US005796103A

United States Patent [19]

Sakai et al.

[11] Patent Number: 5,796,103

[45] Date of Patent: Aug. 18, 1998

[54] CHARGING DEVICE AND DESIGN METHOD THEREOF

[75] Inventors: Takashi Sakai, Kitakatsuragi-gun; Haruo Nishiyama, Nara; Kazuhiro Matsuyama, Ikoma, all of Japan

[73] Assignee: Sharp Kabushiki Kaisha, Osaka, Japan

[21] Appl. No.: 690,730

[22] Filed: Jul. 31, 1996

[30] Foreign Application Priority Data

Aug. 8, 1995 [JP] Japan ..... 7-202473

[51] Int. Cl.[6] ..... H01T 19/04

[52] U.S. Cl. ..... 250/326; 250/324; 361/230; 355/225

[58] Field of Search ..... 250/326, 324, 250/325; 361/225, 230, 2, 229; 355/224, 225

[56] References Cited

U.S. PATENT DOCUMENTS

| | | | |
|---|---|---|---|
| 3,939,386 | 2/1976 | Gallo et al. | 250/326 |
| 4,700,261 | 10/1987 | Nagase et al. | 250/326 |
| 4,725,732 | 2/1988 | Lang et al. | 250/326 |
| 5,359,393 | 10/1994 | Folkins | 355/208 |
| 5,367,366 | 11/1994 | Kido et al. | 355/225 |
| 5,466,938 | 11/1995 | Nakayama et al. | 250/326 |
| 5,521,383 | 5/1996 | Furukawa et al. | 250/324 |

FOREIGN PATENT DOCUMENTS

| | | |
|---|---|---|
| 0 573 758 A3 | 12/1993 | European Pat. Off. . |
| 0 575 731 A3 | 12/1993 | European Pat. Off. . |
| 56-21157 | 2/1981 | Japan . |
| 57-182761 | 11/1982 | Japan . |
| 63-293564 | 11/1988 | Japan . |
| 5-002314 | 1/1993 | Japan . |
| 6-11946 | 1/1994 | Japan . |
| 7-028300 | 1/1995 | Japan . |
| 1481013 | 7/1977 | United Kingdom . |

*Primary Examiner*—Kiet T. Nguyen

[57] ABSTRACT

A charging device is designed in the following manner. Firstly, an optimization of the shape and size of an MC case is performed based on a film thickness and process speed of a photoreceptor (S1). Then, optimization of grid conditions (S2), saw-tooth conditions (S3), a distribution ratio of discharge current (S4) and a grid voltage (S5) are performed respectively, and a minimization of the discharge current is performed (S6). Lastly, surrounding conditions are taken into consideration (S7). The order of performing the processes in S1~S6 is not specified. By designing the charging device so as to have at least one feature obtained by the processes in S2~S7, a stable discharging operation, a uniform charging operation on the surface of the photoreceptor, reduction in amount of ozone generated when discharging, and reduced size and cost of the charging device can be achieved, and the charging device can be designed effectively in a short period of time.

23 Claims, 34 Drawing Sheets

CHARGING DEVICE AND DESIGN METHOD THEREOF

FIELD OF THE INVENTION

The present invention relates to a charging device for use in an image forming apparatus such as a copying machine, a laser printer, etc., more particularly relates to a charging device which generates discharge from a plurality of discharging tip portions provided at predetermined intervals to a photoreceptor to charge the surface thereof.

BACKGROUND OF THE INVENTION

A copying machine with a conventional charging device will be explained below in reference to FIG. 41 and FIG. 42. As shown in FIG. 41, the copying machine includes a photoreceptor 101, a corona discharging device 102 for charging the photoreceptor 101, a developer unit 103 for visualizing an electrostatic latent image formed on the photoreceptor in a form of a toner image using toner, a transfer charger 104 for transferring a resulting visualized toner image on an outer surface of the photoreceptor 101 to a copying material, a cleaning unit 105 for collecting residual toner remaining on the surface of the photoreceptor 101 after transferring the visualized toner image on the outer surface of the photoreceptor 101 onto the copying material, a charge removing lamp 106 for removing residual charges remaining on the photoreceptor 101 after transferring the visualized toner image on the peripheral surface of the photoreceptor 101 onto the copying material, a fixing unit 107 for fixing transferred toner image to be permanent on the copying material, and a copy lamp 108 for projecting light on a document (not shown).

The photoreceptor 101 axially supports a drum-shaped base made of an electrically conductive material such as aluminum, etc., so as to be freely rotatable. The photoreceptor 101 has a photoconductive layer composed of an OPC (Organic Photo Conductor), etc., on the surface of the base.

In the copying machine of the described arrangement, a discharging operation is performed by the corona discharging device 102, and the surface of the photoreceptor 101 is charged uniformly. Then, the copy lamp 108 projects light onto a document, and the uniformly charged surface of the photoreceptor 101 is exposed with light reflected from the document. As a result, an image of the document is formed on the outer surface of the photoreceptor 101 as an electrostatic latent image.

In the developer unit 103, in order to prevent the base from being fogged with toner, the electrostatic latent image is visualized into a toner image while applying a voltage of the same polarity as the charged electric potential of the photoreceptor 101. After the toner image is transferred to a transfer sheet p by the transfer charger 104, the toner image is transported in a direction of an arrow B and is affixed onto the transfer sheet p by the fixing unit 107.

After the toner image is transferred to the transfer sheet p, residual charges remaining on the outer surface of the photoreceptor 101 are removed by the charge removing lamp 106. Then, the surface of the photoreceptor 101 is uniformly charged again by the corona discharging device 102. By repeating the described processes, a copying of the document is repetitively carried out.

Known corona discharging device 102 to be adopted as a charger or a transfer unit etc., in the described copying machine or a printer, etc., in an electrophotographic printing process includes those having the following arrangement: A high voltage of 5 kV to 10 kV is applied to a tungsten wire with a diameter of 50 μm to 100 μm, and resulting ions generated are moved on the surface of the photoreceptor, to charge the entire surface thereof. In the described corona discharge device, in order to stabilize the discharging operation, a shield case is provided with a predetermined distance from the tungsten wire. A corona discharging device provided with a grid electrode for making the electric potential on the surface of the photoreceptor uniform is also known.

However, the described corona discharge device has the following drawback. That is, as an excessive amount of discharge is generated from the tungsten wire to the grid electrode or to the shield case, an amount of ozone generated becomes higher, which causes a deterioration of an image and adversely affects human beings and the environment. Besides, when adopting the tungsten wire, although the structure can be simplified, the tungsten wire is easily disconnected and an application voltage increases which would result in an increase in an amount of ozone generated if the same discharge current is applied.

To solve the described problems, another charging device is known, for example, as disclosed in Japanese Laid-Open Patent Application No. 15272/1988 (Tokukaisho 63-15272) wherein an electrode having a plurality of discharging tip portions formed in a string (plurality of needle-shaped discharge electrodes or saw-toothed discharge electrodes) is provided, in place of the corona charging which uses tungsten wire, to charge the surface of the photoreceptor by generating corona discharge from the discharging tip portions. The described corona discharging device is significantly advantageous over the described discharging device of the wire type in that the amount of ozone generated is reduced to around ⅓ through ¼ if the same discharge current voltage is applied, and that a relatively high structural strength is achieved and a required application voltage can be reduced.

A corona discharging device with a conventional saw-toothed electrode wherein a plurality of electrodes with discharging tip portion are aligned will be explained in reference to FIG. 42.

As shown in FIG. 42, the corona discharging device is arranged such that a plurality of discharge electrodes 111 are formed at predetermined intervals on an insulating substrate 112, and a high voltage is applied from a single power source 113 to the discharge electrodes 111. The described corona discharging device, however, is likely to be affected by differences among respective shapes of the discharge electrodes 111, and a damage, dirt, etc., of the discharge electrodes 111, and such adverse effect would cause variations in discharge current from each discharge electrode 111. Therefore, in order to uniformly charge the photoreceptor 101, an excessive amount of discharge current is required to be applied. As a result, the amount of gas product such as ozone, etc., is increased (by ⅕ compared with the discharging device of the wire type), thereby presenting the problem of adversely affecting human beings, the environment, etc., although the amount of ozone releasing to the outside of the device can be suppressed to some degree by providing an ozone filter.

In general, the sum of the discharge current from respective discharge electrodes 111 is set to be relatively large, i.e., in a range of −700 μA to −800 μA, since it is required to set the discharge current $I_p$ to have a sufficient margin to compensate for the effect from the stabilization of discharge, the life of the device, surrounding conditions, the dirt of the charging device, etc., based on the following mechanism. In consideration of an installation space for the shield case, the conventional discharge gap is set to be around 9 (mm). In this case, the discharge starting voltage $V_{th}$ of about 3.78 kV is given from the equation $V_{th}=(1.2+2L_g/7)$. When the upper limit of the high voltage to be applied to the discharge electrode is set to 7 kV, and the space impedance is set to around 600 MΩ, the upper limit of the discharge current value per pin would be $i_p=-(7,000-3,800)/600\times10^6=-5.3$ μA. This can be converted into the discharge current of the total pins in a range of −700 μA to −800 μA.

In the corona discharging device, the tip to tip pitch P of the discharging tip portions, and the distance D between the discharging tip portions and the photoreceptor surface are set to have appropriate values; otherwise, the surface of the photoreceptor cannot be charged uniformly. Namely, for example, when the pitch P of the discharging tip portions is too small, electric fields of adjacent discharging tip portions would interfere with one another, and this causes the charged electric potential irregularities. On the other hand, when the pitch P is too large, there would arise a significant difference between the portion around the discharging tip portions and other portions, and this also causes the charged electrical potential irregularities. When the distance D is too small, the photoreceptor would be locally discharged, and again this causes the charged electrical potential irregularities. On the other hand, when the distance D is too large, the discharge cannot be performed unless the application voltage is set larger (i.e., a larger high voltage source for discharging is set), thereby presenting the problem that the device becomes large-sized.

To solve the described problem, Japanese Laid-Open Patent Application No. 28300/1995 (Tokukaihei 7-28300) discloses a charging device which permits the surface of the photoreceptor to be uniformly charged (the total discharge current in a range of −200 μA~+100 μA) without generating a large amount of ozone, by specifying the correlation between the distance D between the surface of the photoreceptor and the saw-toothed electrode and the pitch P of the discharging tip portions to satisfy $2\leqq D/P\leqq 8$.

Another discharging device is disclosed, for example, in Japanese Laid-Open Patent Application No. 11946/1994 (Tokukaihei 6-11946), which permits the charged electric potential irregularities to be suppressed without increasing an application voltage to the discharge electrode by setting the grid current $I_g$ flowing through the grid to be equal to the case current $I_c$ flowing through the case ($I_g=I_c$).

In general, the corona discharge has such characteristics that the discharging state varies depending on various conditions. The variations in the discharging state would cause the charged electric potential irregularities on the surface of the photoreceptor and lower the quality of the image formed thereon. For example, the charged electric potential irregularities can be reduced simply by increasing the discharge current. However, to increase the discharge current indicates that a higher voltage is applied to the discharging tip portion. As this increases the size of the high voltage source, the charging device becomes large-sized.

When the amount of discharge current is increased, the amount of ozone generated would increase accordingly. Further, as this adversely affects the surface of the photoreceptor, the quality of the image formed thereon would be lowered. The resulting ozone is bonded to other foreign substances such as gas flowing in the air within the image forming apparatus, and the nitrogen oxide ($No_x$) or silicon oxide (SiO, etc.,) would be produced. The resulting nitrogen oxide or silicon oxide is sucked onto the surface of the discharge electrode and the surface of the grid electrode, and this causes the discharging power of the saw-toothed discharge electrode and the ability of the grid electrode of controlling the grid electrode to be significantly lowered.

Besides, when the discharge current is increased, unwanted leakage discharge leaking from the discharging tip portions to other portion would arise. To prevent this, a more than necessary distance is required to be ensured between the discharging tip portions and the shield case. As this increases the size of the shield, the charging device itself becomes larger in size.

Conventionally, there is no known design method for a charging device that permits a charging device to be designed efficiently in a short period of time while providing a solution to the environmental problems. With regard to the design of the charging device, for example, when determining the shape of the charging device, in general, the shape of the shield case is modified to obtain an optimal shape under various restrictions of the main device that employs the shield case, to temporarily determine the shape of the shield case. Thereafter, other parameters are set. Another charging method has been proposed wherein the grid voltage $V_g$ is set based on charging characteristics in order to maintain stable charging characteristics, as the correlation between the distance $L_{pg}$ from the discharging tip portion to the grid electrode and the opening width $L_c$ of the shield case is not known.

In the described corona discharge device provided with conventional saw-toothed electrode wherein a plurality of electrodes with discharging tip portions are formed, an excessive amount of discharge current would be required to be applied to ensure a uniform charging operation. The method of overcoming the described problem is disclosed, for example, by Japanese Laid-Open Patent Application No. 2314/1993 (Tokukaihei 5-2314). According to the described method, by connecting each discharge electrode to the high voltage power source, the current flowing through each discharge electrode can be controlled under stable condition. The described technique will be explained in detail in reference to FIG. 43.

Such a corona discharging device is arranged such that a common electrode 125 is formed on an insulating substrate 122, and a plurality of needle-shaped discharge electrodes 121 are formed in a predetermined distance, for example, 2 mm apart from the common electrode 125. The common electrode 125 and each discharge electrode 121 are electrically connected by a corresponding control resistor 124. Each control resistor 124 is composed of a resistance element such as a high molecular organic material including a chip resistance, carbon, etc., and has a resistance value of around 1.5 GΩ.

According to the described arrangement, as the voltage applied to the common electrode 125 is lowered by a constant voltage by means of the control resistor 124, the discharge current flowing through each discharge electrode 121 is reduced and stabilized.

However, the described conventional technique has the following drawback.

Namely, in the conventional charging device of Japanese Laid-Open Patent Application No. 28300/1995 (Tokukaihei 7-28300), merely the ratio of the distance D between the surface of the photoreceptor and the saw-toothed electrode with respect to the pitch P of the discharging tip portion is specified, and this would not provide a sufficient solution to prevent the charged electric potential irregularities. This is because, the charged electric potential irregularities vary depending on various factors such as the type of current applied to the discharge electrode (DC current or AC current superimposed on the DC current), and the current value thereof, the distance between the discharging tip portion and t he shield case, surrounding conditions especially humidity, etc. Additionally, in the conventional charging device, the sum of the discharge current is small (−200 μA to +100 μA), and even a slight change in conditions may cause the problem that a discharging operation cannot be stably performed.

Additionally , in the conventional charging device of Japanese Laid-Open Patent Application No. 11946/1994 (Tokukaihei 6-11946), only the condition of $I_g=I_c$ is specified, and again this would not provide a sufficient solution to the charged electric potential irregularities in all possible surrounding conditions. Moreover, as the amount of current increases, there arise other regions where stable charging characteristics can be achieved other than the region satisfying the condition of $I_g=I_c$. However, because of the restriction of $I_g=I_c$, the charging device cannot be designed freely with high efficiency.

With the described conventional technique, under an applied discharge current of not more than −700 μA, a correlation between the discharge current and other parameters is not known. Namely, in a vicinity of a critical value of the discharge current required for preventing charged electric potential irregularities, effects from other parameters cannot be estimated. When only the parameters are specified, in order to determine an appropriate margin, it is required to perform a confirmation test by actually mounting the charging device and to analyze, the results of the test to aid in the designing process, thereby presenting the problem that a long time is required for the entire designing process of the charging device.

On the other hand, in the conventional device of Japanese Laid-Open Patent Application No. 2314/1993 (Tokukaihei 5-2314), it is permitted to lower current. However, in consideration of the margin for the dirt of the discharge electrode and adhesives, etc., the discharge current of several times to several tens of times of the required current amount must be applied. Thus, the problem of generating a large amount of ozone remains unsolved.

SUMMARY OF THE INVENTION

The present invention is achieved in the hope of finding a solution to the above-mentioned problems, and accordingly, an object of the present invention is to provide a compact and inexpensive charging device which permits a stable discharge and the surface of a photoreceptor to be uniformly charged without generating a large amount of ozone during discharge, and to provide a design method which permits the described charging device to be efficiently designed in a short period of time.

To fulfill the above-mentioned object, the first charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the first charging device is arranged such that a discharge current (μA), a grid current (μA) flowing through the grid and a leakage current (μA) leaking from the plurality of discharging tip portions to the electrically conductive case which are respectively designated by a $I_p$ and $I_c$ are all set within an area surrounded by:

(1) a straight line $I_p=-700$, (2) a straight line $\log(I_g/I_c)=-8.78\times10^{-3}I_p-0.54$, and (3) a straight line $\log(I_g/I_c)=5\times10^{-3}I_p+0.68$, in a coordinate system formed by a $\log(I_g/I_c)$ axis that is a common logarithm of $(I_g/I_c)$ and an axis of $I_p$ indicating the discharge current.

According to the described arrangement, a discharge current flows through the photoreceptor from each discharging tip portion according to the voltage applied thereto and a voltage applied to the grid to charge the surface of the photoreceptor.

In the conventional arrangement, a uniform charge is enabled by applying the grid current $I_g$ as much as possible. The charging device having the described arrangement of the present invention has an advantageous feature over the described conventional arrangement in that a uniform charge can be achieved by setting appropriate values for the grid current $I_g$, the case current $I_c$ and the discharge current $I_p$ for each level of the discharge current $I_p$ in consideration of the correlation with the case current $I_c$.

Here, the discharge current $I_p$ is expressed by the sum of the grid current $I_g$, the case current $I_c$ and the current flowing through the photoreceptor, and the discharge stability and the degree of charged electric potential irregularities vary according to the set ratio of $I_p/I_c$. As to the discharge current $I_p$, the greater the discharge current $I_p$, the more stably the surface of the photoreceptor can be charged; however, the greater the amount of ozone generated. On the other hand, when the discharge current $I_p$ is small, the amount of ozone generated can be reduced; however, the absolute values for the grid current $I_g$ and the case current $I_c$ and the ratio of $I_g/I_c$ would greatly affect the uniformity of charges.

According to the described arrangement, as the discharge current $I_p$ is set small, i.e., in a range of not more than −700 (μA), the high voltage generating section can be made compact, thereby permitting a reduction in size of the charging device. Moreover, a discharging operation can be stably performed. The feature that the discharge current $I_p$ is set small, i.e., in the range of not more than −700 (μA) offers an additional effect that the amount of ozone generated can be reduced. Furthermore, the grid current $I_g$ and the case current $I_c$ are also taken into consideration as parameters, and the respective values for the grid current $I_g$, case current $I_c$ and discharge current $I_p$are all set within the range surrounded by the described straight lines (1) through (3). Therefore, the uniformity of discharge can be maintained under normal surrounding conditions, and the generation of charged electric potential irregularities on the surface of the photoreceptor can be surely prevented.

To fulfill the above-mention ed object, the second charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the second charging device is arranged such that a discharge current (μA), a grid current (μA) flowing through the grid and a leakage current (μA) leaking from the plurality of discharging tip portions to the electrically conductive case which are respectively designated by $I_p$, $I_g$, and $I_c$ are all set within an area surrounded by:

(1) a straight line $I_p=-400$, (2) a straight line $\log(I_g/I_c)=-8.78\times10^{-3}I_p-2.32$, and (3) a straight line $\log(I_g/I_c)=5\times10^{-3}I_p+1.68$ in a coordinate system formed by a $\log(I_g/I_c)$ axis that is a common logarithm of $(I_g/I_c)$ and an $I_p$ axis indicating the discharge current.

According to the described arrangement, a discharge current is applied to the photoreceptor from each discharging tip portion according to the voltage applied thereto and a voltage applied to the grid to charge the surface of the photoreceptor.

In the described arrangement, as the discharge current $I_p$ is set small, i.e., in a range of not more than −400 (μA), an amount of ozone generated can be reduced to an ignorable level, and the high voltage generating section can be made compact which permits a reduction in size of the charging device. More over, a discharging operation can be stably performed. The feature that the discharge current $I_p$ is set even smaller than the aforementioned range of the first charging device enables an amount of ozone generated to be reduced to an ignorable level, and this eliminates the need of the ozone filter required in the conventional charging device. Such elimination of the ozone filter offers a wider design choice with regard to space, and enables the charging device to meet various standard requirements set with regard to an amount of ozone generated. Furthermore, the grid current $I_g$ and the case current $I_c$ are also taken into consideration as parameters, and the respective values for the grid current $I_g$, the case current $I_c$ and the discharge current $I_p$ are all set within a range surrounded by the straight lines (1) through (3). The described feature permits a uniformity of discharge to be maintained even under the most unfavorable surrounding conditions (for example, an ambient temperature of around 35 ° C., and a relative humidity of 85%), thereby surely preventing the generation of charged electric potential irregularities on the surface of the photoreceptor.

To fulfill the above-mentioned object, the third charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the third charging device is arranged such that a discharge current (μA), a grid current (μA) flowing through the grid, a leakage current (μA) leaking from the plurality of discharging tip portions to the electrically conductive case and an absolute ambient temperature (g/m$^3$) which are respectively designated by $I_p$, $I_g$, $I_c$ and $D_H$ are all set within an area surrounded by:

(1) a straight line $I_p=-400$, (2) a straight line $\log(I_g/I_c)=-8.78\times10^{-3}I_p-(0.07\times D_H-0.16)$, and (3) a straight line $\log(I_g/I_c)=5\times10^{-3}I_p+(0.04\times D_H+0.28)$, in a coordinate system formed by a $\log(I_g/I_c)$ axis that is a common logarithm of $(I_g/I_c)$, and an $I_p$ axis indicating the discharge current.

According to the described arrangement, a discharge current is applied to the photoreceptor from each discharging tip portion according to the voltage applied thereto and a voltage applied to the grid to charge the surface of the photoreceptor.

In the described arrangement, as the discharge current $I_p$ is set small, i.e., in a range of not more than −400 (μA), the amount of ozone generated can be reduced to an ignorable level, and the high voltage generating section can be made compact which permits a reduction in size of the charging device. Moreover, a discharging operation can be stably performed. Thus, the need of an ozone filter required in the conventional charging device is eliminated, while meeting various standard requirements set with regard to an amount of ozone generated.

Furthermore, the ambient humidity $D_H$ is also taken into consideration as a parameter in addition to the grid current $I_g$ and the case current $I_c$, the uniformity of charge can be maintained according to any surrounding conditions (ambient temperature and relative humidity). Namely, a desired absolute humidity $D_H$ is substituted in the described straight lines (2) and (3), and the respective values for the grid current $I_g$, the case current $I_c$ and the discharge current $I_p$ are all set within a range surrounded by the straight lines (1) through (3), to maintain the uniformity of discharge at any possible surrounding conditions from the normal surrounding conditions to the most unfavorable surrounding conditions, thereby surely preventing the generation of charged electric potential irregularities on the surface of the photoreceptor. Therefore, the described arrangement permits respective values for the above-mentioned parameters to be determined only by specifying the absolute humidity.

To fulfill the above-mentioned object, the fourth charging device in accordance with the present invention having the arrangement of the first, second or third charging device is characterized in that:

the grid current $I_g$ flowing through the grid and the leakage current $I_c$ leaking from the plurality of discharging tip portions to the electrically conductive case satisfy $1<(I_g/I_c)\leqq10$.

The described arrangement offers an effect that the charging device which permits the uniformity of discharge to be maintained, while surely preventing charged electric potential irregularities on the surface of the photoreceptor can be designed efficiently in addition to the effects achieved by the first through third charging devices Namely, by increasing the grid current $I_g$, the current flowing through the photoreceptor can be stabilized. On the other hand, when the case current $I_c$ is inreased, the current flowing through the photoreceptor is reduced as well as the grid current $I_g$, and becomes unstable. Therefore, it is effective to set the grid current of greater than the case current $I_c$ within the range of $1<(I_g/I_c)\leqq10$ to prevent the generation of the charged electric potential irregularities. For example, by applying a negative voltage to the electrically conductive case, the grid current $I_g$ can be set larger than the case current $I_c$.

To fulfill the above-mentioned object, the fifth charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the fifth charging device is arranged such that an opening width (mm) of the electrically conductive case, a process speed (mm/sec), and a film thickness (μm) of the photoreceptor which are respectively designated by $L_c$, $v_p$ and $t_{opc}$ are all set within an area surrounded by:

(1) a straight line $L_c=30$, and (2) a straight line $L_c=3.02\times10^{-6}(v_p/t_{opc})$ in a coordinate system formed by an axis $L_c$ and an axis $v_p$.

According to the described arrangement, a discharge current is applied to the photoreceptor from each discharging tip portion according to the voltage applied thereto and a voltage applied to the grid to charge the surface of the photoreceptor.

Under a fixed discharge current, the higher the process speed $v_p$, the greater opening width $L_c$ of the electrically conductive case is required; otherwise, the time required for charging becomes long and it cannot be ensured that the surface of the generated charged electric potential on the photoreceptor is charged promptly. Therefore, the opening width $L_c$ is required to be set larger in proportion to the process speed $v_p$. The film thickness of the photoreceptor also affects the charging characteristics. Namely, the thicker the film of the photoreceptor, the more charges can be maintained, and the photoreceptor can be charged more promptly. Additionally, the thicker the film of the photoreceptor, the smaller the opening width $L_c$ obtained.

When the upper limit of the voltage to be applied to the discharge electrode is set to 7 kV in consideration of cost and space, based on the corresponding discharge gap which permits a discharge operation to be performed, the electrically conductive case would have the upper limit of the opening width $L_c$ of 30 (mm). If the opening width $L_c$ is set any greater, a discharging operation cannot be stably performed. On the other hand, the lower limit for the opening width $L_c$ required for ensuring a stable discharge is determined with respect to a desired process speed $v_p$ based on the straight line of the formula (2).

As described, by setting the opening width $L_c$, and the process speed $v_p$ and the film thickness $t_{opc}$ of the photoreceptor within the range surrounded by the straight lines of the formulae (1) and (2), the photoreceptor can be charged more quickly, while ensuring a stable discharging operation, thereby uniformly charging the surface of the photoreceptor.

The described arrangement provides the charging device which permits the charge to be generated more promptly and also permits the charging operation to be performed always stably, while uniformly charging the surface of the photoreceptor. Conventionally, the shape of the electrically conductive case has significant effect and dependencies on electrical parameters and mechanical parameters in determining other charging specifications, which makes the determination of the shape difficult. However, the described arrangement of the present invention enables the upper limit for the opening width of the electrically conductive case to be estimated, thereby permitting the desired opening width to be designed efficiently in a short period of time.

To fulfill the above-mentioned object, the sixth charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the sixth charging device is arranged such that an opening width (mm) of the electrically conductive case, and a distance between the plurality of discharge electrodes and the grid which are respectively designated by $L_c$ and $L_{pg}$ are set so as to satisfy $0.4 \leqq L_{pg}/L_c < 0.5$.

According to the described arrangement, a discharge current is applied to the photoreceptor from each discharging tip portion according to the voltage applied thereto and a voltage applied to the grid to charge the surface of the photoreceptor.

Here, by setting the distance $L_{pg}$ between the discharging tip portions and the grid larger, the discharge starting voltage is increased, and the charging device becomes large-sized. When an attempt is made to reduce the size of the charging device, there faces an upper limit for the application voltage to the discharge electrode in view of cost and space, and the discharge cannot be stably performed at an application voltage any greater than the upper limit value. Additionally, to ensure the function of controlling the ratio of $(I_g/I_c)$, the opening width $L_c$ of the electrically conductive case cannot be made too large because if the opening width $L_c$ is set any greater than the upper limit for the opening width $L_c$, the amount of the case current $I_c$ would be reduced, and a stable discharge cannot be performed. Therefore, by setting the opening width $L_c$ and the distance $L_{pg}$ so as to satisfy the condition of $0.4 \leqq L_{pg}/L_c < 0.5$, a discharging operation can be stably performed.

As described, by determining the distance $L_{pg}$ and the opening width $L_c$, the shape of the electrically conductive case can be estimated to some extent. This, in turn, permits the subsequent process of designing the charging device to be performed efficiently in a short period of time. Namely, by determining either one of $L_{pg}$ and $L_c$, the shape of the electrically conductive case can be substantially determined. Therefore, the charging device having the described arrangement can be applied to the compact electrically conductive case with ease.

To fulfill the above-mentioned object, the seventh charging device in accordance with the present invention provided with a discharge electrode having a plurality of discharging tip portions, which generates discharge from the plurality of discharging tip portions with respect to a photoreceptor via a grid according to a voltage applied to the discharge electrode in order to charge the surface of the photoreceptor has the following feature.

Namely, when the seventh charging device is arranged such that a lower limit value of a discharge current required for charging the surface of the photoreceptor to the predetermined potential and a lower limit value of a discharge current required for suppressing charged electric potential irregularities on the surface of the photoreceptor within a permissible range which are respectively designated by $I_{p1}$ and $I_{p2}$, the voltage to be applied to the grid is set so as to satisfy $I_{p1} \approx I_{p2}$.

According to the described arrangement, a discharge current can be applied to the photoreceptor from each discharging tip portion according to the voltage applied thereto and a voltage applied to the grid to charge the surface of the photoreceptor.

By setting the grid voltage greater, the photoreceptor can be charged more promptly and a time required for obtaining a saturated potential can be reduced. This offers improved charging characteristics but increases charged electric potential irregularities. On the other hand, by setting the grid voltage smaller, the charged electric potential irregularities can be suppressed. In order to stabilize the saturated potential and suppress the charged electric potential irregularities on the surface of the photoreceptor, a larger discharge current is required; however, if a larger amount of discharge current is applied, the amount of ozone generated would be increased. Therefore, it is required to set the application voltage to the grid in such a manner that the saturated potential is stabilized while suppressing the charged electric potential irregularities within a permissible range.

According to the described arrangement, the voltage is applied to the grid so as to satisfy the condition of $I_p \approx I_{p2}$. Therefore, even with an application of small discharge current, the surface of the photoreceptor can be uniformly charged, while stabilizing the saturated potential and suppressing the charged electric potential irregularities within the permissible range.

As a result, the grid voltage can be determined so as to minimize the discharge current, and the amount of ozone generated can be reduced compared with the conventional method of determining the grid voltage. Additionally, the feature that the discharge current is minimized offers an effect of reducing the size of the high voltage generating section and reducing the power consumption. Additionally, even with a minimum discharge current, the surface of the photoreceptor can be uniformly charged while stabilizing a saturated potential and suppressing the charged electric potential irregularities to a permissible range.

To fulfill the above-mentioned object, the eighth charging device in accordance with the present invention provided with a discharge electrode having a plurality of discharging tip portions, which generates discharge from the plurality of discharging tip portions with respect to a photoreceptor via a grid according to a voltage applied to the discharge electrode in order to charge the surface of the photoreceptor has the following feature.

Namely, the eighth charging device is arranged such that a pitch (mm) of the discharging tip portions, a discharging current (μA), and a distance (mm) between the discharging tip portions and the surface of the photoreceptor which are respectively designated by P, $I_p$ and $L_g$ are set within an area surrounded by:

(1) a straight line $I_p=-700$, and (2) a curved line $I_p=[-89((L_g/P)-4.5)^2-295]$ in a coordinate system formed by an $I_p$axis and an $(L_g/P)$ axis.

According to the described arrangement, a discharge current is applied to the photoreceptor from each discharging tip portion according to the voltage applied thereto to charge the surface of the photoreceptor. As a result, a generation of charged electric potential irregularities can be surely prevented.

Here, if the pitch P is too small, electric fields of adjacent discharging tip portions would interfere with each other, which would be the cause of discharging irregularities. On the other hand, if the pitch is set too large, there arise a great difference in discharge voltage between the region surrounding the discharging tip portions and other regions, which would be the case of the charged electric potential irregularities. Furthermore, when the distance $L_g$ is set too small, the photoreceptor is discharged locally, and the charged electric potential irregularities would occur. On the other hand, if the distance $L_g$ is set too large, an increase in application voltage (high voltage source for discharge) is required; otherwise, the discharging operation cannot be performed, thereby presenting the problem that the charging device is large-sized. Furthermore, the larger the discharge current $I_p$, the more stably the surface of the photoreceptor can be charged; however, a greater amount of ozone is generated. On the other hand, the smaller the total discharge current, the smaller the amount of ozone generated; however, a stable discharging operation cannot be performed.

According to the described arrangement, however, as the discharge current $I_p$ is set small, i.e., in a range of not more than −700 (μA), the high voltage generating section can be made compact, thereby enabling a reduction in size of the charging device. The feature that the discharge current is set small, i.e., in the range of not more than −700 (μA) enables the amount of ozone generated to be reduced, and the charging device to meet various standard requirements set with regard to an amount of ozone generated. Moreover, as not only $L_g$ and P, but also $I_p$ are taken into consideration as parameters, and the respective values for $I_p$ and $(L_c/P)$ are set within the range surrounded by the straight line (1) and the curved line (2), the generation of the charged electric potential irregularities can be surely prevented. In this case, it is preferable to determine the optimal value of the pitch P corresponding to the distance $L_g$ after the value for $(L_g/P)$ is determined. As a result, in the process of designing the charging device, if a space for installing the charging device is ensured, by determining the value for $L_g$ after the $(L_g/P)$ is determined, an optimal value for P can be determined. On the other hand, with a fixed P, the size of the installation space of the charging device can be determined from the pitch P.

To fulfill the above-mentioned object, a design method for a charging device which generates discharge with respect to a photoreceptor from a plurality of discharging tip portions formed at predetermined intervals via a grid to charge the surface of the photoreceptor is characterized by including the following steps.

Namely, the design method for the charging device having the described arrangement includes the steps of:

(1) setting an opening width $L_c$ (mm) of an electrically conductive case and a distance $L_{pg}$ between the plurality of discharging tip portions and the grid so as to satisfy the condition of $0.4 \leqq L_{pg}/L_c < 0.5$, (2) setting a grid gap and a grid pitch;

(3) setting a pitch P of the discharging tip portions, a discharge current $I_p$ (μA) and a distance $L_g$ between the plurality of discharge tip portions and the surface of the photoreceptor within an area surrounded by a straight line $I_p=-700$, and a curved line $I_p=[-89((L_g/P)-4.5)^2-295]$ in a coordinate system formed by an $I_p$ axis and an $(L_g/P)$ axis;

(4) setting a discharge current $I_p$ (μA), a grid current $I_g$ (μA) and leakage current $I_c$ (μA) leaking from the discharging tip portions to the electrically conductive case within an area surrounded by a straight line $I_p=-700$, a straight line $\log(I_g/I_c)=-8.78\times10^{-3}I_p-0.54$ and a straight line $\log(I_g/I_c)=5\times10^{-3}I_p+0.68$ in a coordinate system formed by a $\log(I_g/I_c)$ axis that is a common logarithm of $(I_g/I_c)$ and an $I_p$ axis indicating the discharge current;

(5) setting a voltage to be applied to the grid such that a minimum discharge current value required for charging the surface of the photoreceptor to a predetermined potential is equal to a minimum discharge current required for suppressing charged electric potential irregularities on the surface of the photoreceptor within a permissible range; and (6) setting a margin of the discharge current based on changes in charged electric potential of the photoreceptor and in charged electric potential irregularities due to changes in environmental conditions.

According to the described arrangement, as respective parameters are set as described in respective steps (1) through (6), the reduction in the amount of ozone generated, the reduction in the size of the charging device, and the reduction in manufacturing cost can be achieved. Additionally, the described design method offers a significantly improved efficiency and a shorter time required for completing an optimal design as compared to the conventional design method.

To fulfill the above-mentioned object, the ninth charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the ninth charging device is arranged such that a discharge current (μA), a current (μA) flowing through the grid, a leakage current (μA) leaking from the discharging tip portions to the electrically conductive case, and a current (μA) flowing through the photoreceptor which are respectively designated by $I_p$, $I_g$, $I_c$ are set within an area surrounded by:

(1) $(I_g/I_d)+(I_c/I_d)=6$ , (2) $(I_g/I_d)+(I_c/I_d)=8$, (3) $(I_c/I_d)=1$, and (4) $(I_g/I_d)=1$, in a coordinate system formed by an $(I_g/I_d)$ axis and an $(I_c/I_d)$ axis.

According to the described arrangement, a discharge current is applied to the photoreceptor from each discharging tip portion according to the voltage applied thereto and a voltage applied to the grid to charge the surface of the photoreceptor. However, an amount of ozone generated would increase.

Here, the greater the discharge current, the more stably the discharging operation can be performed, and the smaller are the charged electric potential irregularities on the surface of the photoreceptor. On the other hand, an amount of ozone generated increases. Provided that no leakage current is generated, the discharge current is expressed by the summation of the grid current $I_g$, the drum current $I_d$ and the case current $I_c$. Like the discharge current, the grid current $I_g$ and the case current $I_c$ vary according to $L_{pg}/l_c$ representing the ratio of the distance $L_{pg}$ between the grid and the discharging tip portions to the distance $l_c$ between the electrically conductive case and the discharging tip portions, while $I_d$ is maintained constant irrespectively of the ratio of $L_{pg}/l_c$. Therefore, in order to perform a uniform discharging operation without increasing the overall size of the charging device, it is required to suppress the discharge current while satisfying a specific relative correlation among the grid current $I_g$, the drum current $I_d$ and the case current $I_c$.

In the described arrangement, as the grid current $I_g$ and the case current $I_c$ are set within the range of $L_{pg}/l_c$ where both the grid current $I_g$ and the case current $I_c$ are not less than the grid current $I_d$ ((3) and (4)) and the sum of $(I_g/I_d)$ and $(I_c/I_d)$ is in a range of 6 to 8 ((1) and (2)), the discharge current can be suppressed to a level that the amount of ozone generated does not create any problems, and a uniform discharging operation can be performed, thereby surely suppressing the charged electric potential irregularities on the surface of the photoreceptor.

To fulfill the above-mentioned object, the tenth charging device in accordance with the present invention provided with a discharge electrode having a plurality of discharging tip portions and an electrically conductive case for supporting the discharge electrode in an electrically insulated state from the discharge electrode, which generates discharge from the plurality of discharging tip portions with respect to a photoreceptor via a grid according to a voltage applied to the discharge electrode in order to charge the surface of the photoreceptor has the following feature.

Namely, the tenth charging device is arranged such that a minimum discharge current (μA) for uniformly charging the surface of the photoreceptor is applied to the discharge electrode, and a grid current (μA) flowing through the grid, a leakage current (μA) leaking from the plurality of discharging tip portions to the electrically conductive case, and a current (μA) flowing through the photoreceptor which are respectively designated by $I_g$, $I_c$ and $I_d$ are all set within an area surrounded by:

(1) $(I_g/I_d)+(I_c/I_d)=6$, (2) $1\leqq(I_c/I_d)\leqq5$, and (3) $1\leqq(I_g/I_d)\leqq5$ in a coordinate system formed by an $(I_g/I_d)$ axis and an $I_c/I_d$ axis.

According to the described arrangement, a discharge current is applied to the photoreceptor from each discharging tip portion according to the voltage applied thereto and a voltage applied to the grid to charge the surface of the photoreceptor. Here, in order to uniformly perform a discharging operation without increasing the overall size of the charging device, it is required to suppress the discharging current while satisfying a specific correlation among the grid current $I_g$, the drum current $I_d$ and the case current $I_c$.

When the discharge current of the lower limit value required for uniformly charging the surface of the photoreceptor is applied to the discharge electrode, $(I_g/I_d)$ and $(I_c/I_d)$ vary within a range of from 1 to 5 and the range of $L_{pg}/l_c$ where both the grid current $I_g$ and the case current $I_c$ are not less than the drum current $I_d$. Therefore, by setting the respective values for the grid current $I_g$, the case current $I_c$ and the drum current $I_d$ to satisfy the condition that the sum of $(I_g/I_d)$ and $(I_c/I_d)$ is 6 within the described range, the discharge current can be minimized for each $L_{pg}/l_c$, and the amount of ozone generated can be significantly reduced as compared to the conventional arrangement, thereby sufficiently meeting the standard requirements applied with regard to environmental problems. Moreover, a discharging operation can be performed uniformly, thereby surely suppressing the charged electric potential irregularities on the surface of the photoreceptor.

To fulfill the above-mentioned object, the eleventh charging device having the arrangement of the tenth charging device is characterized in that $(I_g/I_d)=(I_c/I_d)=3$.

In this arrangement, the condition of $I_g:I_c:I_d=3:3:1$ is satisfied. When the grid current $I_g$, the case current $I_c$ and the drum current $I_d$ have the described relative correlation, the charged electric potential irregularities of the photoreceptor is minimized, and the discharge current required for the uniform charge is also minimized. Namely, by setting the grid current $I_g$, the case current $I_c$ and the drum current $I_d$ so as to satisfy the described condition, the charged electric potential irregularities and the discharge current can be minimized, thereby permitting a reduction in size of the charging device.

To fulfill the above-mentioned object, the twelfth charging device having the arrangement of ninth or tenth charging device is arranged such that when a voltage equal to the grid voltage is applied to the electrically conductive case, a distance $L_{pg}$ between the plurality of discharging tip portions and the grid and a distance $l_c$ between the discharging tip portions and the electrically conductive case are set so as to satisfy the conditions of:

(1) $I_g\geqq I_d$, and (2) $I_c\geqq I_d$.

In the described arrangement, the conditions of both (1) and (2) are satisfied. Here, the grid current $I_g$ and the case current $I_c$ vary in response to the ratio of $L_{pg}/l_c$ like the discharge current, while the grid current $I_d$ is maintained substantially constant irrespectively of the ratio of $L_{pg}/l_c$. By satisfying the conditions of (1) and (2), the discharge current for uniformly charging the surface of the photoreceptor can be suppressed, and the charged electric potential irregularities can be still reduced. The described effect of reducing the discharge current would offer an additional effect of reducing an amount of ozone generated, thereby providing a sufficient solution to environmental problems.

To fulfill the above-mentioned object, the thirteenth charging device having the arrangement of ninth or tenth charging device is arranged such that when a voltage equal to the grid voltage is applied to the electrically conductive case, a distance $L_{pg}$ between the discharging tip portions and the grid and a distance $l_c$ between the discharging tip portions and the electrically conductive case are set so as to satisfy $(L_{pg}/l_c)\approx 1.1$.

According to the described arrangement, the distance $L_{pg}$ and the distance $l_c$ are respectively set so as to satisfy the condition that the ratio of $(L_{pg}/l_c)$ is substantially 1.1. In addition to the effects achieved by the ninth and tenth charging devices, this feature offers a particular effect of the present invention that the charged electric potential irregularities can be minimized while minimizing the discharge current required for performing a uniform discharge. As the discharge current is minimized, the amount of ozone generated can be minimized, thereby providing a sufficient solution to the environmental problems.

To fulfill the above-mentioned object, the fourteenth charging device in accordance with the present invention provided with a discharge electrode having a plurality of discharging tip portions and an electrically conductive case for supporting the discharge electrode, which generates discharge from the plurality of discharging tip portions with respect to a photoreceptor via a grid according to a voltage applied to the discharge electrode in order to charge the surface of the photoreceptor has the following feature.

Namely, the fourteenth charging device is arranged such that when a current (μA) flowing through the electrically conductive case in the discharging current $I_p$ (μA) is designated by $I_c$, $I_c$ and $I_p$ are set so as to satisfy the condition of $0.1\leqq(I_c/I_p)\leqq 0.8$.

According to the described arrangement, a discharge current flows from each discharging tip portion to the photoreceptor according to a voltage applied to the discharge electrode and a voltage applied to the grid in order to charge the surface of the photoreceptor.

The minimum discharge current for preventing the charged electric potential irregularities, the voltage applied to the discharge electrode and the power consumption in the charging device are reduced within the range of $0.1\leqq(I_c/I_p)\leqq 0.8$. Therefore, by setting the case current $I_c$ and the discharge current $I_p$ within the range of $0.1\leqq(I_c/I_p)\leqq 0.8$, the surface of the photoreceptor can be charged without generating the charged electric potential irregularities with a smaller discharge current, while reducing the application voltage and the power consumption. Additionally, as the discharge current is small, the amount of ozone generated can be reduced, thereby providing a sufficient solution to the environmental problems.

To fulfill the above-mentioned object, the fifteenth charging device in accordance with the present invention provided with a discharge electrode having a plurality of discharging tip portions, each discharge electrode being connected to a power source through a resistor, which generates discharge from the plurality of discharging tip portion to the photoreceptor according to the voltage applied to the discharge electrode in order to charge the surface of the photoreceptor has the following features:

That is, the fifteenth charging device has a resistance value in a range of from 500 MΩ to 2,500 MΩ.

According to the described arrangement, the discharge current flows from each discharging tip portion to the photoreceptor according to the voltage applied to the discharge electrode through the resistor an d the voltage applied to the grid to charge the surface of the photoreceptor. Here, the larger the resistance value of the resistor, the more absorbed are the discharged electric potential irregularities, and the discharge current would be reduced.

Here, the greater is the resistance value of the resistor, the higher is the voltage applied to the resistor. However, in view of cost, space, etc., normally, the high voltage has the upper limit of around 7 kV. Here, the resistance value for the resistor corresponds to 2,500 MΩ. On the other hand, if the resistor has a resistance value of less than 500 MΩ, the lower limit value for the discharge current required for preventing the charged electric potential irregularities greatly vary depending on the space impedance (the impedance between the discharging tip portions and the surface of the photoreceptor, which is varied in a range of 150 MΩ to 950 MΩ depending on the environmental conditions including humidity, etc.).

As described, by setting the resistance value for the resistor in a range of from 500 MΩ to 2,500 MΩ, an inexpensive charging device which charges the surface of the photoreceptor uniformly irrespectively of the space impedance can be achieved without increasing the size thereof.

To fulfill the above-mentioned object, the sixteenth charging device provided with a discharge electrode having a plurality of discharging tip portions and an electrically conductive case for supporting the discharge electrode in an electrically insulated state from the discharge electrode, which generates discharge from the plurality of discharging tip portions with respect to a photoreceptor via a grid in order to charge the surface of the photoreceptor has the following feature.

Namely, the sixteenth charging device in accordance with the present invention includes:

means for detecting a current $I_c$ (μA) flowing through the electrically conductive case from the discharge electrode, wherein:

a discharge current (μA), a grid current (μA) flowing through the grid from the discharge electrode, and a current (μA) flowing in air from the discharge electrode which are respectively designated by $I_p$, $I_g$ and $I_L$, and $A=(I_p-7I_c/3)$, the $I_L$ is compensated by feeding back $\Delta I_p$ satisfying the condition of $A\leqq\Delta I_p\leqq(A+A^2/I_p)$ to the discharge current $I_p$.

According to the described arrangement, the discharge current is applied from each discharging tip portion to the photoreceptor according to the voltage applied to the discharge electrode and the voltage applied to the grid, thereby charging the surface of the photoreceptor.

Here, under the conditions of normal temperature and normal humidity, the current $I_L$ flowing from the discharge electrode in the air is substantially zero. However, when bringing the surrounding conditions from normal temperature and humidity to high temperature and high humidity, the current $I_L$ starts increasing. This reduces the grid current $I_g$, the case current $I_c$ and the current flowing through the photoreceptor, resulting in the problem of an unstable discharging operation and the charged electric potential irregularities on the surface of the photoreceptor.

However, according to the described arrangement, as the case current $I_c$ flowing from the discharge electrode to the electrically conductive case is detected by the detection means, and the discharge current $\Delta I_p$ satisfying the condition of $A\leqq\Delta I_p\leqq(A+A^2/I_p)$ is fed back to the discharge current $I_p$, respective amounts of reduction in the grid current $I_g$, the case current $I_c$ and the current flowing through the photoreceptor by the current $I_L$ are compensated, thereby permitting a stable discharge, without generating charged electric potential irregularities on the surface of the photoreceptor.

Especially, when adjusting $I_L$ by feeding back $\Delta I_p$ which satisfies the condition of $\Delta I_p$=A, the charged electric potential irregularities on the surface of the photoreceptor can be suppressed within 30 V. Additionally, by feeding back $\Delta I_p=(A+A^2/I_p)$ to the discharge current $I_p$ to compensate for the current $I_L$, the level of charged electric potential irregularities can be suppressed to the level of normal temperature and normal humidity.

The novel features which are considered as characteristic of the invention are set forth in particular in the appended claims. The improved treatment method, as well as the construction and mode of operation of the improved treatment apparatus, will, however, be best understood upon perusal of the following detailed description of certain specific embodiments when read in conjunction with the accompanying drawings.

DESCRIPTION OF THE EMBODIMENTS

The following descriptions will discuss one embodiment of the present invention in reference to FIG. 1 through FIG. 32.

Figure 2:
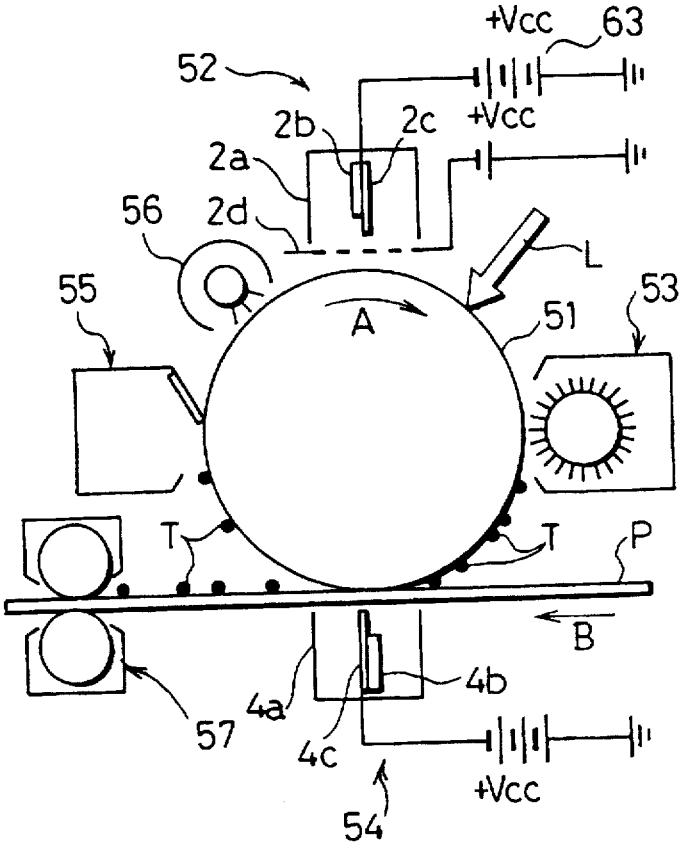
FIG. 2 is an explanatory view showing a structure of an example of a copying machine provided with a charging device of the present invention.

As shown in FIG. 2, a copying machine with a charging device in accordance with the present embodiment includes a photoreceptor drum 51 whose outer surface is exposed with light L reflected from a document (not shown) by carrying out an optical scanning. The photoreceptor drum 51 axially supports a base in a drum shape made of an electrically conductive material such as aluminium, etc., so as to be freely rotatable, and has a photoconductive layer made of an OPC (organic photo conductor), etc., on a circumference of the base. The photoreceptor drum 51 is rotatably driven in a direction of an arrow A in the figure. The outer surface of the photoreceptor drum 51 that is uniformally charged is exposed with the reflected light L, and an electrostatic latent image corresponding to an image pattern of the document is formed thereon.

Along the circumference of the photoreceptor 51, provided are an MC charger (main charger) 52, a developing unit 53, a cleaning unit 55 and a charge removing lamp 56. The MC charger 52 is provided for charging the outer surface of the photoreceptor drum 51 to a predetermined potential. The developing unit 53 is provided for visualizing an electrostatic latent image formed on the photoreceptor drum 51 in a form of a toner image using toner T. The cleaning unit 55 is provided for collecting toner T remaining on the photoreceptor drum 51. The charge removing lamp 56 is provided for removing residual charges remaining on the photoreceptor drum 51.

On the downstream side in the transporting direction of a transfer sheet p (in a direction of an arrow B in the figure) between the photoreceptor drum 51 and a transfer charger 54, provided is a fixing unit 57 for making a transferred toner image permanent on the transfer sheet p. The described MC charger 52 and the transfer charger 54 are respectively composed of charging devices of the present invention.

The MC charger 52 is composed of an MC case 2a (electrically conductive case), an insulating substrate 2b, a plurality of discharge electrodes 2c and a grid 2d. The MC case 2a has a cross-section of a substantially square union shape. The insulating substrate 2b is made of glass, epoxy, or the like and is supported in the MC case 2a. Each discharge electrode 2c (with a thickness of 0.1 mm) is made of stainless steel, to which a high voltage (for example, a negative high voltage of $-V_{cc}$) is applied from a high voltage generating section 63 that is fixed to the insulating substrate 2b. The grid 2d is provided between the discharge electrode 2c and the photoreceptor drum 51, and a predetermined high voltage is applied thereto. The discharge electrode 2c has, for example, 107 saw-toothed discharging tip portions (see FIG. 10). The discharging tip portions are formed, for example, at a tip to tip pitch of 2 mm and are projected from the surface of the insulating substrate 2b, for example, by 2 mm.

When a high voltage (for example, −3.5 kV) is applied to the discharge electrode 2c from the high voltage generating section 63, the MC charger 52 charges the outer surface of the photoreceptor drum 51 by generating corona discharge from each discharging tip portion. When a voltage of −620 V is applied to the grid 2d from the high voltage generating section 63, the grid 2d controls an amount of discharge from each discharging tip portion of the discharge electrode 2c to make a charge potential of the outer surface of the photoreceptor drum 51 to a predetermined potential (for example, −600 V).

The transfer charger 54 has the same structure as the MC charger 52 expect the grid 2d. Namely, the transfer charger 54 is composed of a shield case 4a having a cross-section of a substantially square union shape, an insulating substrate 4b that is made of epoxy, or the like, and is supported in the shield case 4a, and a plurality of discharge electrodes 4c to which a high voltage (for example, a negative high voltage of $-V_{cc}$) is applied from the high voltage generating section 63 fixed to the insulating substrate 4b. The discharge electrode 4c has, for example, 107 saw-toothed discharging tip portions. The discharging tip portions are formed, for example, at a tip to tip pitch of 2 mm and are projected from the surface of the insulating substrate 4b, for example, by 2 mm.

Figure 1:
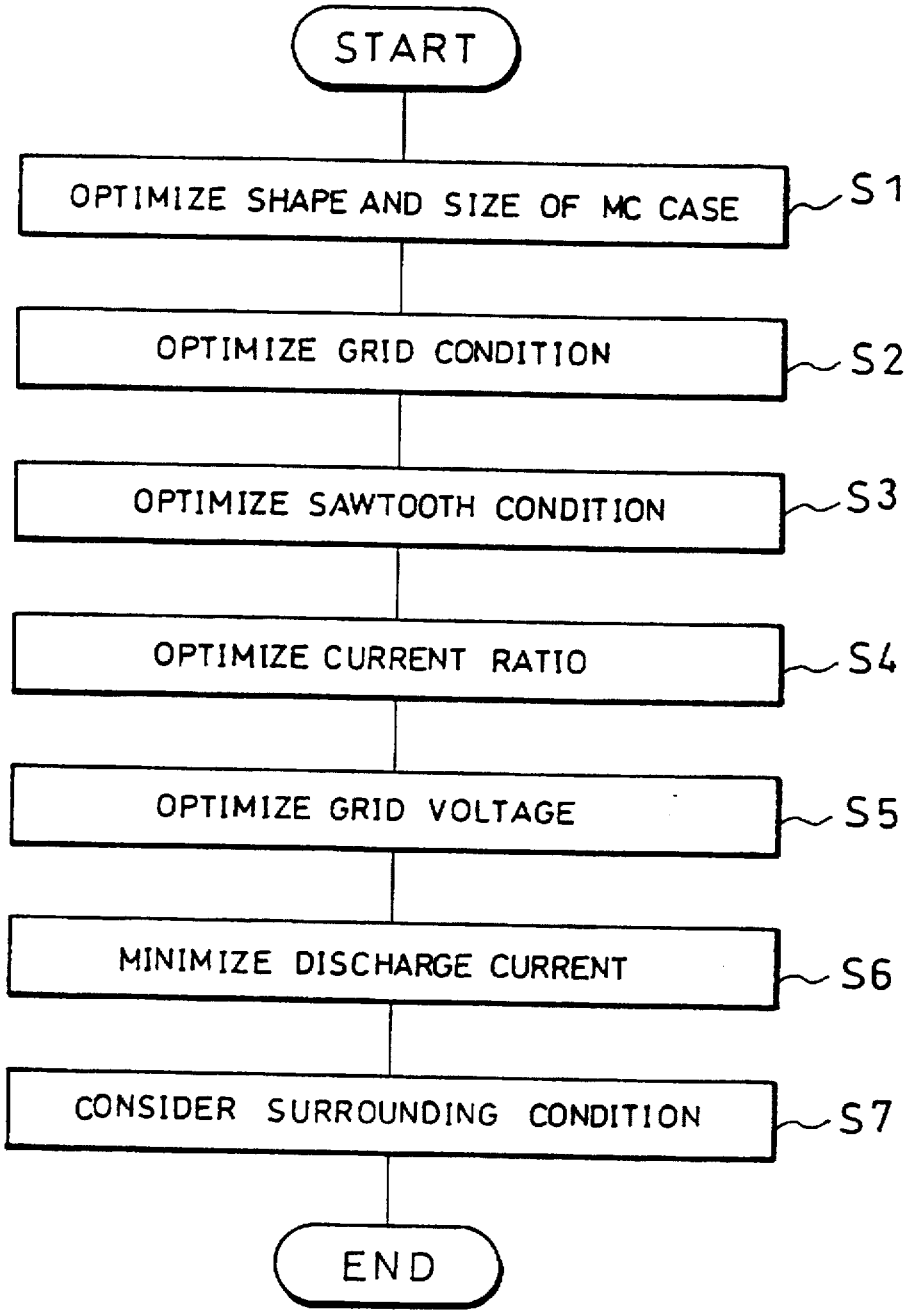
FIG. 1 is a flowchart showing a design method for an MC charger in accordance with the present invention.

When a high voltage is applied to the discharge electrodes 4c, the transfer charger 54 generates corona discharge from each discharging tip portion to charge the back surface of the transfer sheet p and transfers a toner image formed on the outer surface of the photoreceptor drum 51 onto the transfer sheet The design method of the MC charger 52 in accordance with the present invention will be explained below in reference to FIG. 1 and FIG. 2.

First, an optimization of the shape and the size of the MC case 2*a* is performed based on the physical properties (film thickness of the photoreceptor) of the photoreceptor drum 51 and the process speed (peripheral speed of the photoreceptor drum 51), etc. (S1). Namely, in S1, an opening width of the MC case 2*a* and a distance between the discharging tip portions and the grid 2*d* are determined.

Then, an optimization of grid conditions is performed (S2). Specifically, a correlation between a grid gap (a distance from the grid 2*d* to the surface of the photoreceptor drum 51) and a grid pitch is set in S2.

Next, an optimization of the saw-toothed conditions is performed (S3). Specifically, a correlation between a pitch of the discharging tip portions (saw-toothed pitch) and a discharging gap (distance between the discharging tip portions and the surface of the photoreceptor drum 51) is set in S3.

Then, an optimization of a current distribution ratio of a discharge current is performed (S4). Specifically, an optimization of a ratio of a grid current to a case current is performed. Subsequently, an optimization of a grid voltage and a minimization of the discharge current are respectively performed (S5–S6).

Lastly, environmental conditions are taken into consideration (S7). Specifically, a margin of the discharge current is set in consideration of changes in ambient temperature, humidity, etc., in S7.

For sake of convenience in explanations, the explanations have been given as if the processes in S1 through S7 are to be performed in this order. However, the present invention is not intended to specify the order of carrying out the described processes in S2 through S6 as long as the process in S1 is performed first and the process in S7 is performed last.

The process in each step will be explained in detail below.

First, the process of optimizing the shape and the size of the MC case 2*a* (S1 in FIG. 1) will be explained. In the initial stage of designing the MC charger 52, first, it is required to clarify the conditions on the structure surrounding the photoreceptor drum 51. Specifically, it is required to ensure a space for a charging section in consideration of the smallest possible size (hereinafter simply referred to as an opening width $L_c$) that is an opening width (mm) of the MC case 2*a*.

Figure 3:
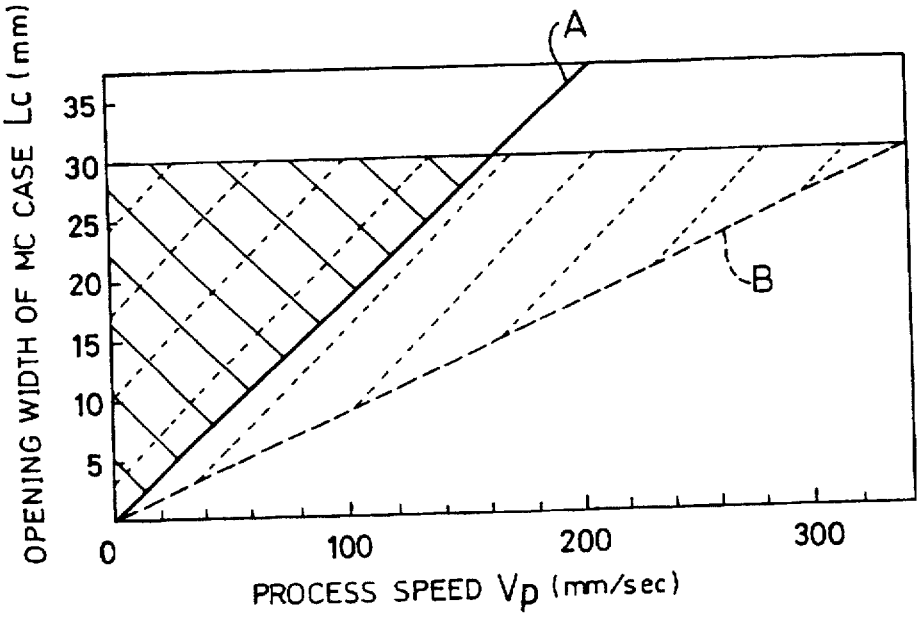
FIG. 3 is an explanatory view showing a correlation between an opening width $L_c$ and a process speed $v_p$ of an MC case.

Here, a process speed (mm/sec) and a film thickness (μm) of the photoreceptor are respectively designated by $v_p$ and $t_{opc}$. Then, provided that the discharge current $I_p$ is fixed, the correlation between $L_c$ and $v_p$ varies depending on $t_{opc}$ as shown in FIG. 3. In FIG. 3, when the opening width $L_c$ is set within a shaded area with solid lines, the charging device can be designed efficiently.

When the discharge current is fixed, it is required to increase the opening width $L_c$ of the MC case 2*a* as the process speed $v_p$ increases; otherwise, a longer time would be required for charging, and it cannot be ensured that the surface of the photoreceptor is quickly charged to a predetermined charged electric potential. Therefore, it is required to increase the opening width $L_c$ in proportion to the process speed $V_p$. Additionally, the film thickness $t_{opc}$ of the photoreceptor drum 51 is also affected by the charging characteristics.

Namely, the thicker the film of the photoreceptor drum 51, the shorter the time required for charging the photoreceptor drum 51 as a greater number of charges can be held thereon (a type of condenser is formed). This permits a lower discharge current and a reduction in installation space. Further, the thicker film of the photoreceptor drum 51 would offer another beneficial feature that the opening width $L_c$ can be reduced.

FIG. 3 shows $L_c$–$v_p$ characteristics under a fixed discharge current $I_p$ of −400 μA respectively with the film thickness $t_{opc}$ of the photoreceptor drum 51 of 17 μm (characteristic A) and 35 μm (characteristic B). The film thickness is set on the assumption that the film thickness of the mass-produced OPC drums is in a range of around 17 μm to 35 μm. Here, $I_p$=−400 μA is the largest possible discharge current from the correlation between the amount of ozone generated and the discharge current $I_p$. If the discharge current $I_p$ becomes greater than −400 μA, the amount of ozone generated would be the problem.

For the opening width $L_c$ under the condition of $I_p$=−400 μA, as can be seen from FIG. 3, it is important to ensure a length of at least a value (lower limit value) on a straight line A in an initial stage of designing the MC charger 52. To suppress the discharge current, it is effective to increase the opening width $L_c$. However, in the case of a copying machine in which the process speed $v_p$ is high, it is not sufficient to make the opening width $L_c$ larger. Namely, it is important to carry out an optimization to lower the discharge current $I_p$ in consideration of both the opening width $L_c$ and the film thickness of the photoreceptor drum 51.

The reason for adopting the condition of $I_p$=−400 μA is explained below in view of a correlation between the discharge current and the amount of ozone generated.

In a copying machine, a discharge current is generated by a charger unit such as the MC charger, the transfer charger, etc., adopting a high voltage transformer in the charging process. However, the discharge current would cause a generation of ozone. Further, it is known that the amount of ozone generated is in proportion to the output current $I_{OUT}$ from each charger. Recently, the standard requirement sets with regard to an amount of ozone generated becomes more and more strict in view of environmental concern mainly from Europe. Such tendency of restricting ozone generated is represented by the German blue angel standard, and recently, a still more strict restriction is set in some countries mainly from Northern Europe. Therefore, it is important to minimize the amount of ozone generated to meet various standard requirements and to prevent a deterioration of the photoreceptor which may cause a trouble in copied image quality.

Figure 4:
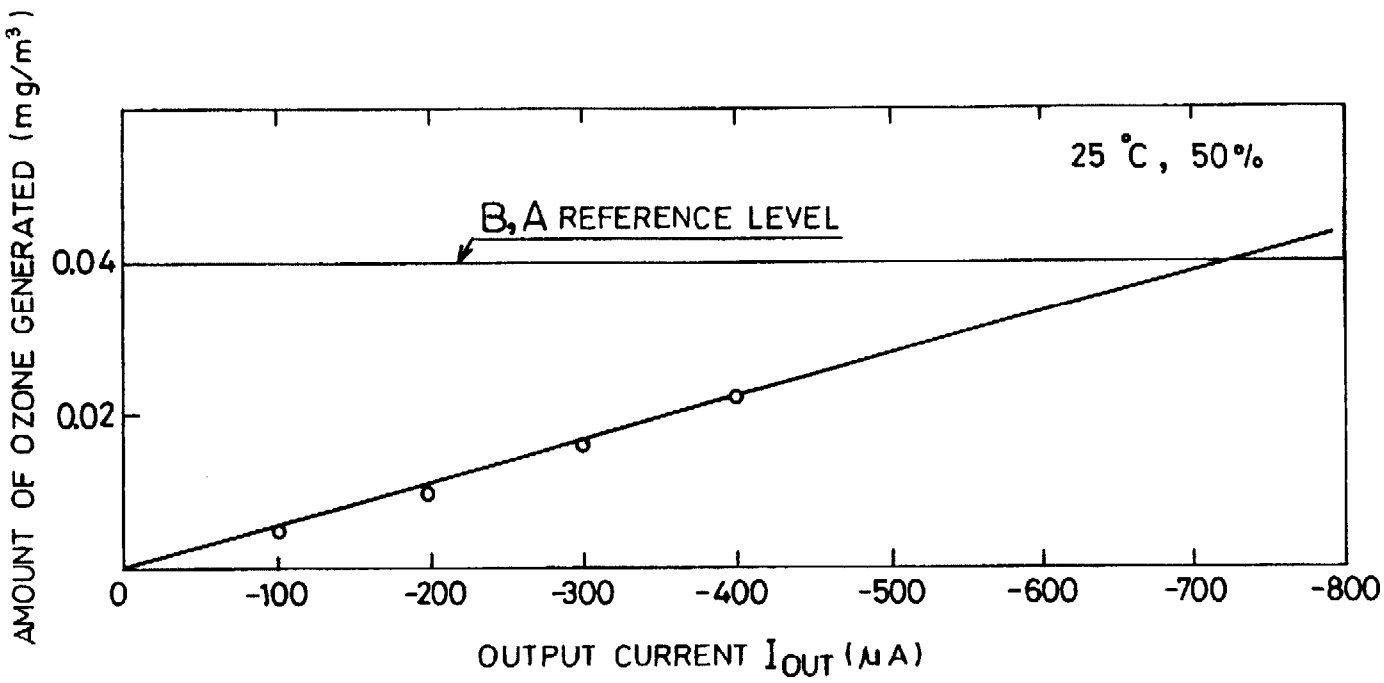
FIG. 4 is an explanatory view showing observed values representing discharge current dependencies of an amount of ozone generated.
Figure 5:
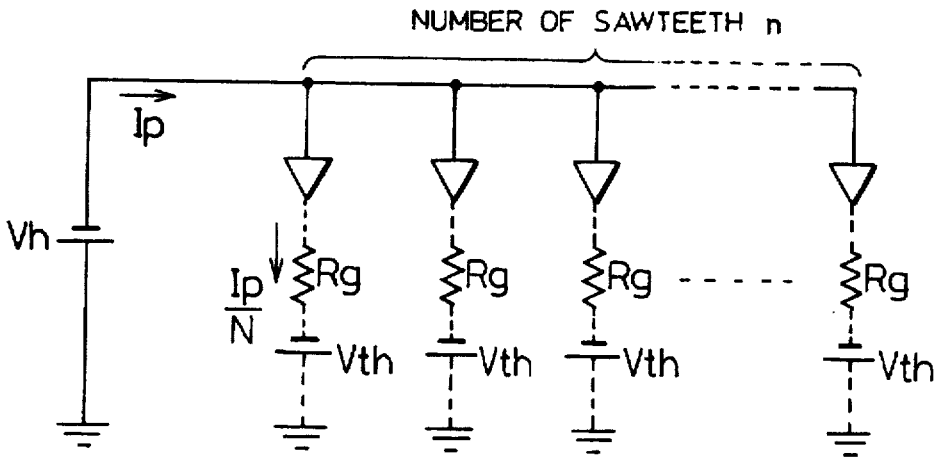
FIG. 5 is an equivalent circuit which explains discharging characteristics of a discharge electrode with saw-toothed discharging tip portions.

The dependency of an amount of ozone generated on the output current (discharge current) $I_{OUT}$ was measured, and the results shown in FIG. 4 were obtained. As is evident from FIG. 4, to meet the blue angel standard (tolerable amount of ozone generated is within 0.04 mg), it is necessary to reduce the total discharge current in the copying machine to not more than about −700 μA. Especially, in view of only the MC charger, as the discharge current applied thereto occupies around 60 percent of the total discharge current in the copying machine, the upper limit value of the discharge current of the charger would be around −400 μA.

Next, the upper limit value of the opening width $L_c$ will be explained. Discharging characteristics of the discharge electrode with saw-toothed discharging tip portions satisfy the following equation (1):

$$(I_p/N)=(V_h-V_{th})/R_g \quad (1)$$

wherein N is a total number of discharging tip portions, $V_h$ is a high voltage to be applied to the discharge electrode, $V_{th}$ is a discharge starting voltage, and $R_g$ is a space impedance (MΩ).

The discharge starting voltage $V_{th}$ varies while satisfying the following equation (2):

$$V_{th}=1.2+(2L_g)7 \quad (2)$$

wherein $L_g$ (mm) is a discharging gap (a distance between the discharging tip portions and the surface of the photoreceptor drum).

The space impedance $R_g$ also varies while satisfying the following equation (3):

$$R_g=11.4(L_g)^2+1.79\ (L_g) \quad (3).$$

Assumed here that the upper limit of the high voltage $V_h$ applied to the discharge electrode 2c be 7 kV in considering the cost, space, etc., and the discharge current flowing through each discharging tip portion ($I_p$/N) be not less than 0.5 μA, the following condition would be given from the above-mentioned equations (1) through (3):

$$0.5\times10^{-6}\leqq(I_p/N)=[(7.0\times10^3-(1.2+2L_g/7\times10^3]/[(11.4(L_g)^2+1.79L_g]\times10^6,\text{ and } L_g 15.5\ (\text{mm}).$$

Therefore, the upper limit value of the discharging gap $L_g$ is around 15.5 (mm).

Additionally, from the condition of $0.4 \leqq L_{pg}/L_c<0.5$ (to be described later), $L_{pg}=L_g-L_g$, and $L_{gr}\approx1.0$ (mm), when $L_g=15.5$, the opening width $L_c$ is around 30 (mm). If the opening width $L_c$ is set greater than the described range, a discharging cannot be stably performed. In general, the larger the opening width $L_c$, the longer the time required for charging and the more desirable would be the resulting charging characteristics. However, under the condition that the application high voltage has the upper limit value of 7 kV, the upper limit value for the opening width would be around 30 mm.

Next, the correlation between the opening width $L_c$ and the process speed $v_p$ will be explained. When, an initialization is set for the process speed $V_p$, a minimum charging time to required for charging the photoreceptor drum 51 to a predetermined potential is represented by $t_0=L_c/v_p$. Therefore, the opening width $L_c$ is represented by the following equation (4):

$$L_c=t_0\cdot v_p \quad (4)$$

Here, with a given discharge current $I_p$=−400 μA, to can be obtained in the following manner.

Figure 6:
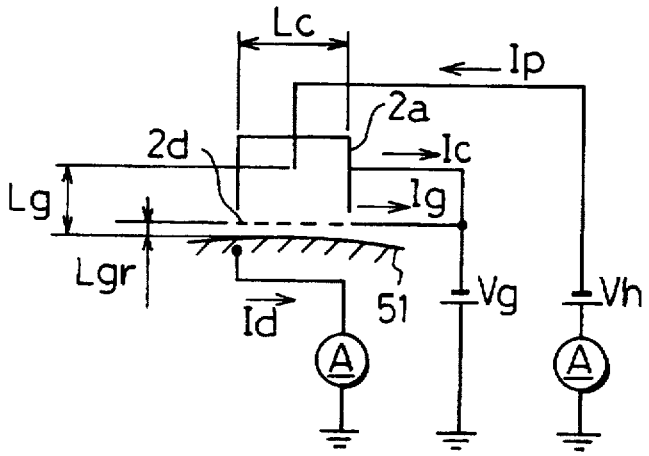
FIG. 6 is a simulation circuit for $cal_c$ ulating a lower limit charging time to required for charging a photoreceptor drum to a predetermined potential in the case where a process speed is initialized.
Figure 7:
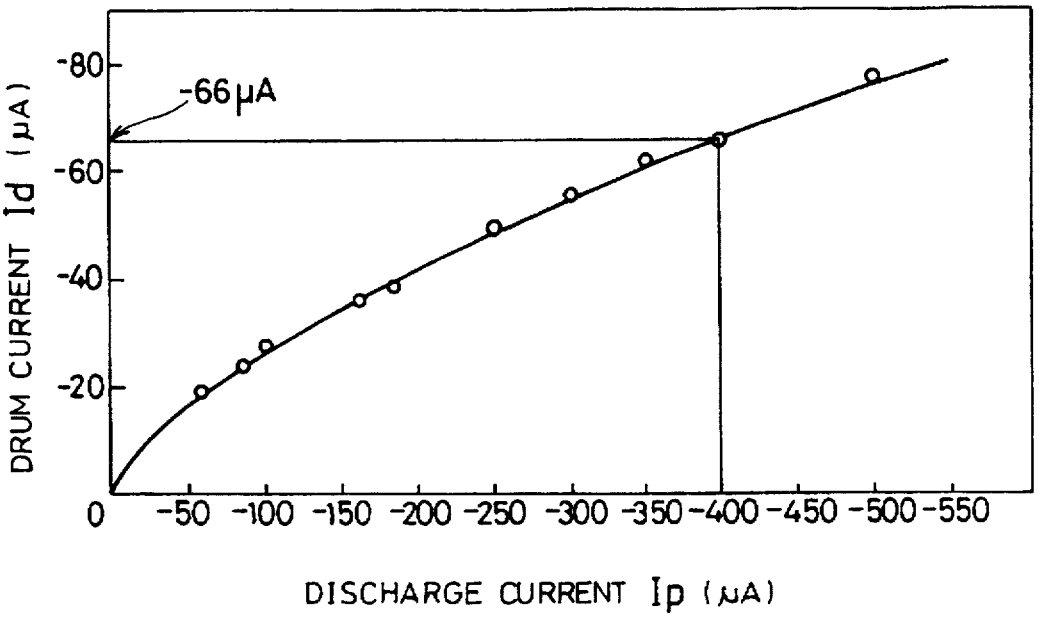
FIG. 7 is an explanatory view showing observed values of current and discharging current flowing through the photoreceptor drum based on the simulation circuit of FIG. 6.

Based on a simulation circuit shown in FIG. 6, the current $I_d$ and the discharge current $I_p$ flowing in the photoreceptor drum 51 were measured. The results obtained are as shown in FIG. 7. For the photoreceptor drum 51, an aluminum pipe is adopted, and the experiment was conducted under the conditions of the opening width $L_c$=13 (mm), the discharging gap $L_g$=9.5 (mm), the grid gap $L_{gr}$=1.0 (mm), and the grid voltage $V_g$=MC case voltage $v_c$=−620 (V). As a result, the photoreceptor drum current $I_d$ with respect to $I_p$=−400 μA of around 66 μA was obtained.

Figure 8:
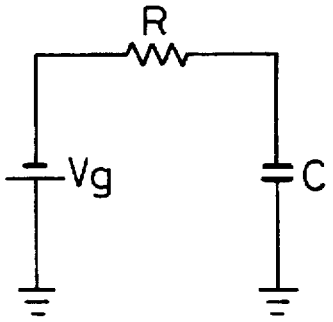
FIG. 8 is an equivalent circuit diagram between a grid and the photoreceptor drum of FIG. 6.

An equivalent circuit between the grid 2d and the photoreceptor drum 51 shown in FIG. 6 is as shown in FIG. 8 when the charged electric potential of the photoreceptor drum, an electrostatic capacity of the photoreceptor drum, and a resistance are respectively designated by $V_d(t)$, C and R, and the following approximate expression (5) is obtained based on the equivalent circuit:

$$V_d(t)=V_g[1-e^{(-t/cr)}] \quad (5)$$

wherein $C=\epsilon_0\epsilon_1 S/t_{opc}$, $R=V_g/I_d$, $\epsilon_0$ is a vacuum dielectric constant, $\epsilon_1$ is a relative dielectric constant of the photoreceptor drum, $t_{opc}$ is a film thickness (μm) of the photoreceptor, and S is an area (mm$^2$) of the charging area.

Figure 9:
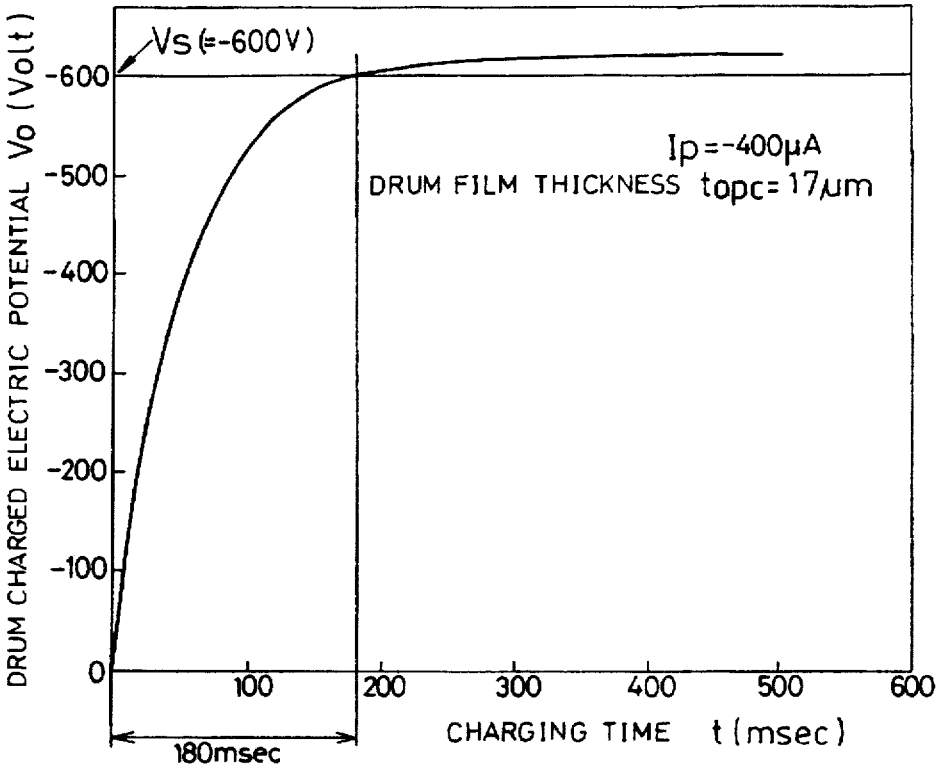
FIG. 9 is an explanatory view showing one example of the equivalent circuit shown in FIG. 8.

Further, assumed that $V_g$=−620 V, $\epsilon_0=8.855\times10^{-12}$, $\epsilon_1$=3.88, $t_{opc}=17\times10^{-6}$ and S=13(mm)×210 (mm), CR of $\epsilon_0\epsilon_1 SV_g/(t_{opc}I_d)\approx51.83\times10^{-3}$ is given, and the approximate expression (5) can be expressed in a diagram shown in FIG. 9.

From FIG. 9, time to required for charging the surface of the photoreceptor drum 51 to have a predetermined drum electric potential $V_s$=−600 (V) is $t_0\approx178$ (msec). When $t_0$=178 is substituted for the equation (4), $L_c=178\times10^{-3}\cdot v_p$ is obtained, thereby obtaining a straight line A shown in FIG. 3.

Similarly, assumed in equation (5) that $V_g$=−620 V, $\epsilon_0=8.855\times10^{-12}$, $\epsilon_1$=3.88, $t_{opc}=35\times10^{-6}$ and S=13(mm)×210 (mm), as $I_{do}$=66 μA, CR of $\epsilon_0\epsilon_1 SV_g/(t_{opc}I_{do})\approx25.17\times10^{-3}$ is given. In this case, time $t_0$ required for charging the surface of the photoreceptor drum 51 to have a predetermined drum electric potential $V_s$=−600 (V) is $t_0\approx86.4$ (msec). When $t_0=86.4\times10^{-3}$ is substituted for the equation (4), $L_c=86.4\times10^{-3}\cdot v_p$ is obtained, thereby obtaining a straight line B shown in FIG. 3.

Therefore, in FIG. 3, an area surrounded by the straight line A and the straight line $L_c$=30 offers an optimal combination of the opening width $L_c$ and the process speed $V_p$.

In the general film thickness $t_{opc}$, a time $t_0$ required for charging the surface of the photoreceptor drum 51 to have the predetermined drum electric potential of $V_s$=−600 (V) is calculated to be $t_0=\ln(1-(600/620))\times(\epsilon_0\epsilon_1 SV_g)/(t_{opc}I_{do})\approx3.02\times10^{-6}/t_{opc}$. Then, the resulting to is substituted for the equation (4), and $L_c=3.02\times10^{-6}\cdot v_p/t_{opc}$ is given. Therefore, in general, by setting the opening width $L_c$, the process speed $v_p$ and the film thickness $t_{opc}$ within the area surrounded by $L_c=3.02\times10^{-6}\cdot v_p/t_{opc}$ and the straight line $L_c$=30, the charging operation can be started more promptly and a stable discharging operation can be always performed stably, thereby uniformly charging the surface of the photoreceptor.

As described, after setting the opening width $L_c$ of the MC case 2a and the distance $L_{pg}$ between the discharging tip portions and the grid 2d, an optimization of the grid conditions are performed in S2. Namely, the correlation between the grid gap (distance between the grid 2d and the surface of the photoreceptor drum 51) and the grid pitch is set in S2 in a conventional manner.

Figure 10:
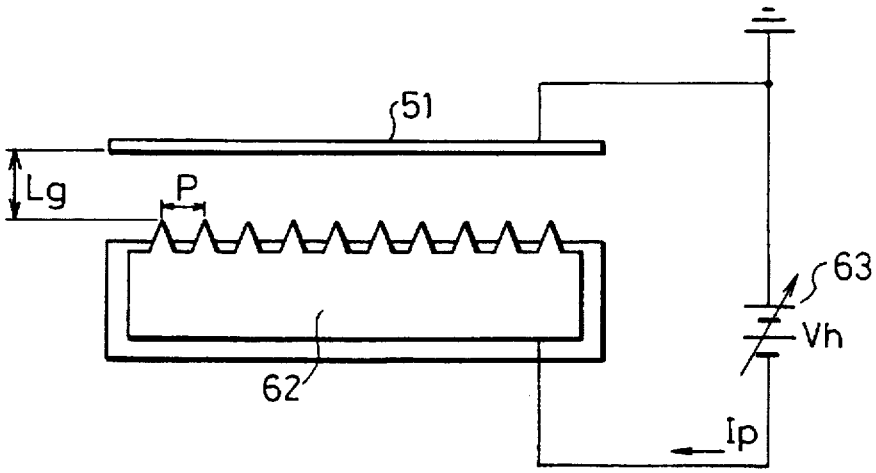
FIG. 10 is an explanatory view showing an example of the saw-toothed discharging tip portions of the discharge electrode.

First, the correlation between the tip to tip pitch of the discharging tip portions (saw-toothed portion) and the discharging gap (the distance between the discharging tip portions and the surface of the photoreceptor drum 51) will be explained. FIG. 10 is an explanatory view showing the structure of the saw-toothed charging device with discharging tip portions. In the saw-toothed charging device, a predetermined application voltage $V_h$ is applied between the discharging tip portions and the surface of the photoreceptor drum 51 with a discharging gap $L_g$ (mm) therebetween. A discharge current $I_p$ (corona current) flows into the photoreceptor drum 51 from the discharge electrode 62. In this state, the $I_p$-$V_h$ characteristics are as shown in FIG. 11, and the discharge current $I_p$ is approximated by the following equation (7):

$$I_p=kV_h(V_h-V_0) \quad (7)$$

wherein k is a proportional constant, and $V_0$ is a limit voltage for initiating the corona discharge.

Figure 11:
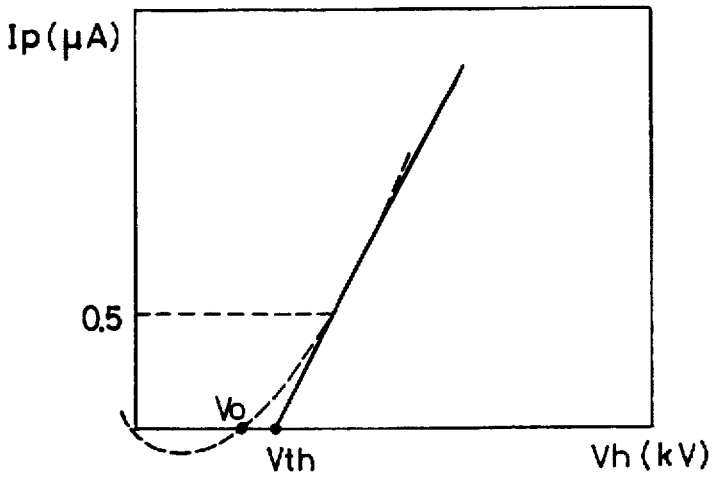
FIG. 11 is an explanatory view showing $I_p$–$V_h$ characteristics in the structure of FIG. 10.

However, when the discharge current is limited to the practical range (not less than 0.5 μA per pin), as is evident from FIG. 11, the characteristics of the equation (7) show sufficient linear properties, and can be approximated to the straight line. Thereafter, an intersection of the straight line and the voltage axis $V_h$ of FIG. 11 is defined to be the discharge starting voltage $V_{th}$. Namely, the discharge electrode 62 has discharge starting characteristics such that when the application voltage $V_h$ exceeds the discharge starting voltage $V_{th}$, the corona discharge starts generating from the discharging tip portions, and the discharge current $I_p$ starts increasing in proportion to an increase in the application voltage $V_h$.

Figure 12:
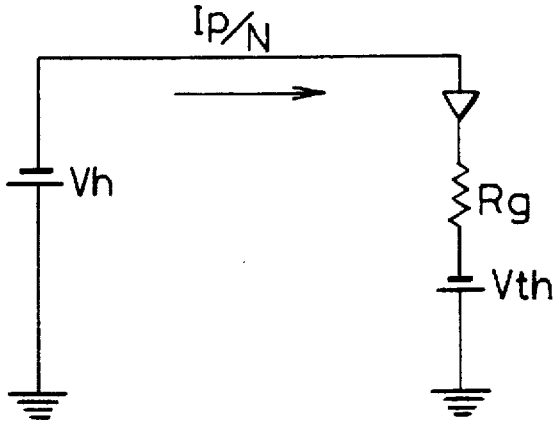
FIG. 12 is an equivalent circuit per pin in which an effect of space is shown by a concentrated constant of a space impedance.

When considering the equivalent circuit per pin, wherein an effect of the space is expressed by a lumped constant of the space impedance $R_g$, the equivalent circuit shown in FIG. 12 is obtained. From this equivalent circuit, the following equation (8) is obtained:

$$I_p/N=(V_h-V_{th})/R_g \quad (8)$$

wherein N is the number of discharging tip portions (sawteeth).

Here, it is required to minimize the amount of ozone generated by reducing the discharge current $I_p$.

Figure 13:
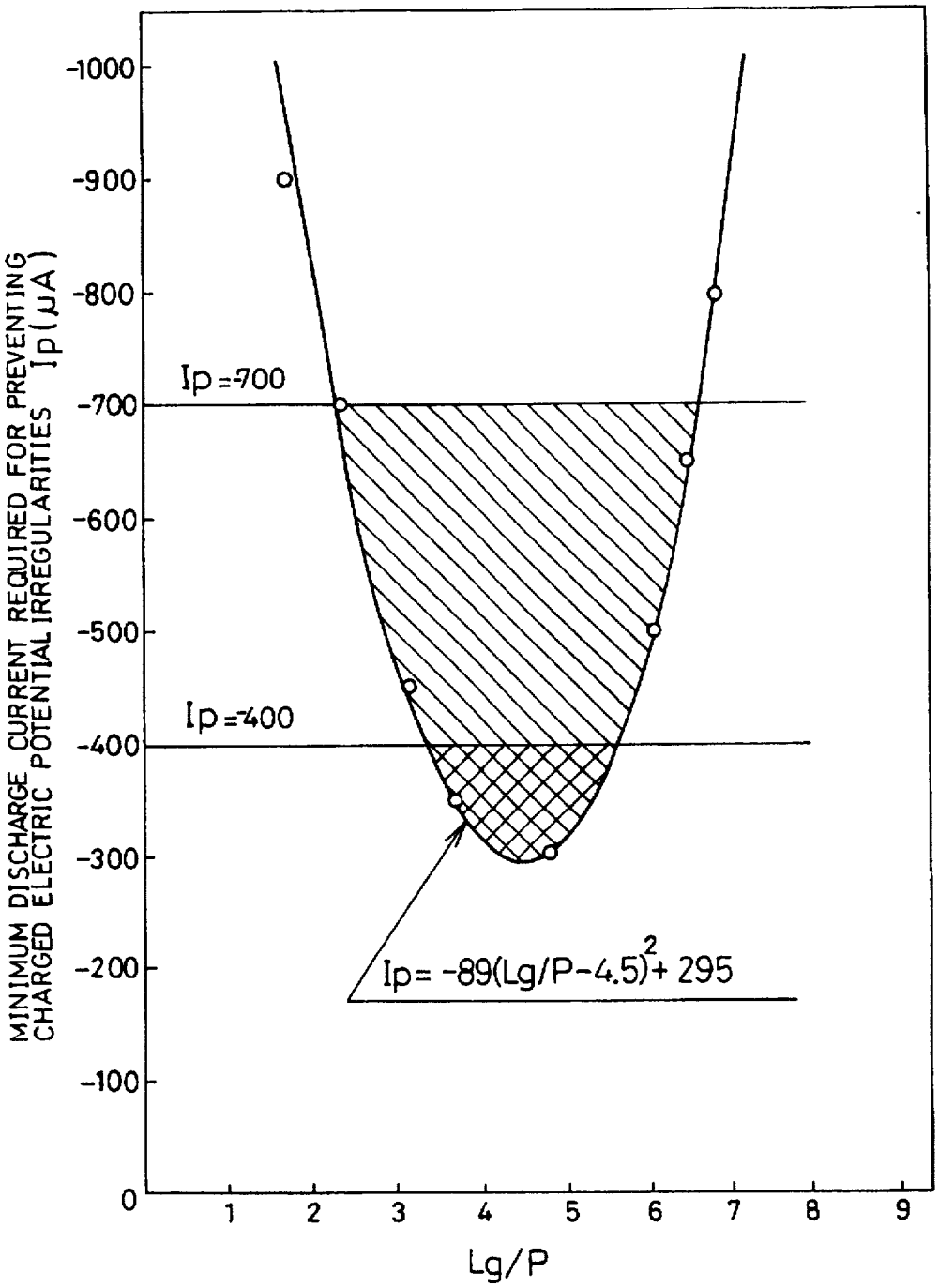
FIG. 13 is an explanatory view showing an optimization of a discharge current.

The following will explain the optimization of the discharge current $I_c$in reference to FIG. 13.

When the tip to tip pitch P of the discharging tip portions is small, the electric fields of the adjoining discharging tip portions interfere with one another, which would cause discharging irregularities. On the other hand, when the tip to tip pitch of the discharging tip portions is large, a great difference would arise in discharging voltage between the vicinity of the discharging tip portions and other portions, which would cause discharging irregularities. Similarly, when the discharging gap $L_g$ is small, as the photoreceptor drum 51 is charged locally, charged electric potential irregularities would occur. On the other hand, when the discharge gap $L_g$ is large, discharge cannot be carried out unless the application voltage $V_h$ is set greater, thereby presenting the problem that the device becomes larger in size.

With respect to the respective combinations of the tip to tip pitch P of the discharging tip portions (1 (mm), 2 (mm), 3 (mm) and 4 (mm)), and discharging gap $L_g$ (6 (mm) to 10 (mm)), smallest possible discharge current $I_p$ which ensure a half tone uniformity were measured, and the results shown in FIG. 13 were obtained. The results show that an optimal $L_g/P$ for minimizing the discharge current $I_p$ exists. The curve shown in FIG. 13 can be approximated to the following equation (9):

$$I_p=[-89((L_g/P)-4.5)^2-295] \quad (9)$$

Considering that most of the charging devices are set so as to have a discharging gap $L_g$ of around 10 (mm), the discharge current $I_p$ can be minimized by setting the discharging tip to tip pitch P of the discharging tip portions to around 2 (mm). Assumed that the upper limit value of the discharge current be −700 μA (determined by a high voltage transformer for use in discharge, etc.), then the lower limit value of $I_p$=−700 would be given from the equation (9). Therefore, the area surrounded by the equation (9) and the curve (9) is an effective area for obtaining a uniform charge.

As described, as the discharge current $I_p$ is set to a small value , i.e., in a range of not more than −700 (μA), the high voltage generating section 63 can be reduced in size, thereby reducing the size of the charging device. Moreover, as the discharge can be stably carried out, charged electric potential irregularities on the photoreceptor drum 51 can be surely prevented. The described feature that the discharge current $I_p$ is set small, i.e., in a range of not more than −700 μA offers an effect of reducing the amount of ozone generated, and the charging device which meets various standard requiremntes can be achieved. Here, it is preferable to set the pitch P so as to correspond to the value of the distance $L_g$ after determining $L_g/P$, because various parameters can be determined efficiently in a short period of time when designing the charging device.

When designing the charging device, if the space for installing the charging device is ensured, the optimal value P may be set by determining $L_g$ after determining the ratio of ($L_g/P$). As a result, when designing the charging device, various parameters can be determined efficiently in a short period of time. On the contrary, when the pitch P is fixed, the required installation space for the charging device can be determined based on the pitch P.

The correlation between the discharge current and the amount of ozone generated will be explained. The larger the discharge current $I_p$, the more stably the surface of the photoreceptor drum 51 is charged; however, the greater the amount of ozone generated. On the other hand, the smaller the discharge current $I_p$, the smaller the amount of ozone generated; however, the discharge operation is not stably carried out.

The correlation between the measurement values of the amount of ozone generated the discharge current and various standard requirements is summarized in Table 1. Values shown in Table 1 are obtained based on the measurement values in the charging device of the wire system, the UL standard converted value, and the BA standard (Blue Angle) converted values thereof. More specifically, when the measured value is 0.195 (PPM), the UL standard and the BA standard converted values thereof are 0.065 (PPM) and 0.082 (mg/m$^3$) respectively. Additionally, the BA standard converted values are at temperature of 25° C., and relative humidity of 50 percent.

TABLE 1

| | AMOUNT OF OZONE GENERATED | | | TEMPERATURE (°C.) AND RELATIVE HUMIDITY |
|---|---|---|---|---|
| CURRENT (μA) | MEASURED VALUES (PPM) | UL CONVERSION (PPM) | BA CONVERSION (mg/m$^3$) | (%) AT A TIME OF MEASUREMENT |
| −100 | 0.011 | 0.0037 | 0.0050 | 23° C., 24% |
| −200 | 0.021 | 0.0070 | 0.0097 | 22.7° C., 22% |
| −300 | 0.034 | 0.0113 | 0.016 | 22.6° C., 23% |
| −350 | 0.040 | 0.0130 | 0.017 | 22.6° C., 23% |
| −400 | 0.047 | 0.0157 | 0.022 | 22.5° C., 23% |

As is evident from Table 1, to suppress the amount of ozone generated to meet a standard level, it is required to set the discharge current to not more than −400 μA. Therefore, with the upper limit of $I_p$=−400, the area surrounded by the equation (9) and the curve (9) is an effective area for obtaining a uniform charge.

By setting the discharge current $I_p$ in a range of not more than −400 (μA), the high voltage generating section 63 can be still reduced in size, thereby still reducing the size of the charging device 63. In the meantime, various restrictions on the design of the charging device can be eased, and a greater degree of freedom on designing the charging device can be achieved, thereby providing a sufficient solution to the environmental problems. Moreover, charged electric potential irregularities on the surface of the photoreceptor can be still suppressed. Here, as the discharge current $I_p$ is set to not more than −400 μA, the amount of ozone generated can be reduced to the ignorable level, and the ozone filter can be eliminated from the conventional arrangement. Here, it is preferable to set the pitch P corresponding to the distance $L_g$ after determining the ratio $L_g$/P because various parameters can be determined efficiently in a short period of time.

Here, an optimization of the distribution ratio of the discharge current (in S4) will be explained. In general, there is a tendency that the greater is the grid current $I_p$, the smaller the charged electric potential irregularities as compared to the case where the case current $I_c$ is larger. Namely, by increasing the grid current $I_g$, the drum current $I_d$ flowing in the photoreceptor drum 51 can be stabilized. On the other hand, by increasing the case current $I_c$, the grid current $I_g$ is reduced as well as the drum current $I_d$, and the drum current $I_d$ becomes unstable.

The correlation among the grid current $I_g$, the case current $I_c$, the drum current $I_d$ and the case voltage $V_c$ of the shield case under the constant discharge current $I_p$ will be explained in reference to FIG. 14 through FIG. 17.

Figure 14:
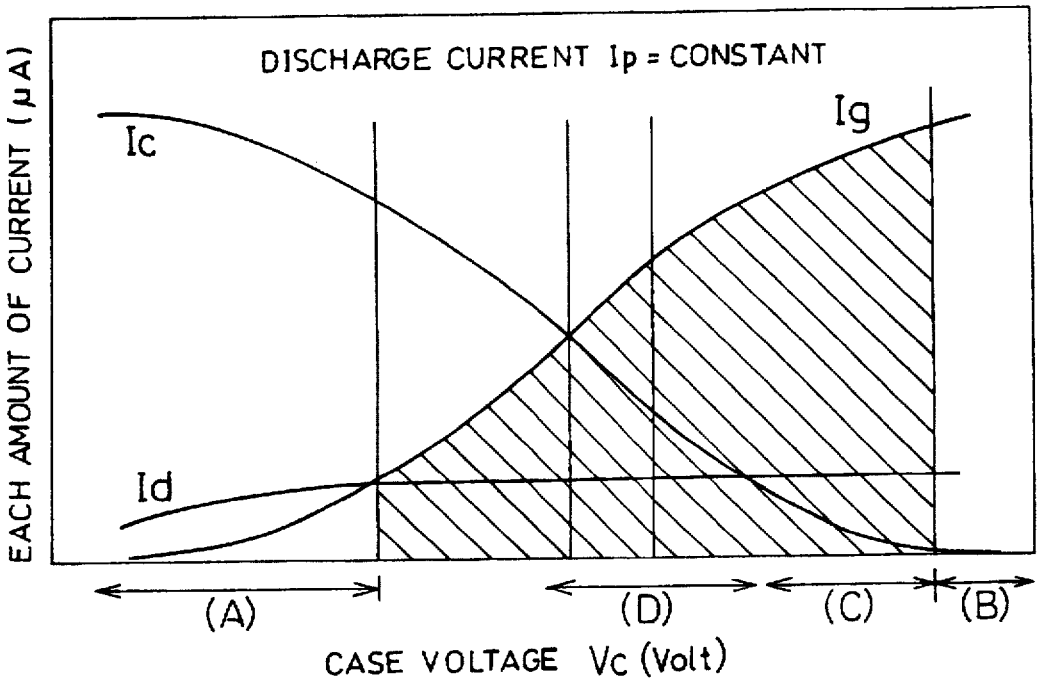
FIG. 14 is an explanatory view showing a correlation among a grid current, a case current, a drum current and a case voltage of a shield case under a constant discharge current.

A s shown in FIG. 14, in the area where the grid current $I_g$ is smaller than the drum current $I_d$ (shown by (A) in FIG. 14), the grid control cannot be performed appropriately, and the uniformity of the charge cannot be maintained, thereby presenting the problem that the charged electric potential irregularities are likely to occur. In this area, as the grid current $I_g$ is small, the drum current $I_d$ is also small, and a stable charged electric potential cannot be obtained. Moreover, the unstable conditions of the drum current $I_d$ also cause the charged electric potential irregularities.

In the area shown by (B) in Fig.14, the case current $I_c$ hardly flows, and the charge on the surface of the photoreceptor drum 51 becomes non-uniform, thereby presenting the problem that charged electric potential irregularities are likely to occur.

In the area shown by (C) in FIG. 14, although the case current $I_c$ is small, the grid current $I_g$ is large to compensate for the small case current. Therefore, charged electric potential irregularities would not occur. Here, as the drum current $I_d$ flows under stable conditions, a uniform charge can be ensured.

In the area shown by (D) in FIG. 14, a balance is kept between the case current $I_c$ and the grid current $I_g$, and a discharge is stably carried out, thereby ensuring a uniformity of the charge. Thus, when forming an image in this area, a desirable image quality can be obtained.

As described, by increasing the grid current $I_g$, the drum current $I_d$ can be stabilized. On the other hand, by increasing the case current $I_c$, the drum current $I_d$ reduces as well as the grid current $I_g$, therefore, the drum current $I_d$ becomes unstable. In considering the above, to prevent the charged electric potential irregularities, it is effective to set so as to satisfy the condition that the grid current $I_g$ is greater than the case current $I_c$.

Figure 15:
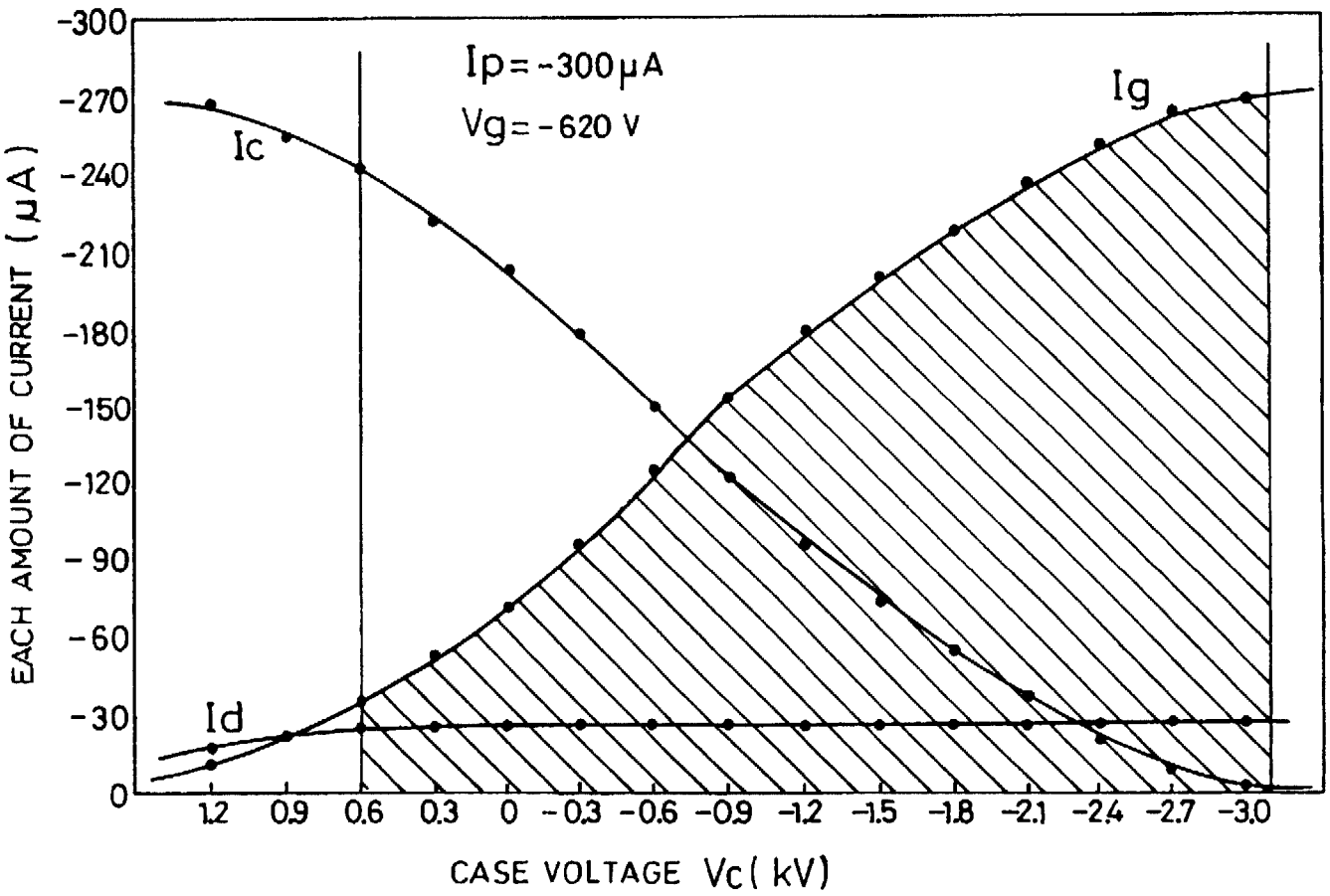
FIG. 15 is an explanatory view showing another correlation among a grid current, a case current, a drum current and a case voltage of a shield case under a constant discharge current.
Figure 16:
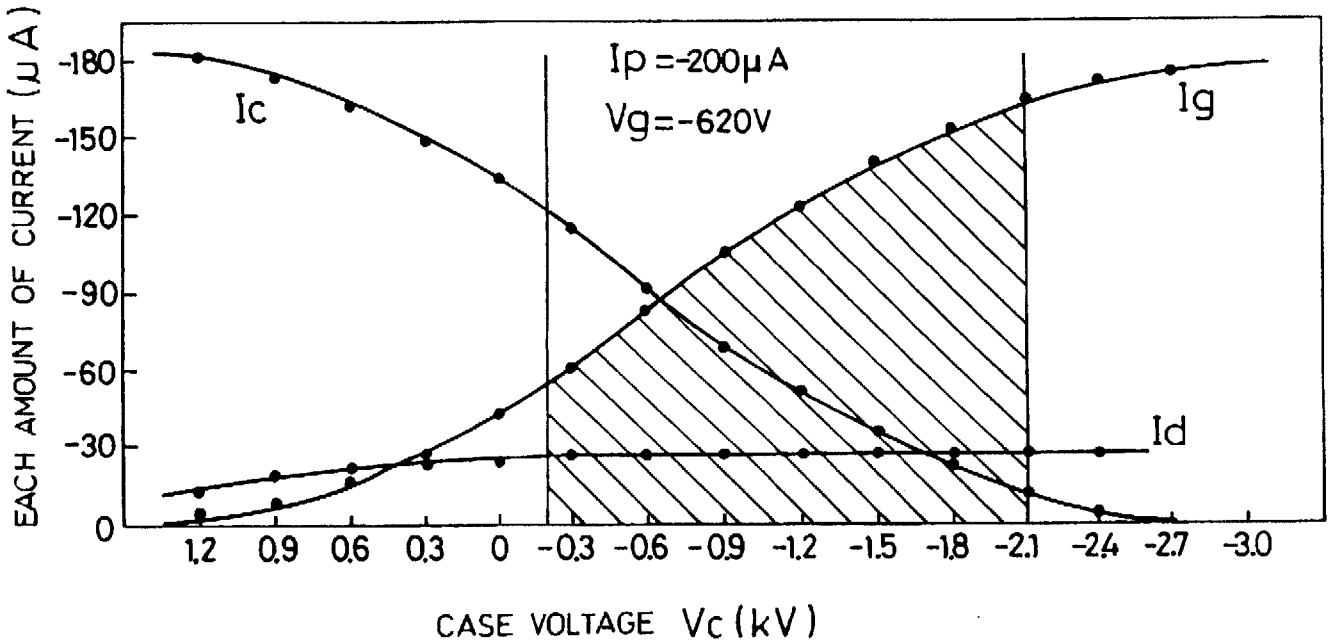
FIG. 16 is an explanatory view showing still another correlation among a grid current, a case current, a drum current and a case voltage of a shield case under a constant discharge current.
Figure 17:
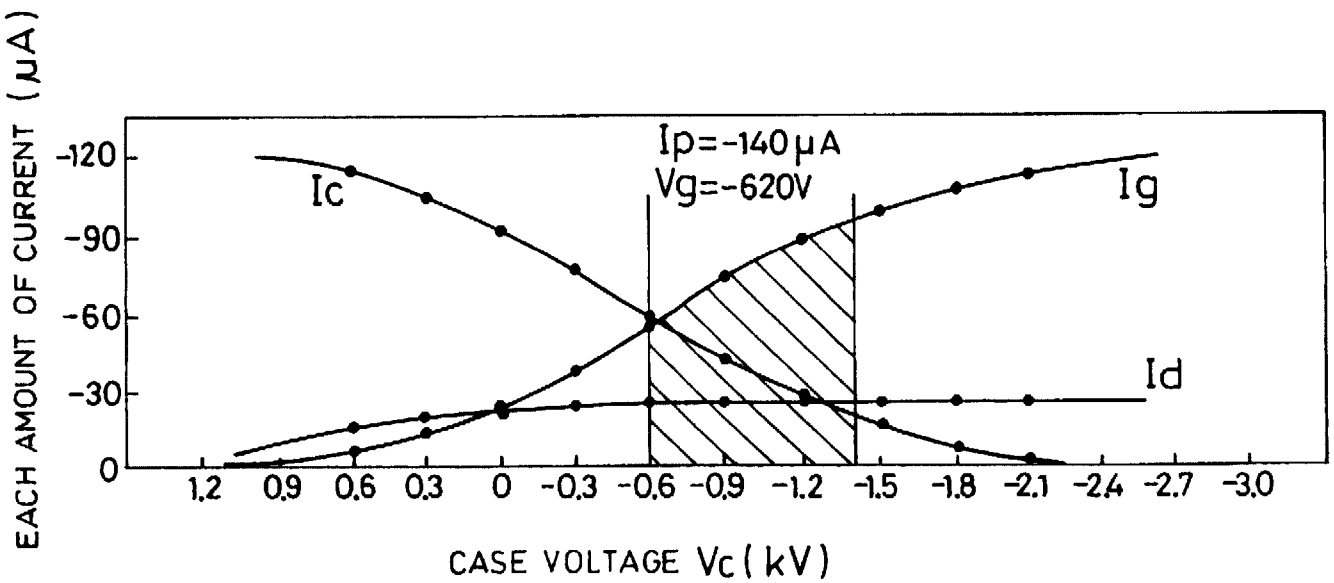
FIG. 17 is an explanatory view showing yet still another correlation among a grid current, a case current, a drum current and a case voltage of a shield case under a constant discharge current.

FIG. 15 shows the results of measurements of the grid current $I_g$, the case current $I_c$, the drum current $I_d$, and the case voltage $V_c$ of the shield case when the grid voltage $V_g$ is set to −620 under a constant discharge current $I_p$ of −300 μA. FIG. 16 shows the results of measurements of the grid current $I_g$, the case current $I_c$, the drum current $I_d$ and the case voltage $V_c$ of the shield case when the grid voltage $V_g$ is set to −620 under a constant discharge current $I_p$ of −200 μA. FIG. 17 shows the results of measurements of the grid current $I_g$, the case current $I_c$, the drum current $I_d$ and the case voltage $V_c$ of the shield case when the grid voltage $V_g$ is set to −620 under a constant discharge current $I_p$ of −140 μA. In the shaded areas in FIG. 14 through FIG. 16, charged electric potential irregularities hardly occur. As is evident from FIG. 14 through FIG. 16, the greater the discharge current $I_p$, the larger the area in which the charged electric potential irregularities hardly occur. On the contrary, the smaller the discharge current $I_p$, the smaller is the area in which the charged electric potential irregularity hardly occurs.

Figure 18:
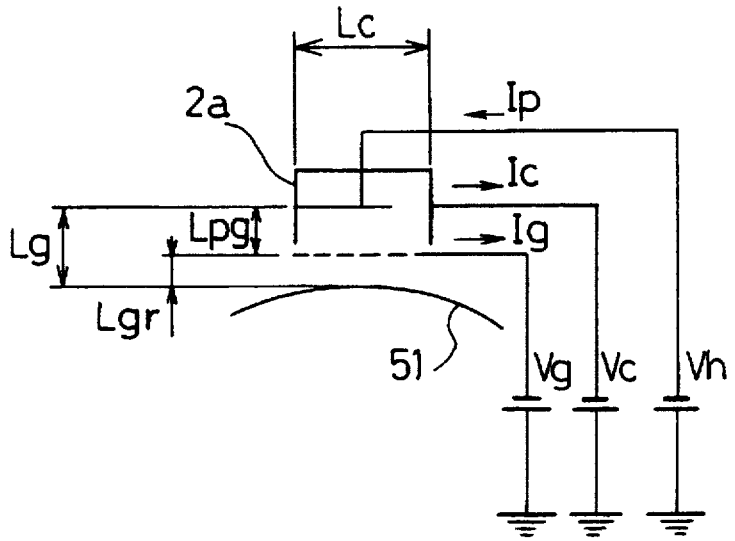
FIG. 18 is an explanatory view showing an example arrangement for deriving respective correlations shown in FIG. 14 through FIG. 17.

With respect to the charging device having the structure shown in FIG. 18, the grid current $I_g$, and the case current $I_c$ flowing in the shield case when applying the discharge current $I_p$ (sum of the current flowing from the discharging tip portions to the photoreceptor drum 51) (see FIG. 14 through FIG. 16), and a uniformity of copy with respect to each $I_g/I_c$ is measured (by checking a level of charged electric potential irregularities of a half tone copy). As a result, a discharge current value that permits an overall high quality level to be maintained without generating charged electric potential irregularities was measured.

Figure 19:
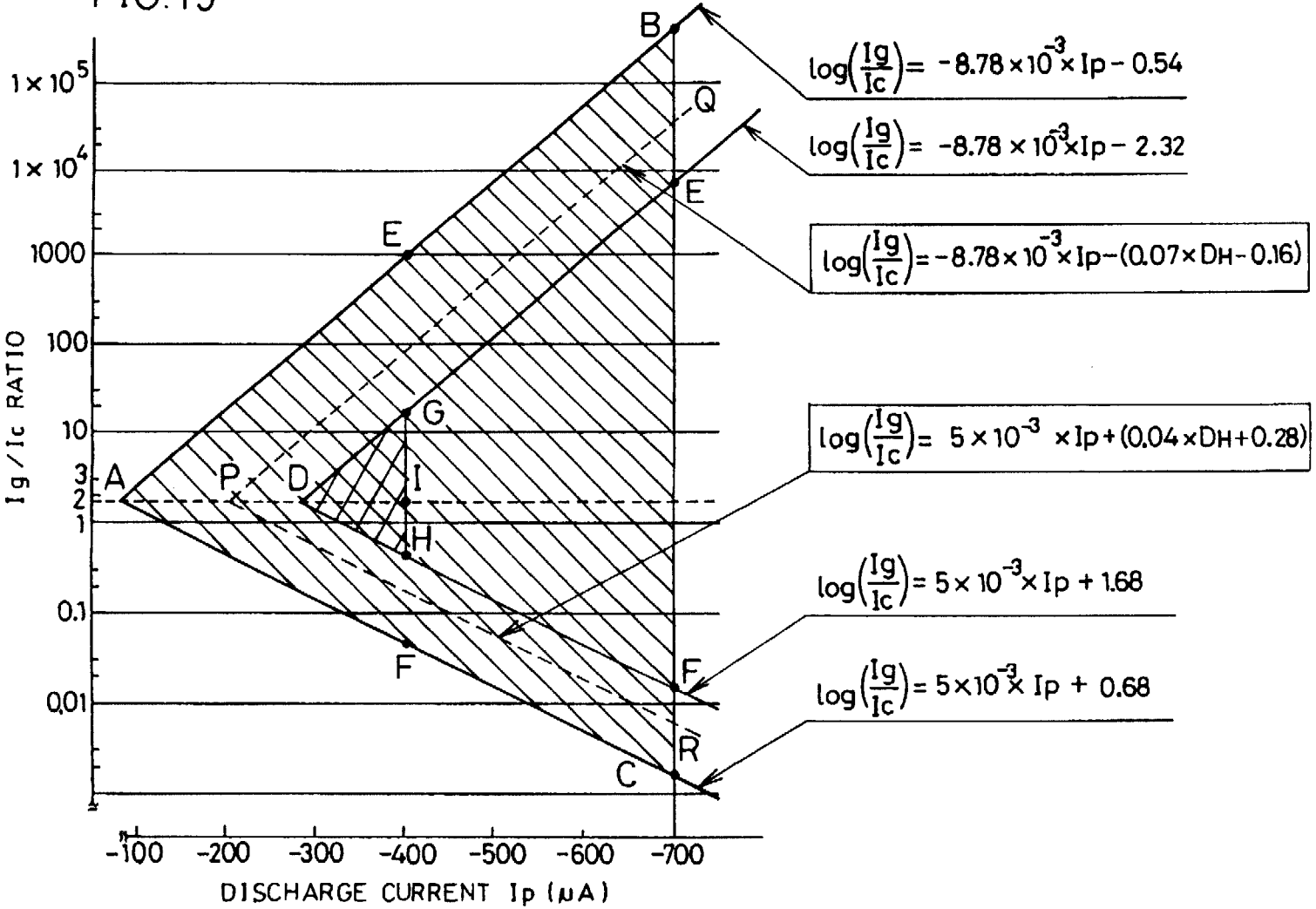
FIG. 19 is an explanatory view showing observed values of discharging current which permits a high quality level of a copied image to be maintained without having charged electric potential irregularities from an overall judgement based on observed values representing the uniformity of a copied image (checking a level of charged electric potential irregularities of a half tone copied image) with resect to each ratio of $I_g/I_c$ obtained by measuring respective values for the grid current $I_g$ and the case current $I_c$ flowing through the shield case when the discharge current is applied thereto.

It can be seen from the results of measurement that the values on the straight line AB of FIG. 19 show the upper limit value of the discharge current for ensuring the high quality level without generating charged electric potential irregularities, while the values on the straight line AC show the lower limit values of the discharge current for ensuring the high quality level without generating charged electric potential irregularities. The straight line AB and the straight line AC are respectively expressed by the following formulae (10) and (11):

$$\log(I_g/I_c)=-8.78\times10^{-3}I_p-0.54 \quad (10)$$

$$\log(I_g/I_c)=5\times10^{-3}I_p+0.68 \quad (11)$$

The discharge current $I_p$ is expressed by the sum of the grid current $I_g$, the case current $I_c$ and the current flowing through the photoreceptor drum 51. However, depending on the ratio of $I_g/I_c$, the stability level of discharge, and the degree of charged electric potential irregularities on the surface of the photoreceptor drum 51 vary. Namely, when the discharge current $I_p$ is large, the surface of the photoreceptor is stably charged (the effect of the ratio of ($I_g/I_c$) is small); however, an amount of ozone generated increases. On the other hand, when the discharge current $I_p$ is small, the amount of ozone generated reduces; however, the absolute amount of the grid current $I_g$ and the case current $I_c$ and the ratio of $I_g/I_c$ greatly affect the uniformity of charge (see FIG. 19).

In FIG. 19, by setting the discharge current $I_p$ small, i.e., in a range of not more than −700 μA, the high voltage generating section 63 (high voltage transformer) can be small-sized, thereby permitting a reduction in size of the charging device. Moreover, a discharging operation can be stably carried out. The feature that the discharge current $I_p$ is set small, i.e., in a range of not more than −700 μA, offers another effect that an amount of ozone generated can be reduced. Furthermore, the grid current $I_g$ and the case current $I_c$ are also considered as parameters, and these parameters are selected to fall within an area surrounded by $I_p$=−700, the straight line AB and the straight line AC (an area shown by the triangle ABC). Therefore, under normal surrounding conditions, a discharging uniformity can be maintained, and the charged electric potential irregularities can be surely prevented.

It is preferable to set the discharge current $I_p$ to be not more than −400 (μA) for the aforementioned reasons. Namely, when the respective values for the discharge current $I_g$, $I_c$ and $I_p$ are set so as to fall within an area surrounded by $I_p$=−400, the straight line AB and the straight line AC (within an area shown by the triangle AEF), the high voltage generating section 63 can be small-sized, thereby permitting a reduction in size of the charging device. Additionally, as the amount of ozone generated can be reduced to a ignorable level, an ozone filter can be omitted from the conventional charging device. This permits a wider design choice as more space becomes available, and also permits various standards set with regard to an amount of ozone generated to be satisfied. Besides, the uniformity in discharge can be ensured under normal surrounding conditions. As a result, generation of irregularity in charge potential on the surface of the photoreceptor drum 51 can be surely prevented.

The straight line AB and the straight line AC show the results of measurements under normal surrounding conditions (ambient temperature of 20° C., and the relative humidity of 55%). However, the charging device can be used in various environmental conditions. Therefore, it is preferable that the charging device is operable properly even under the critical surrounding conditions (ambient temperature of 35° C., and the relative humidity of 85%). These critical surrounding conditions will be further described below.

With respect to the charging device having a structure shown in FIG. 18, the uniformity in a copied image was measured with respect to the ratio of $I_g/I_c$ under critical surrounding conditions as in the same manner as the measurements conducted under normal surrounding conditions. As a result, overall, the observed value of the discharge current had a sufficient level to ensure a high quality level of the copied image without having charged electric potential irregularities.

As shown in FIG. 19, according to the results of measurement, a value on the straight line DE shows a upper limit value of the discharge current in each discharge current $I_p$ for ensuring the high quality level without having charged electric potential irregularities, while a value on the straight line DF shows a lower limit value of the discharge current in each discharge current $I_p$ for ensuring the high quality level without having charged electric potential irregularities. The straight line DE and the straight line DF are respectively expressed by the following formulae (12) and (13):

$$\log(I_g/I_c)=-8.78\times10^{-3}I_p-2.32 \quad (12)$$

$$\log(I_g/I_c)=5\times10^{-3}I_p+1.68 \quad (13)$$

When the discharge current $I_p$ is set so as to fall in a range of not more than −400 (μA), and the respective values for $I_g$, $I_c$ and $I_p$ are selected to fall within an area surrounded by $I_p$=−400, the straight line DE and the straight line DF (an area shown by the triangle DGH) taking the parameters $I_g$ and $I_c$ into consideration, the high voltage generating section 63 can be small-sized, thereby permitting a reduction in size of the charging device. Additionally, as the amount of ozone generated can be reduced to a ignorable level, an ozone filter can be omitted from the conventional charging device. This permits a wider design choice as more space is available, and also permits various standards set with regard to an amount of ozone generated to be satisfied. Besides, the uniformity in discharge can be ensured under normal surrounding conditions. As a result, the charged electric potential irregularities on the surface of the photoreceptor drum 51 can be surely prevented, thereby obtaining a charging device which permits a reliable operation.

Figure 20:
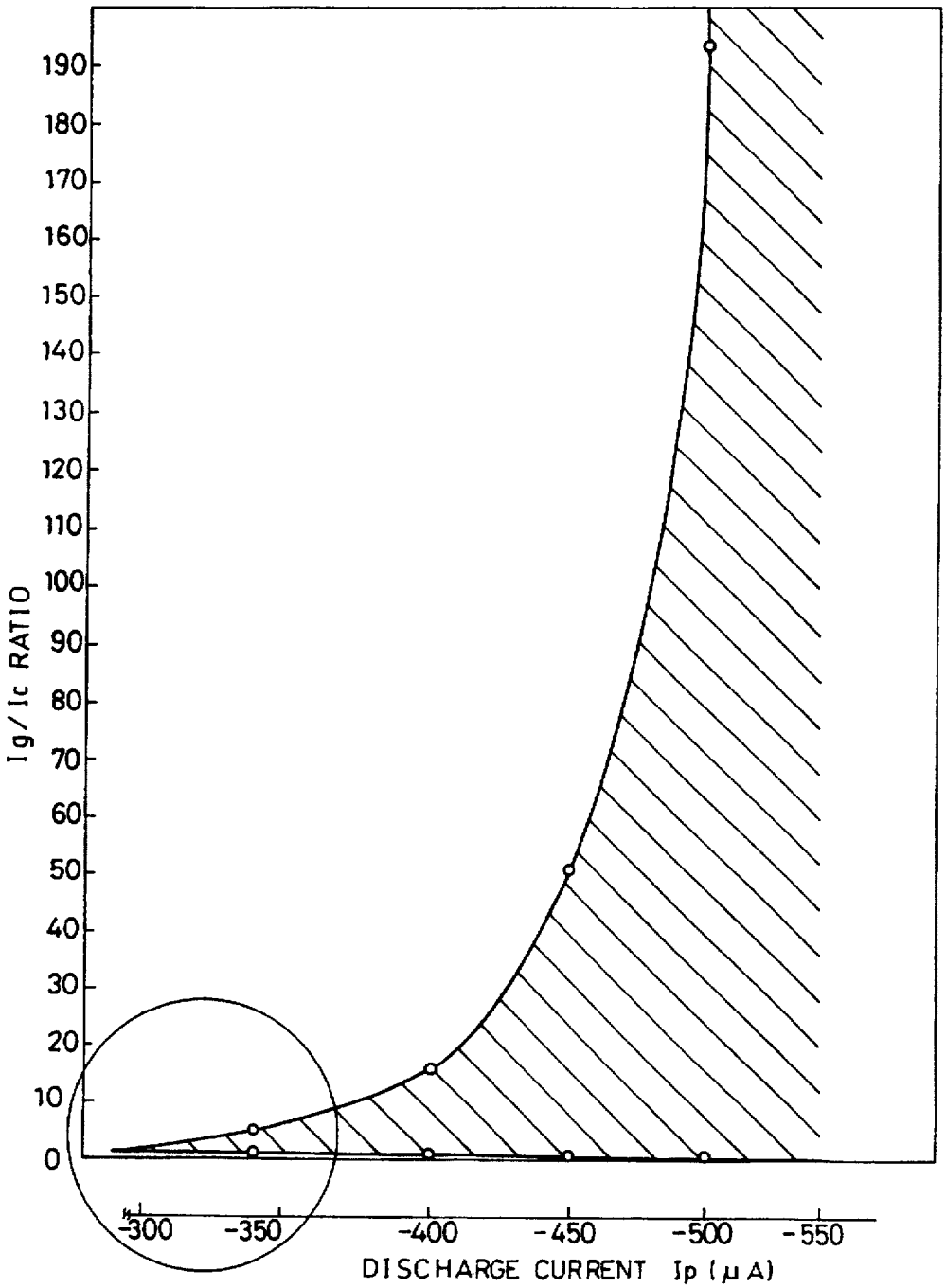
FIG. 20 is an explanatory view showing $(I_g/I_c)$ under critical surrounding conditions without using logarithm expression for the y-axis of FIG. 19.
Figure 21:
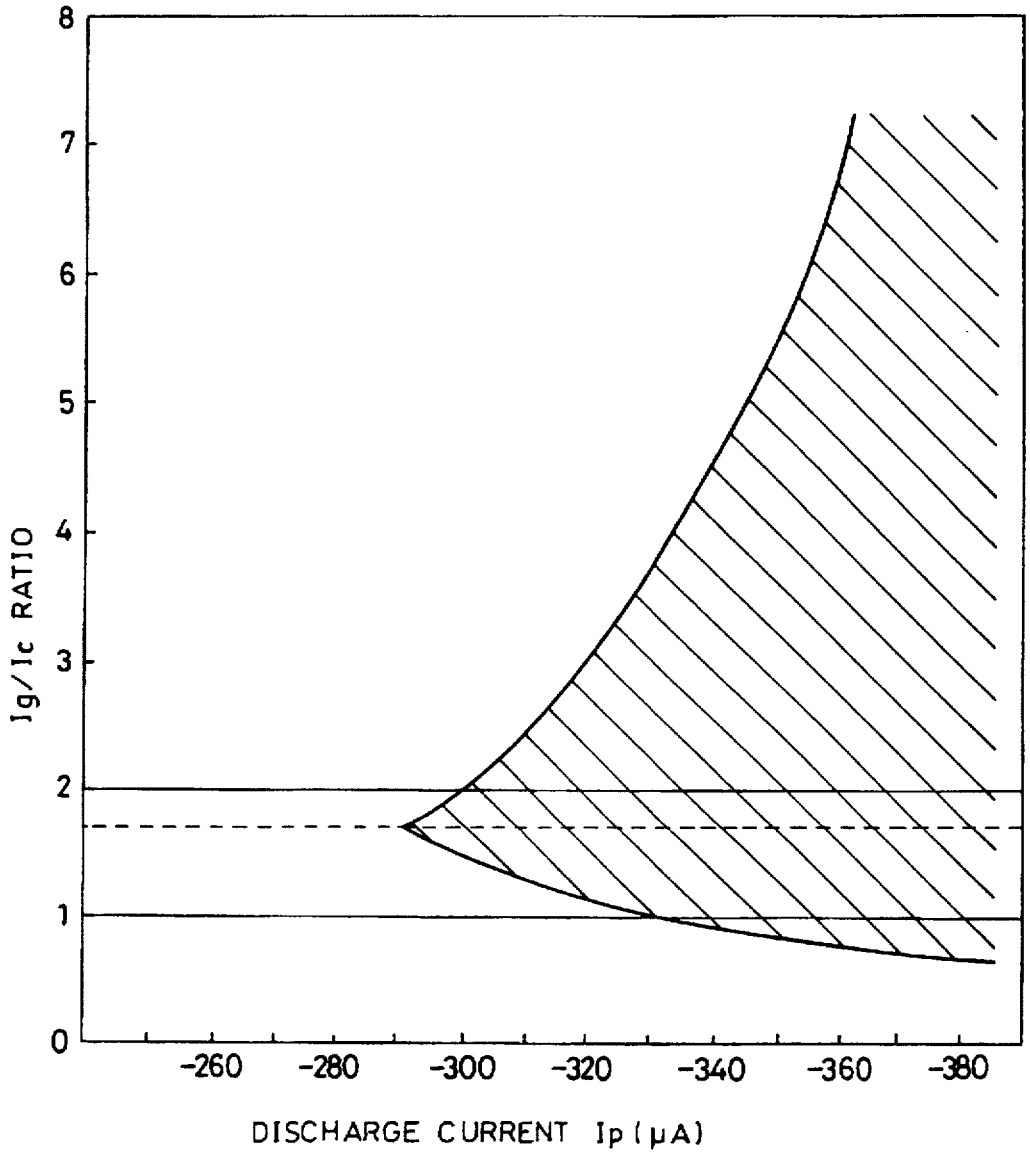
FIG. 21 is an enlarged view of a circled portion in FIG. 20.

FIG. 20 shows the ratio of $I_g/I_p$ without using logarithm expression under critical surrounding conditions. As is evident from FIG. 20, by making the discharge current $I_p$ smaller, the ratio of $(I_g/I_c)$ can be converged in a range of 1 to 2 (see FIG. 21). When the ratio of $(I_g/I_c)$ is to not more than 1, it is necessary to set the discharge current $I_p$ large. Therefore, it is preferable to set the ratio of $(I_g/I_c)$ greater than 1. On the other hand, to ensure the discharge stability, it is effective to set the case current $I_c$ large as well as the grid current $I_g$. When the charged electric potential irregularities are taken into consideration, the ratio of $(I_g/I_c)$ is preferably set to not more than 10. FIG. 21 is an enlarged view of a circled area in FIG. 20.

As described, by setting the grid current $I_g$ greater than the case current $I_c$ within the range of $1<(I_g/I_c)<10$, the charged electric potential irregularities can be prevented. The ratio of $(I_g/I_c)$ in the described range can be achieved by setting the grid current $I_g$ greater than the case current $I_c$, for example, by applying a negative voltage to the MC case 2a . This permits the charging device to be designed to have such beneficial features that a discharging uniformity is maintained, and the charged electric potential irregularities on the surface of the photoreceptor drum 51 can be surely prevented.

Here, the aforementioned condition of $0.4\leqq(L_{pg}/L_c)<0.5$ will be explained. This condition can be interpreted as follows. When $L_{pg}$ that is a distance between the discharge tip portions and the grid is set large, the discharge starting voltage $V_{th}$ becomes large, which causes the charging device to be large-sized. When an attempt is to be made to reduce the size of the charging device, there is an upper limit value for the application voltage to the discharge electrode in terms of cost, space, etc., and if the application voltage exceeding the upper limit value is applied, a discharging operation would not be stably performed. Here, by adjusting the opening width $L_c$ of the MC case 2a, the ratio of $(I_g/I_c)$ can be controlled. Specifically, if the opening width $L_c$ is set too large, the case current $I_c$ would be reduced, and a discharging operation may not be stably performed.

Figure 22:
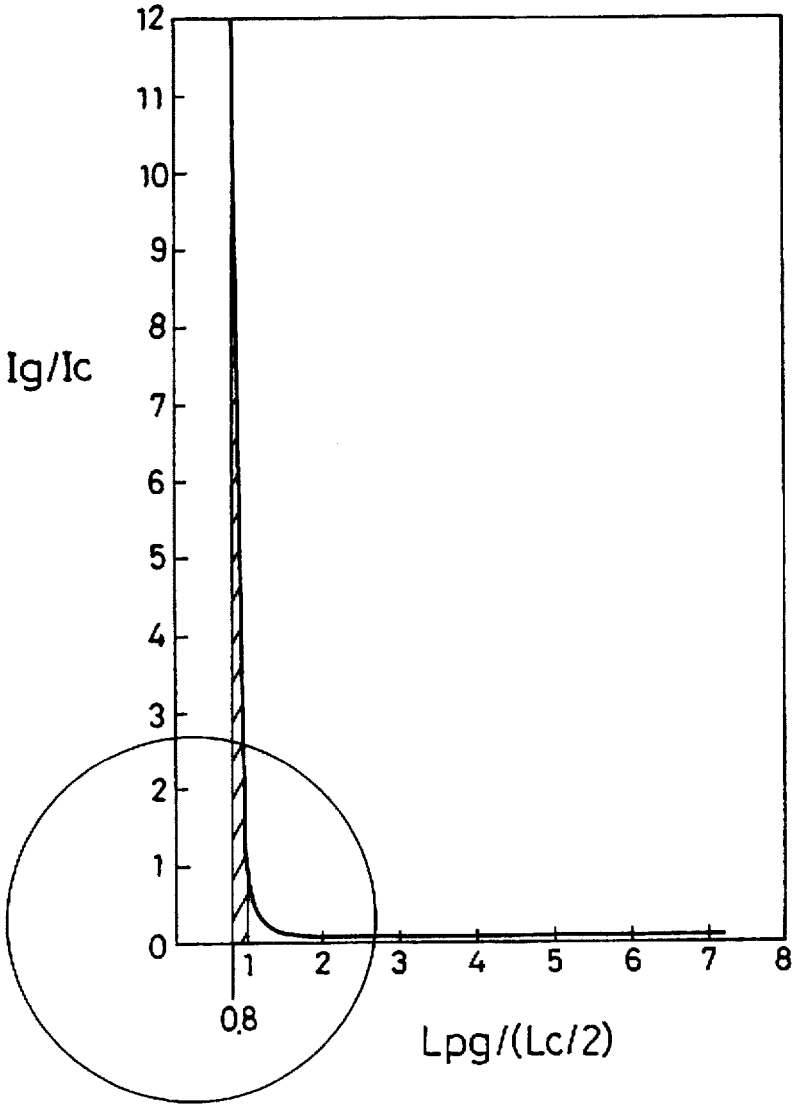
FIG. 22 is an explanatory view showing a correlation between $(L_{pg}/(L_c/2))$ and $(I_g/I_c)$.
Figure 23:
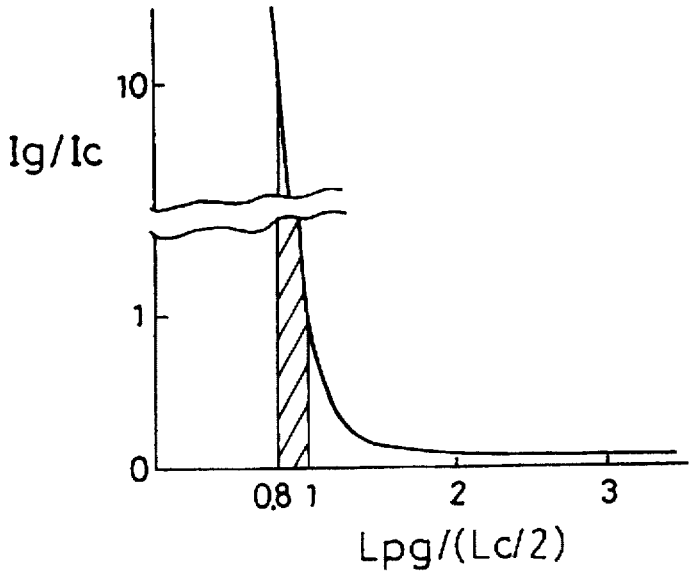
FIG. 23 is an enlarged view of a circled portion in FIG. 22.

The respective ratios of $(L_{pg}/(L_c/2))$ and $(I_g/I_c)$ have the correlation shown in FIG. 22 and FIG. 23. As shown in FIG. 22 and FIG. 23, when the ratio of $(L_{pg}/(L_c/2))$ becomes smaller than 1, the ratio of $(I_g/I_c)$ suddenly increases, and the grid current $I_g$ increases. On the contrary, when the ratio of $(L_{pg}/(L_c/2))$ becomes larger than 1, the ratio of $(I_g/I_c)$ suddenly becomes small, and the case current $I_c$ becomes large. FIG. 23 is an enlarged view of the circled portion in FIG. 22.

As described, it is preferable to satisfy the condition of $1<(I_g/I_c)\leqq10$. Therefore, by setting $(L_{pg}/(L_c/2))$ so as to correspond to the described range, i.e., $0.4\leqq(L_{pg}/(L_c/2))<0.5$, the charged electric potential irregularities can be surely prevented. As shown in FIG. 22, the condition of $(I_g/I_c)=1$ corresponds to the condition of $(L_{pg}/(L_c/2))=1$, while the condition of $(I_g/I_c)=10$ corresponds to the condition of $(L_{pg}/(L_c/2))=0.8$. As described, by setting a half of the distance between the discharging tip portions and the shield case equal to the distance between the discharging tip portions and the grid, the uniformity of the charged electric potential can be maintained, and the discharging current can be suppressed.

Additionally, by determining the distance $L_{pg}$ and the opening $L_c$, the shape of the MC case 2a can be estimated to some degree, and a subsequent design process of the charging device can be performed efficiently in a short period of time. Namely, if either one of $L_{pg}$ and $L_c$ is given, the shape of the MC case 2a is roughly determined, thereby providing a charging device which is applicable to a small-sized MC case 2a.

Next, an optimization of the grid voltage and a miniaturization of discharge current (S5 and S6) will be explained. Here, the grid voltage $V_g$ is set in consideration of the charging time T (time obtained by dividing the opening width of the shield case by a process speed). Namely, the grid voltage $V_g$ suggests a grid voltage which permits the surface of the photoreceptor drum 51 to be charged to a predetermined charged electric potential within the charging time T and the charged electric potential irregularities ΔV to fall in a range of not more than a predetermined value.

By increasing the grid voltage $V_g$, the charge can be performed more quickly, and the time required for reacting the saturated electric potential $V_s$ can be reduced, thereby improving the charging characteristics; however, the charged electric potential irregularities ΔV becomes larger. On the other hand, by reducing the grid voltage, the charged electric potential irregularities ΔV can be reduced. In order to stabilize the saturated electric potential $V_s$ on the surface of the photoreceptor drum 51, and suppress charged electric potential irregularities, it is required to increase the discharge current $I_p$ However, by doing so, the amount of ozone generated increases on the contrary. In consideration of the above, it is required to set the application voltage to the grid so as to stabilize the saturated potential $V_s$ and to maintain charged electric potential irregularities within a permissible range.

Figure 24:
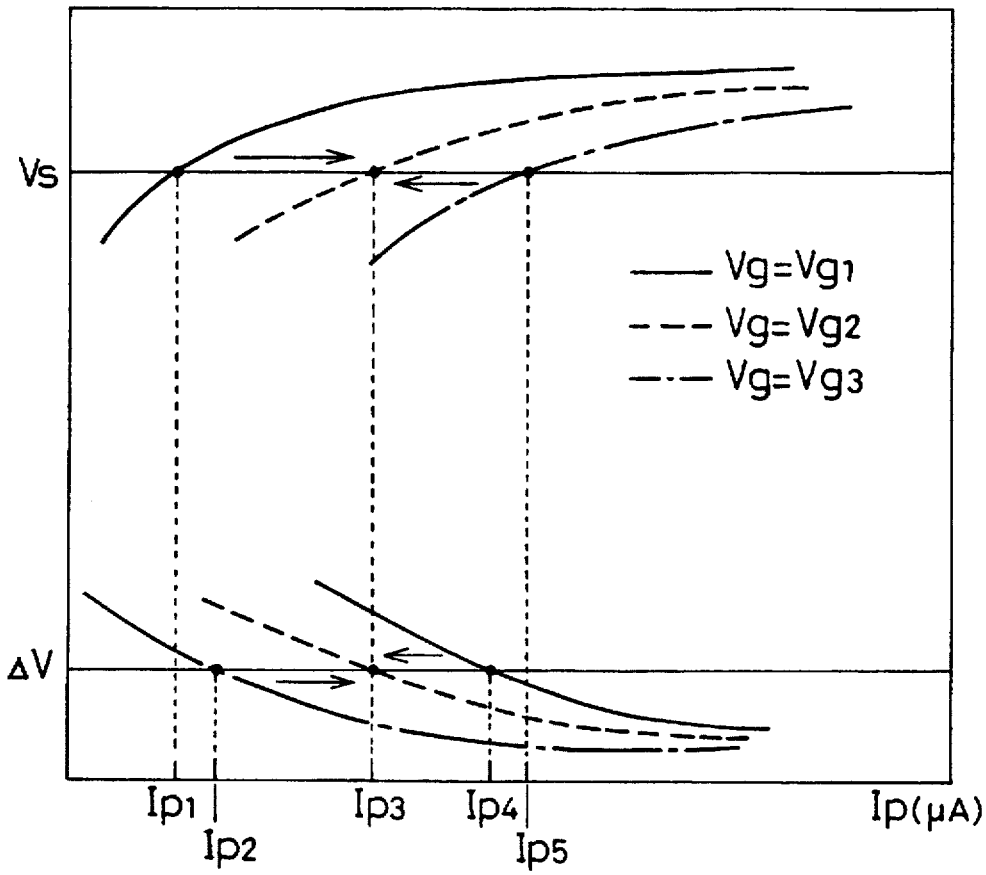
FIG. 24 is an explanatory view showing results of measurement of a saturated potential $V_s$ and charged electric potential irregularities $\Delta V$ of the photoreceptor drum with respect to the discharge current $I_p$ using a grid voltage $V_g$ as a parameter.

The saturated potential $V_s$ and charged electric potential irregularities ΔA of the photoreceptor drum 51 were measured with respect to the discharge current $I_p$ using the grid voltage $V_g$ as a parameter. Then, the observed results are as shown in FIG. 24. As is evident from FIG. 24, by increasing the discharge current $I_p$, the saturated potential $V_s$ becomes stabilized, and charged electric potential irregularities ΔA can be reduced. Namely, it can be seen that the level of the discharge current $I_p$ has a large effect on the stability in charged electric potential on the surface of the photoreceptor drum 51.

Assumed here that in FIG. 24, the condition of $V_{g1} \geqq V_{g2} \geqq V_{g3}$ is satisfied, wherein $V_{g1}$, $V_{g2}$ and $V_{g3}$ respectively represent grid voltage, and that the condition of $I_{p1} \leqq I_{p2} \leqq I_{p3} \leqq I_{p4} \leqq I_{p5}$ is satisfied wherein $I_{p1}$, $I_{p2}$, $I_{p3}$, $I_{p4}$ and $I_{p5}$ respectively represent discharge current.

When the condition of $V_g=V_{g1}$ (when the grid voltage is large) is given, to stabilize the saturated potential $V_s$, it is required for the discharge current to satisfy the condition of $I_p \geqq I_{p1}$. Additionally, to suppress charged electric potential irregularities ΔA to fall in a range of not more than a predetermined range, it is required for the discharge current to satisfy the condition of $I_p \geqq I_{p4}$. Therefore, to stabilize the saturated potential $V_s$ and to maintain the charged electric potential irregularities ΔA within a range of not more than a predetermined range, it is required to satisfy the condition of $I_p \geqq I_{p4}$. On the other hand, when the condition of $V_g=V_{g3}$ (when the grid voltage is small) is given, to stabilize the saturated potential Ve, the discharging current is required to have the condition of $I_p \geqq I_{p5}$. Similarly, to suppress the charged electric potential irregularities ΔA to fall in a range of not more than a predetermined value, it is required to satisfy the condition of $I_p \geqq I_{p2}$. Therefore, to stabilize the saturated potential $V_s$ while maintaining the charged electric potential irregularities to fall within a range of not more than a predetermined value, it is required to satisfy the condition of $I_p \geqq I_{p5}$.

As described, to stabilize the surface of the photoreceptor drum 51, it is preferable to increase the discharge current $I_p$; however, an amount of ozone generated increases on the contrary. Therefore, to reduce the discharge current $I_p$, for example, it is required to set the discharging current between $I_{p1}$ and $I_{p5}$ (for example, $I_p \geqq I_{p3}$), to stabilize the saturated potential $V_s$, and to maintain the charged electric potential irregularities ΔV to fall within a range of not more than a predetermined range. Namely, in FIG. 24, by setting the grid voltage $V_g$ equal to $V_{g2}$, the discharge current $I_p$ can be minimized while stabilizing the saturated potential $V_s$, and the charged electric potential irregularities ΔV can be maintained in a range of not more than a predetermined range.

As described, when determining an optimal value for the grid voltage $V_g$, a grid voltage which permits the discharge current to be minimized is selected among grid voltages which ensure the stability of the saturated electric potential $V_s$ on the surface of the photoreceptor drum 51 and the permissible level of the charged electric potential irregularities ΔA.

As described, in the charging device, the minimum discharging current for charging the surface of the photoreceptor drum 51 to the saturated potential $V_s$ and the minimum discharging current for maintaining the charged electric potential irregularities on the surface of the photoreceptor within a permissible level are respectively designated by $I_{vsmin}$ and $I_{dvmin}$, it is preferable to set the grid voltage $V_g$ to satisfy the condition of $I_{vsmin} \approx I_{dvmin}$. Therefore, irrespectively of a small discharge current, the saturated potential $V_g$ is stabilized, and the charged electric potential irregularities ΔA can be maintained in a range of not more than a predetermined level. Additionally, as the discharge current can be set small, amount of ozone generated can be reduced, and the surface of the photoreceptor drum 51 can be uniformly charged.

The surrounding conditions (S7) will be explained. The correlation between the absolute humidity $D_H$ and the minimum discharge current which would not cause the charged electric potential irregularities with respect to the absolute humidity $D_H$ are measured, and the results shown in table 2 are obtained. The results are plotted in FIG. 25.

TABLE 2

| | | | |
|---|---|---|---|
| RELATIVE HUMIDITY (%) | 35 | 55 | 85 |
| TEMPERATURE (°C.) | 5 | 20 | 35 |
| ABSOLUTE HUMIDITY (g/m³) | 2.38 | 9.51 | 33.64 |
| MINIMUM DISCHARGE CURRENT (μA) | −140 | −200 | −400 |

Figure 25:
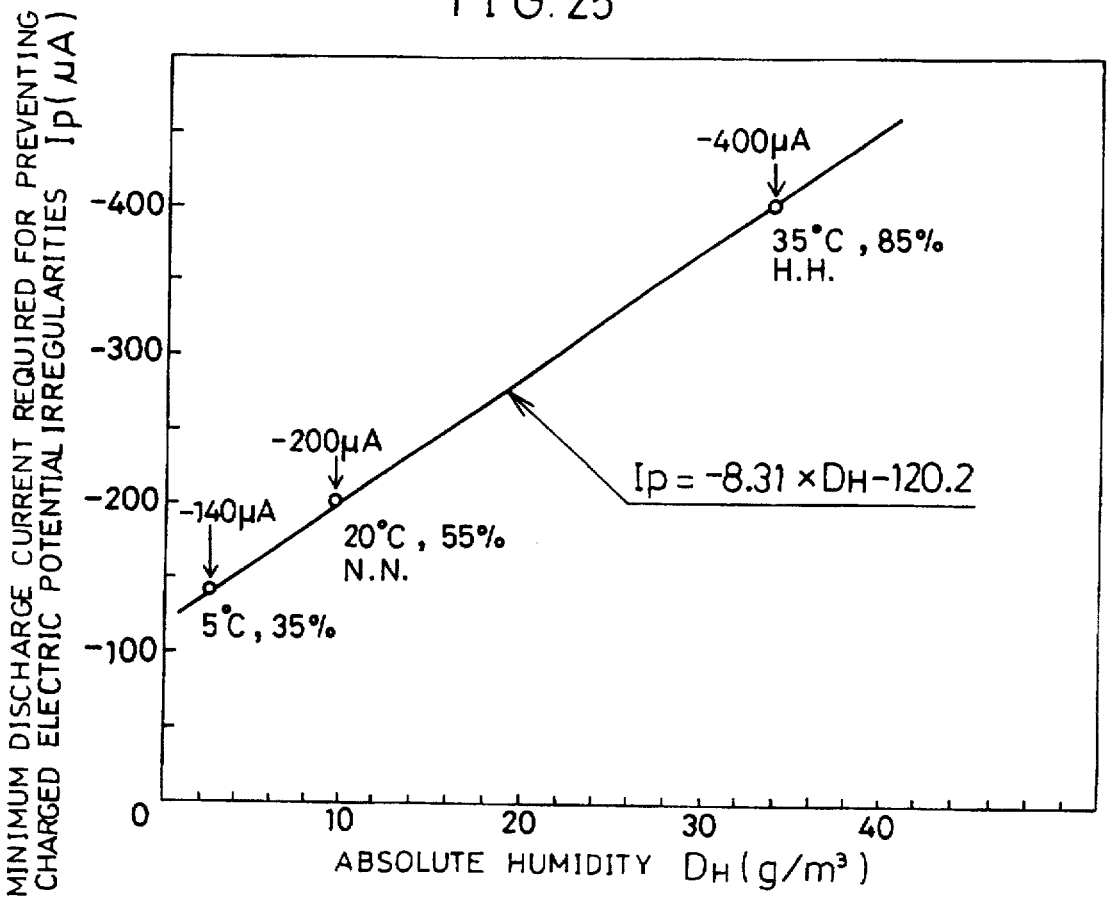
FIG. 25 is an explanatory view showing results of measurement of lower limit value of the discharge current $I_p$ required for preventing charged electric potential irregularities with respect to an absolute humidity $D_H$.

In FIG. 25, the temperature of 20° C. and the relative humidity of 55% show the surrounding conditions NN (Normal Temperature and Normal Humidity), and temperature of 35° C. and the relative humidity of 85% show the critical surrounding conditions HH (High temperature and high Humidity).

As is evident from FIG. 25, respective measurement points are on the straight line of $I_p=-8.31\ D_H-120.2$, and by applying the discharge current $I_p$ of not less than the value on this straight line, the charged electric potential irregularities can be prevented. In Table 2, the absolute humidity of 9.51 (g/m$^3$) corresponds to the normal surrounding conditions (ambient temperature of 20° C., and the relative humidity of 55%), and the absolute humidity of 33.64 (g/m$^3$) corresponds to the critical surrounding condition (ambient temperature of 35° C., and the relative humidity of 85%).

The ratio of $I_g/I_c$ in FIG. 19 which varies in response to a change in absolute humidity (see the dotted straight line PQ and straight line PR shown in FIG. 19) varies according to the equation $I_p=-8.31\ D_H-120.2$. Namely, in response to a change in absolute humidity, the straight line PQ varies between the straight line AB and the straight line DE with the same slope as the both lines AB and DE. In accordance with a change in absolute humidity, the straight line PR varies between the straight line AC and the straight line DF with the same slope as these lines. The straight lines PQ and PR are respectively expressed by the following formulae (14) and (15).

$$\log (I_g/I_c)=-8.78\times10^{-3}I_p-(0.07\times D_H-0.16) \quad (14)$$

$$\log (I_g/I_c)=5\times10^{-3}I_p+(0.04\times D_H+0.28) \quad (15)$$

In FIG. 19, the straight lines AB and AC respectively show characteristics under normal surrounding conditions, and the straight lines DE and DF show characteristics under critical surrounding conditions. Here, the equations (14) and (15) are satisfied with respect to any absolute humidity, the discharging uniformity can be maintained at any surrounding conditions (ambient temperature and relative humidity). Namely, by setting the respective values for $I_g$, $I_c$ and $I_p$ within an area surrounded by the straight lines resulting from substituting the desired absolute humidity $D_H$ into the equations (14) and (15) and $I_p=-400$ (μA), the discharge uniformity is maintained at any surrounding condition from normal surrounding conditions to the critical surrounding conditions, and the charged electric potential irregularities on the surface of the photoreceptor drum 51 can be surely prevented.

In this case, as the discharge current $I_p$ is set small, i.e., in a range of not more than −400 (μA), the amount of ozone generated can be reduced to an ignorable level, and the high voltage generating section 63 can be small-sized, thereby permitting a reduction in size of the charging device. Additionally, a discharging operation can be stably performed. Therefore, the ozone filter can be omitted from the conventional charging device, and the charging device which meets various standard requirements set with regard to an amount of ozone gene rated can be achieved.

Here, an optimization of the grid current $I_g$ the case current $I_c$, and the drum current $I_d$ will be explained. The larger the discharge current $I_p$, the more stably the discharging operation can be performed, and the more suppressed is the charged electric potential irregularities on the surface of the photoreceptor drum 51; however, the amount of ozone generated increases on the contrary. The discharge current $I_g$ and $I_c$ vary in response to $L_{pg}/l_c$ that is a ratio of the distance $L_{pg}$ between the grid and the discharging tip portions to the distance $l_c$ between the MC case 2a and the discharging tip portions, on the other hand, $I_d$ is maintained constant irrespectively of the ratio of $L_{pg}/l_c$. In consideration of the above, to carry out a uniform discharging operation without increasing the size of the entire charging device, it is required to satisfy a specific correlation amon $I_g$, $I_c$ and $I_d$.

Figure 26:
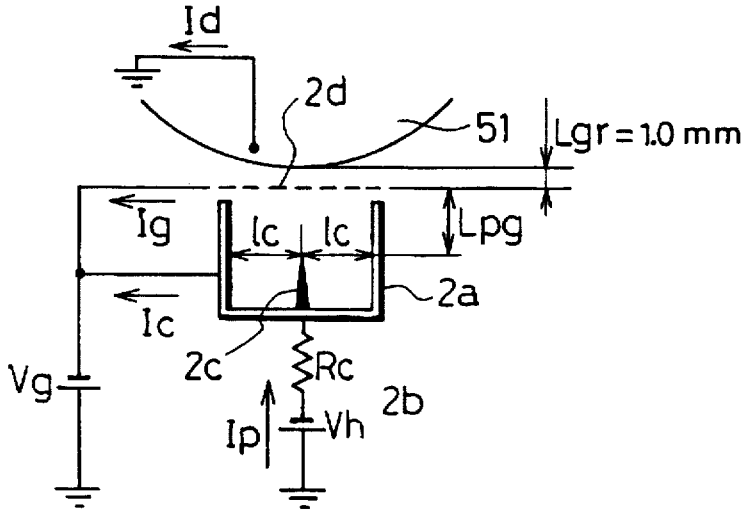
FIG. 26 is an explanatory view for measuring respective amounts of change in $I_g$, $I_c$ and $I_d$ while varying parameters $L_{pg}$ and $l_c$ of the MC case under constant discharge current.

In the arrangement of the charging device shown in FIG. 26, it is assumed that the distance $L_{gr}$ between the photoreceptor drum 51 and the grid 2d (grid gap) is set to 1 mm, and the distance between the grid 2d and the discharge tip portion and the distance between the discharge tip portion and the MC case 2a are respectively designated by $L_{pg}$ and $l_c$. Then, the discharge current $I_p$ is expressed by the following formula (16) when no leakage discharge is generated:

$$I_p=I_g+I_c+I_d \quad (16)$$

Figure 27:
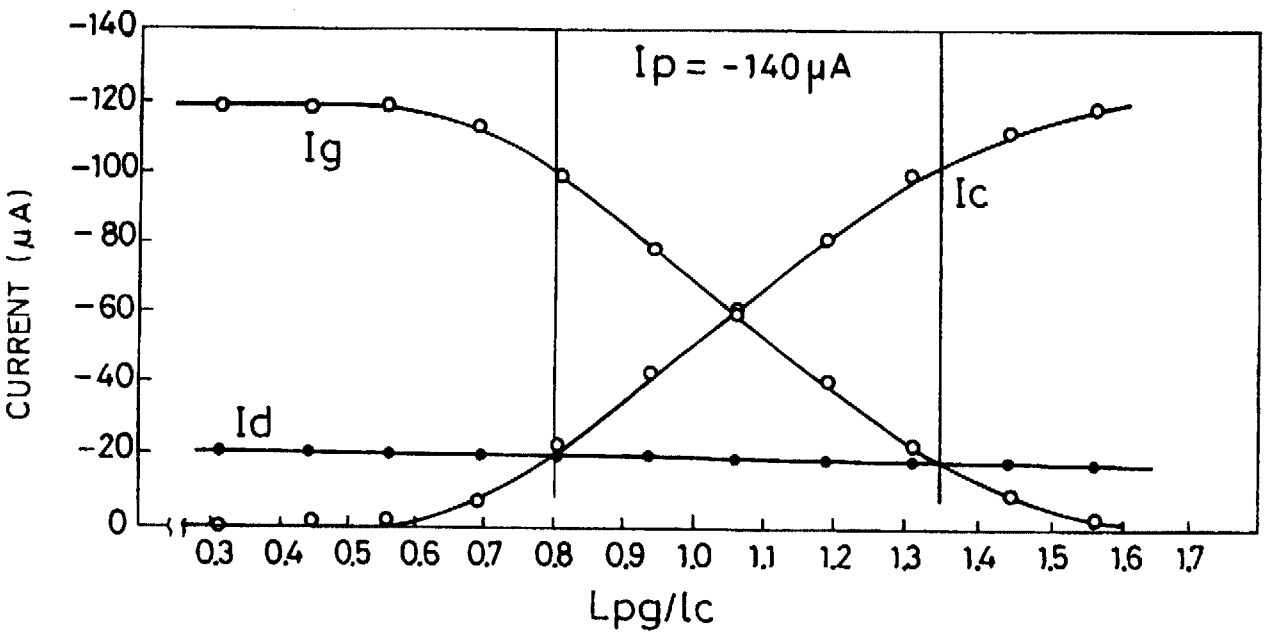
FIG. 27 is an explanatory view showing the results of measurement in the structure of FIG. 26.

Here, under an applied constant discharge current in (−140 μA and −180 μA), the respective changes in $I_g$, $I_c$ and $I_p$ were measured with variable parameters $L_{pg}$ and $l_c$ of the MC case 2a. Then, the results shown in FIG. 27 are obtained. As shown in FIG. 27, the respective parameters $I_g$ and $I_c$ vary in response to the ratio of $(L_{pg}/l_c)$, and these changes greatly affect the charging characteristics of the photoreceptor drum 51. However, a significant change in $I_d$ is not observed, and shows a substantially constant value.

Figure 28:
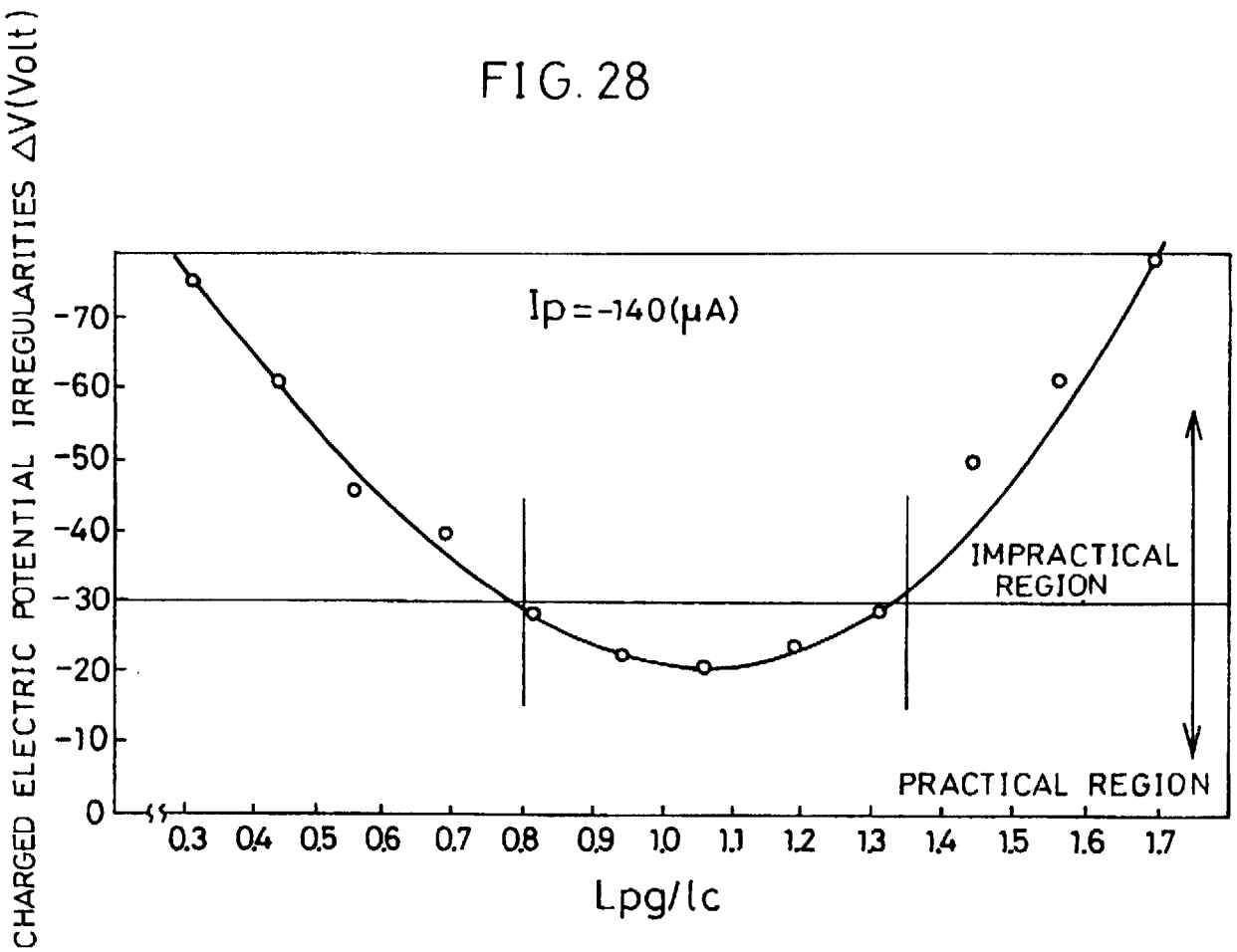
FIG. 28 is an explanatory view of the results of measurement showing how the charged electric potential irregularities $\Delta V$ vary with respect to $(I_p/I_c)$ when the discharge current $I_p$=−140 μA.

FIG. 28 shows results of measurement indicating how the charged electric potential irregularities ΔA vary under an applied discharge current $I_p=-400$ μA in accordance with $L_{pg}/l_c$. As is evident from FIG. 28, when the ratio of $(L_{pg}/l_c)$ is set around 1.1, the charged electric potential irregularities ΔV is minimized. However, when only the practical range where the charged electric potential irregularities ΔA is not more than 30 V is taken into consideration, it is preferable that the respective parameters are set so as to satisfy the condition of $0.8\leqq(L_{pg}/l_c)\leqq1.35$.

Figure 29:
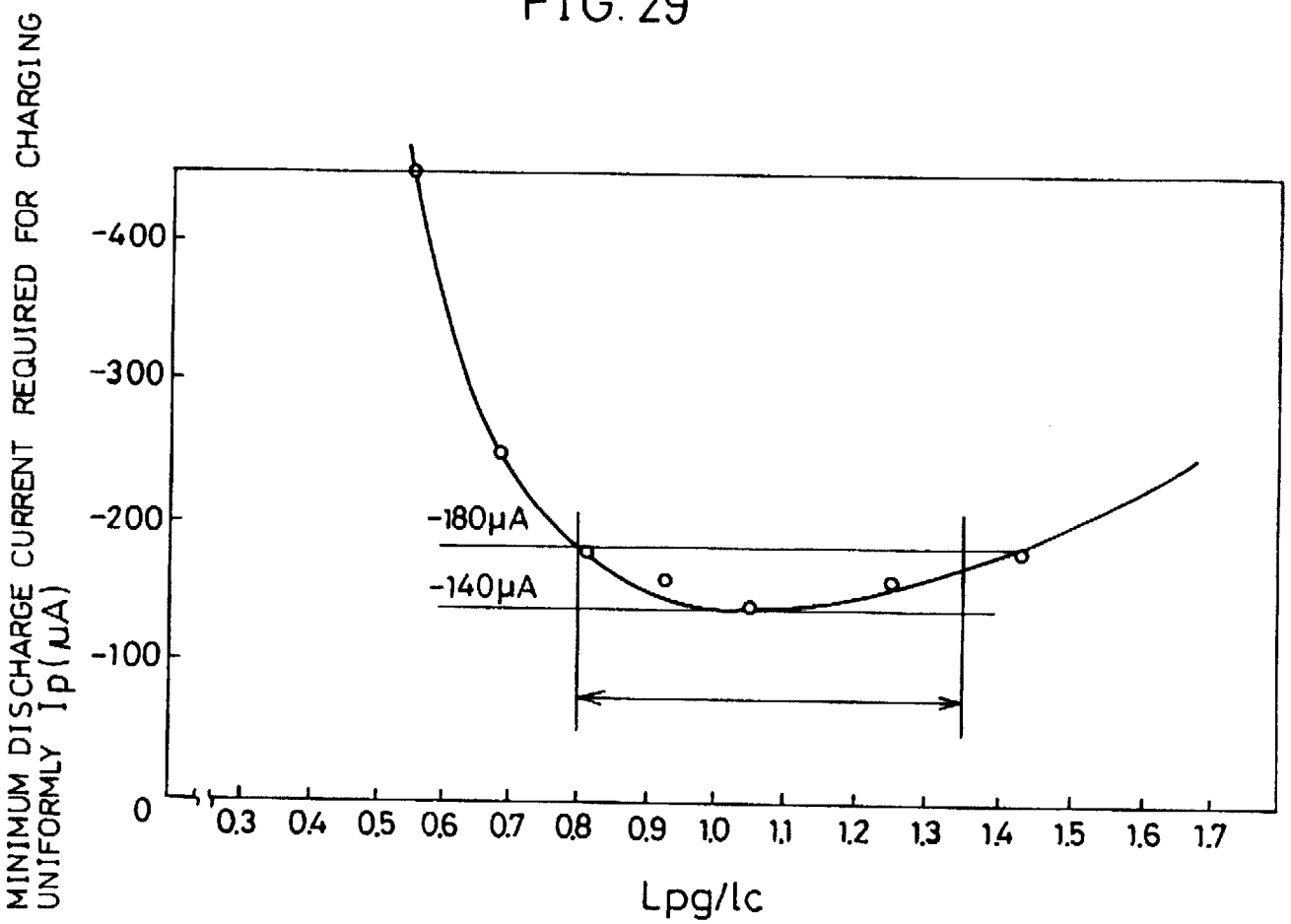
FIG. 29 is an explanatory view showing results of measurement of uniformity of charge by varying a current distribution ratio among $I_g$, $I_c$ and $I_d$ by varying parameters $L_{pg}$ and $l_c$ of the MC case.

FIG. 29 shows the results of measurements of the uniformity of charge when a ratio in distribution of current among $I_g$, $I_c$ and $I_d$ varied with variable parameters $L_{pg}$ and $l_c$ of the MC case 2a. As is evident from FIG. 29, the minimum discharge current $I_p$ required to obtain a uniform charge varies in response to the ratio of $(L_{pg}/l_c)$, and the minimum value (optimal value) for the discharge current $I_p$ required for obtaining a uniform charge is −140 μA. Here, the ratio of $(L_{pg}/l_c)$ is required to be set around 1.1, and by setting so, as the discharge current reduces, the amount of ozone produced can be also reduced, thereby solving the environmental problems. It is additionally seen that when considering the range of $0.8\leqq(L_{pg}/l_c)\leqq1.35$ wherein the charged electric potential irregularities ΔA is not more than 30 V, the discharge current $I_p=-180$ μA would offer a uniform charge.

Figure 30:
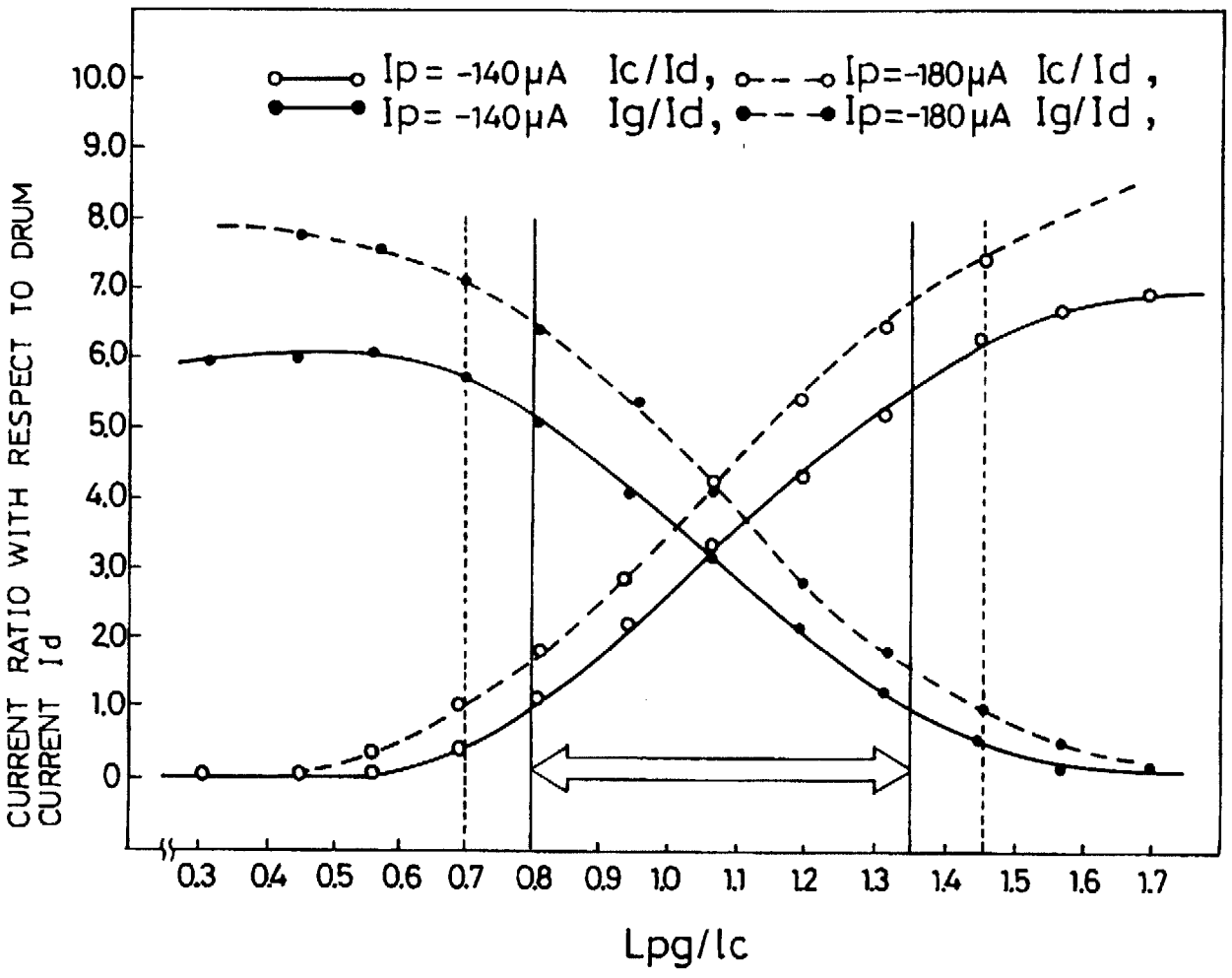
FIG. 30 is an explanatory view showing the results of measurement of current ratio with respect to the drum current $I_d$ based on the results shown in FIG. 27.
Figure 31:
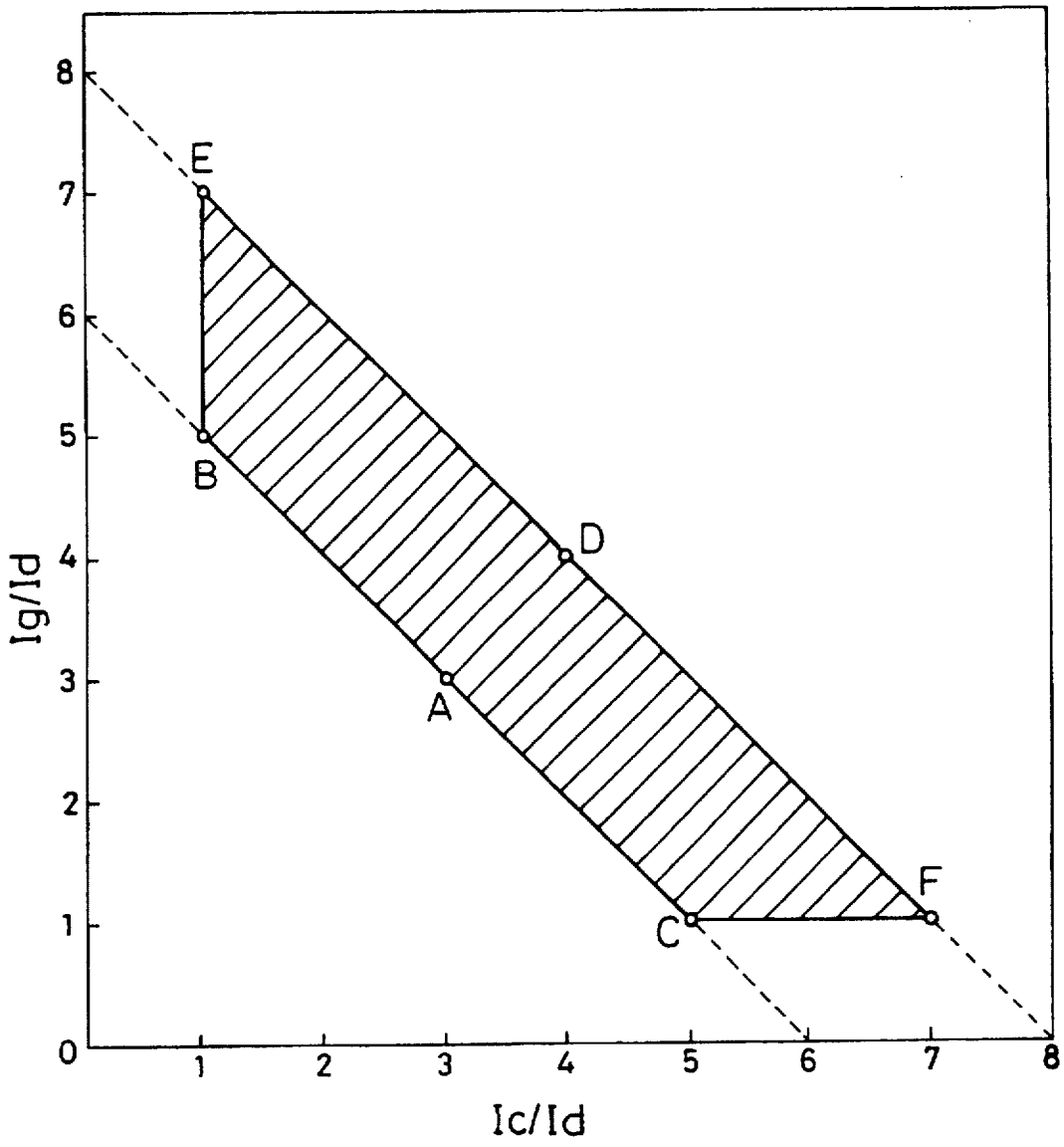
FIG. 31 is an explanatory view showing respective regions for $I_g$, $I_c$ and $I_d$ wherein charged electric potential irregularities $\Delta V$ on the surface of a photoreceptor drum 51 can be surely reduced to a level that problems associated with an amount of ozone generated can be suppressed to an ignorable level while ensuring a uniform discharge.

The respective ratios of the grid current $I_g$ and the case current $I_c$ with respect to the drum current $I_d$ are calculated based on the results shown in FIG. 27, and the calculation results shown in FIG. 30 are obtained. The results of measurement under an applied constant discharge current of −180 μA are also shown in FIG. 30.

As shown in FIG. 30, under an applied discharge current of $I_p=-140$ μA, in the range of $0.8\leqq(L_{pg}/l_c)\leqq1.35$, $I_c/I_d$ and $I_g/I_d$ vary on the curve $(I_g/I_d)+(I_c/I_d)=6$ in accordance with $(L_{pg}/l_c)$, and the conditions of $I_c/I_d\geqq1$ and $(I_g/I_d)\geqq1$ are satisfied.

In the range where both the conditions of $I_c/I_d\geqq1$ and $(I_g/I_d)\geqq1$ are satisfied, as is clear from FIG. 28 and FIG. 29, the discharge current $I_p$ for uniformly charging the surface of the photoreceptor drum 51 can be suppressed, and the charged electric potential irregularities ΔA can be suppressed to a still smaller range. Additionally, as the discharge current $I_p$ can be set small, an amount of ozone generated can be suppressed, thereby providing a sufficient solution to environmental problems.

Similarly, when the discharge current $I_p=-180$ μA, in the range of $0.7\leqq(L_{pg}/l_c)\leqq1.45$, the conditions of $I_c/I_d\geqq1$ and $(I_g/I_d)\geqq1$ are satisfied, and the respective ratios of $I_c/I_d$ and $I_g/I_d$ vary almost linearly on $(I_c/I_d)=8$ in accordance with $(L_{pg}/l_c)$.

As described, in the range of $-140\ \mu A \leqq I_p \leqq -180\ \mu A$, by setting respective parameters $I_g$, $I_c$ and $I_d$ so as to fall within the range (an area surrounded by BACFDE in FIG. 31) surrounded by the lines represented by the following formulae:

$(I_g/I_d)+(I_c/I_d)=6$, $(I_g/I_d)+(I_c/I_d)=8$, $(I_c/I_d)+1$, and $(I_g/I_d)=1$, the discharge current $I_p$ can be suppressed to a level which permits the following beneficial features to be obtained: An amount of ozone generated would not be a problem, a uniform discharging operation can be performed, and charged electric potential irregularities on the surface of the photoreceptor drum 51 can be surely prevented.

It is especially preferable that the respective parameters $I_g$, $I_c$ and $I_d$ are set so as to fall in the range surrounded by lines represented by the following formulae:

$(I_g/I_d)+(I_c/I_d)=6$, $1 \leqq (I_c/I_d) \leqq 5$, and $1 \leqq (I_g/I_d) \leqq 5$.

By setting so, the charged electric potential irregularities $\Delta A$ can be reduced to not more than 30 V. Here, the discharge current $I_p$ is minimized ($-140\ \mu A$) with respect to each $L_{pg}/l_c$, and the amount of ozone generated can be reduced, thereby providing a sufficient solution to the environmental problems. Moreover, a uniform discharging operation can be performed, and charged electric potential irregularities on the surface of the photoreceptor drum 51 can be surely suppressed to a small level.

It is still more preferable to set the parameters $I_g$, $I_c$ and $I_d$ to satisfy the condition of $(I_g/I_d)=(I_c/I_d)=3$. In this case, a discharging operation can be performed most stably, and charged electric potential irregularities $\Delta A$ can be minimized. In the meantime, the discharge current $I_p$ required obtaining a uniform charge can be minimized. Namely, by setting so as to satisfy the above-mentioned conditions, the charged electric potential irregularities, discharge current, and an amount of ozone generated can be minimized, thereby enabling that the device can be small-sized. Therefore, by adopting the charging device of the described arrangement in the copying machine, an optimal copied image quality can be obtained.

Figure 32:
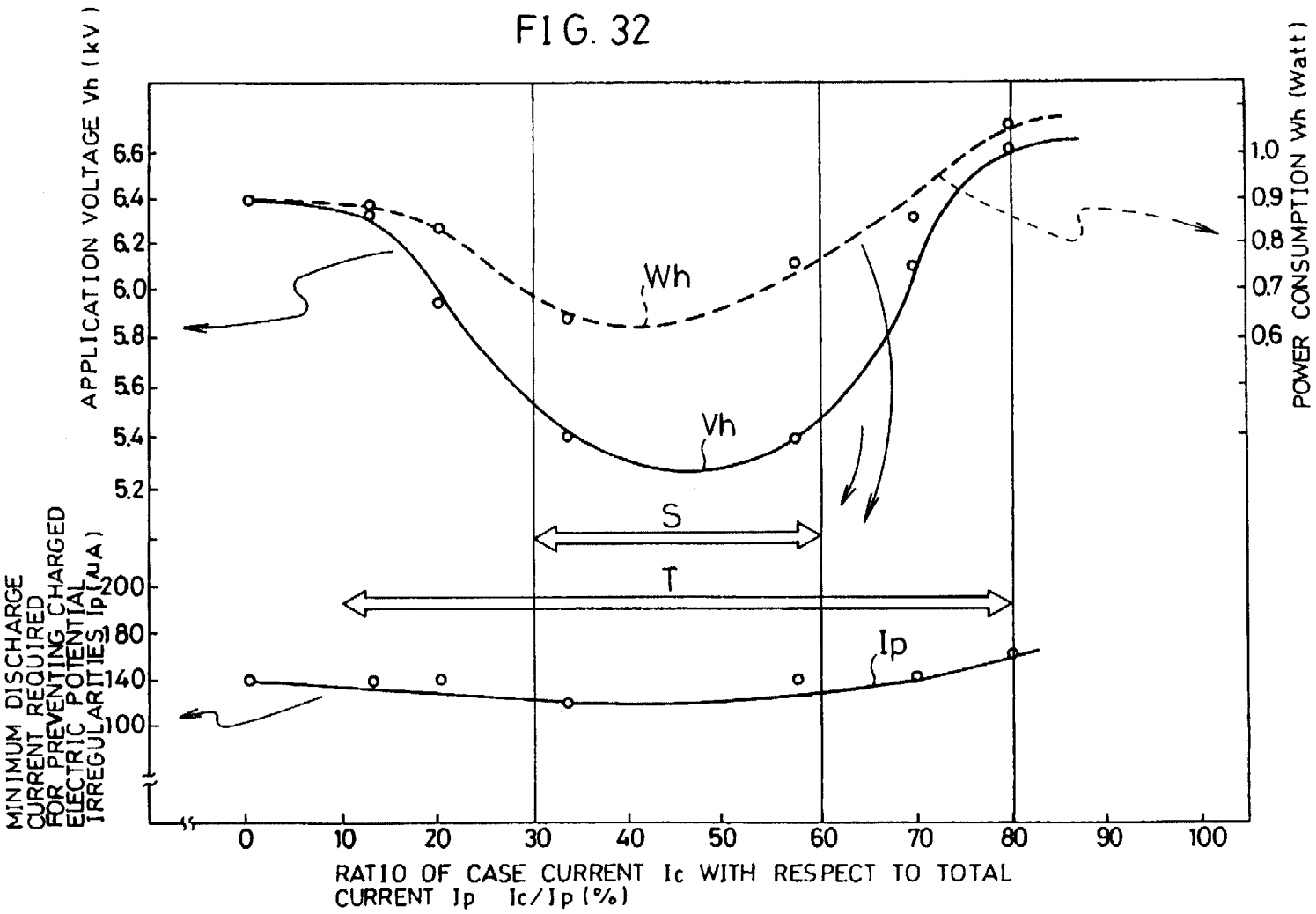
FIG. 32 is an explanatory view showing results of measurement of a ratio in percentage of the case current with respect to the discharge current (lower limit value for the discharge current required for preventing charged electric potential irregularities) when parameters $L_{gr}$, $L_{pg}$, and $l_c$ are respectively set to 1 (mm), 8.5 (mm) and 8.0 (mm).

Based on the results shown in FIG. 26, the ratio in percentage of the case current $I_c$ to the discharge current $I_p$ (minimum discharge current required for preventing the charged electric potential irregularities ) when the parameters $L_g$, $L_{pg}$ and $l_c$ are respectively set to 1 (mm), 8.5 (mm) and 8.0 (mm) were measured, and the results shown in FIG. 32 are obtained.

The discharge current $I_p$ gradually reduces from a vicinity of a point $(I_c/I_L)$ of 10 percent, and is minimized in a vicinity of a point $(I_c/I_p)$ of 40 to 50 percent. Thereafter, the discharge current $I_p$ gradually increases. This can be explained through the following mechanism. While the case current $I_c$ is small, a stable discharging operation cannot be obtained. Therefore, it is necessary to apply an increased amount of discharge current $I_p$. On the other hand, when the case current $I_c$ is increased, a discharging operation can be stabilized; however, the grid current $I_g$ is reduced on the contrary, thereby presenting the problem that a uniform discharging operation cannot be obtained. Therefore, the lower limit level for preventing the charged electric potential irregularities is minimized in an intermediate range, i.e., in a vicinity of a point $(I_c/I_p)$ of 40 to 50 percent.

On the other hand, the high voltage $V_h$ to be applied to the discharge electrode varies in response to the ratio $(I_c/I_p)$ as shown in FIG. 32. The high voltage $V_h$ varies in response to the space impedance $R_g$ (MΩ). When the case current $I_c$ varies, the space impedance $R_g$ also varies. Therefore, in the arrangement of the present embodiment, the high voltage $V_h$ varies by varying the case current $I_c$. The case current $I_c$ can be varied, for example, by applying a voltage to the MC case, or mounting an insulating substance to the MC case. For example, when the case current $I_c$ is small, as the space impedance $R_g$ becomes large, a larger high voltage $V_h$ would be required. Then, when the case current $I_c$ is gradually increased, as the space impedance $R_g$ reduces, the parameter $V_h$ also reduces.

As described, the parameter $V_h$ significantly reduces from a vicinity of a point $(I_c/I_p)$ of 10 percent, and is minimized in a vicinity of a point $(I_c/I_p)$ of 40 to 50 percent, and is increased to a vicinity of 80 percent. The high voltage $V_h$ is increased again as the discharge current $I_p$ increases after the point $(I_c/I_p)$ of 40 to 50 percent, and this causes the high voltage $V_h$ to be increased.

In FIG. 32, the curve $W_h$ (power consumption)$=V_h \times I_p$ is also plotted. As in the case of the parameters $V_h$ and $I_p$, the power consumption $W_h$ is minimized in a vicinity of a point $(I_c/I_p)$ of 40 to 50 percent.

The parameters $I_p$, $V_h$ and $W_h$ show that the lower limit of the discharge current $I_p$ required for preventing charged electric potential irregularities, an application voltage $V_h$ and a power consumption $W_h$ can be set small in the range of $0.1 \leqq (I_c/I_p) \leqq 0.8$ (the range denoted by T in the figure), thereby improving a charging efficiency of the charging device as a whole. Additionally, as the lower limit of the discharge current $I_p$ can be reduced, the amount of ozone generated can be also reduced, thereby providing a sufficient solution to the environmental problems.

The range of $0.3 \leqq (I_c/I_p) \leqq 0.6$ (the range denoted by S in the figure) is especially preferable as the lower limit discharge current for preventing charged electric potential irregularities, the high voltage $V_h$ to be applied to the discharge electrode and the power consumption $W_h$ of the charging device can be all reduced so as to have respective minimum values within the range. Therefore, by setting the respective parameters $I_c$ and $I_p$ so as to fall within the range of $0.3 \leqq (I_c/I_p) \leqq 5\ 0.6$, an optimal charging device can be designed. Namely, such charging device would permit the surface of the photoreceptor drum 51 to be charged without generating charged electric potential irregularities, while minimizing the application voltage $V_h$ and the power consumption $W_h$. As the discharge current is minimized, the amount of ozone generated is also minimized, thereby proving the sufficient solution to the environmental problem.

Figure 33:
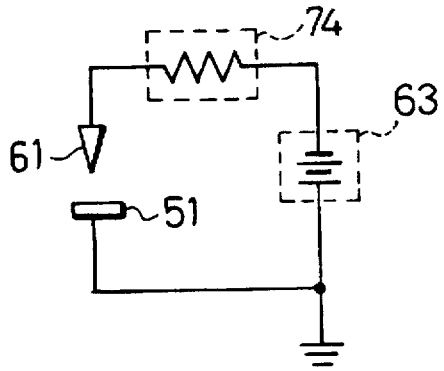
FIG. 33 is an explanatory view showing another embodiment of the present invention.

Another embodiment of the present invention will be explained in reference to FIG. 33. FIG. 33 is an explanatory view schematically showing a charging device in accordance with the present embodiment.

Figure 34:
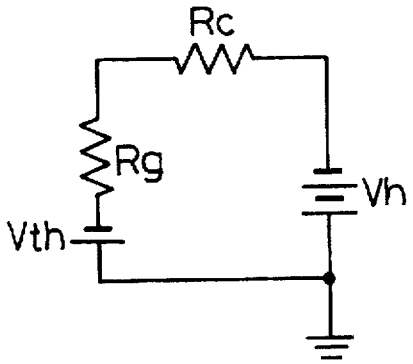
FIG. 34 is an equivalent circuit of a charging device of FIG. 33.

FIG. 11 is a diagram showing discharging characteristics of the charging device. FIG. 34 is an equivalent circuit diagram of the charging device.

The charging device is controlled under constant current, and is arranged as follows: When a high voltage $V_h$ is applied across discharging tip portions 61 and a photoreceptor drum 51 (space impedance $R_g$) via a resistor 74 (resistance value: $R_c$) from a high voltage generating section 63, a drop in voltage occurs at both terminals of the resistor 74 so as to stabilize an (applied) discharge current. A discharge current $I_p$ flowing through the equivalent circuit can be expressed by the following formula (17):

$$I_p=(V_h-V_{th})/(R_g+R_c) \quad (17)$$

Here, the discharge current $I_p$ indicates a sum of the discharge currents when a discharge current of 1 to 1.5 μA flows through each tip portion, the high voltage $V_h$ has an upper limit value of 7 kV, a discharge starting voltage $V_{th}$ is in a range of 3.2 to 3.8 kV when a discharge gap in a range of 7 to 9 mm is given, and the space impedance $R_g$ is in a range of 150 to 950 MΩ in consideration of surrounding conditions when the discharge gap in a range of 7 to 9 mm is given.

Figure 35:
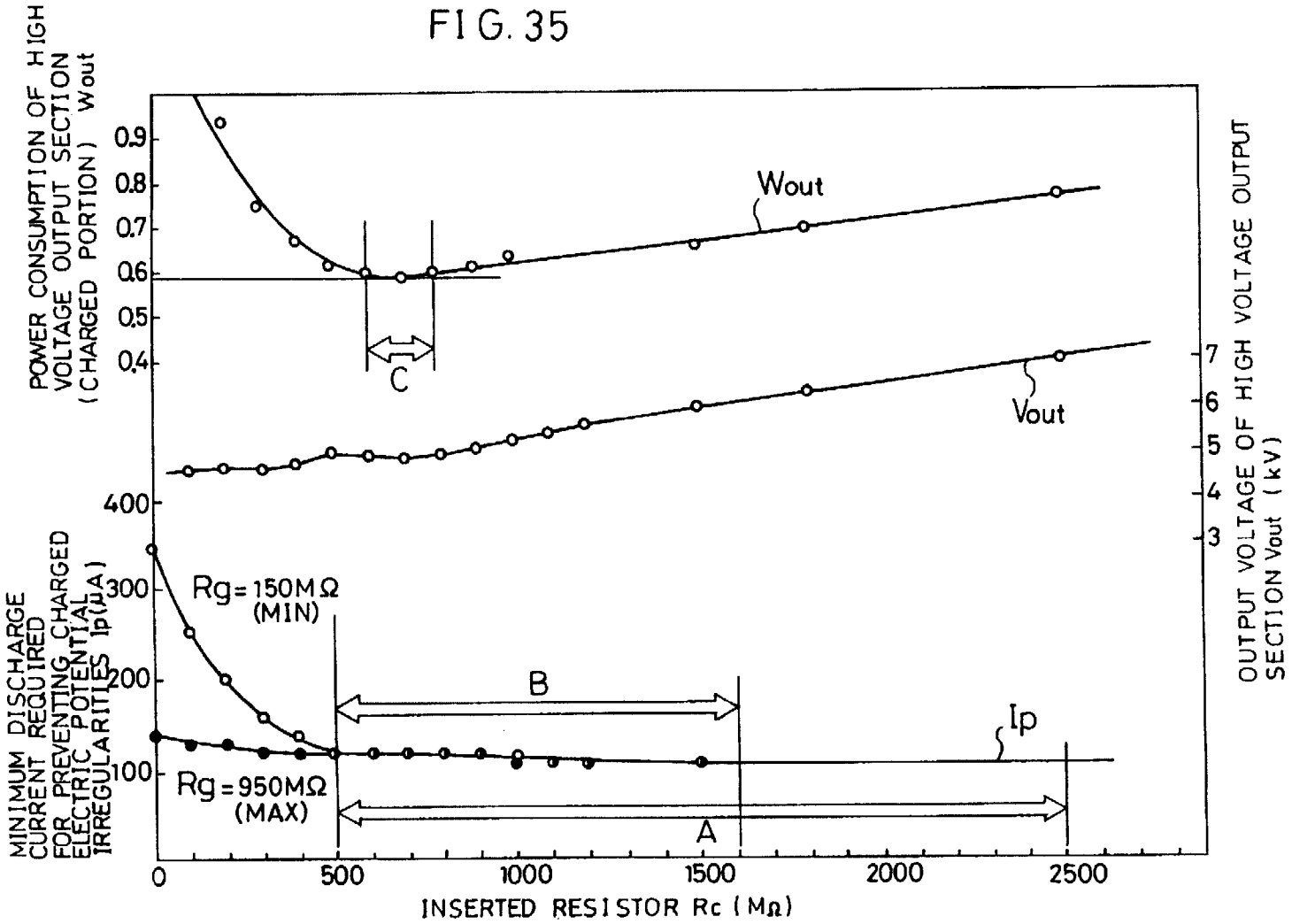
FIG. 35 is an explanatory view showing respective correlations with respect to a resistance value of an inserted resistor of a lower limit discharge current required for preventing charged electric potential irregularities, an output voltage of a high voltage output section (high voltage transformer) and of a required power consumption of the high voltage output section.

FIG. 35 shows respective correlations (1) of the lower limit discharge current $I_p$ required for preventing charged electric potential irregularities, (2) of an output voltage $V_{out}$ ($R_g$=150 MΩ) of the high voltage output section (high voltage transformer) and (3) of power consumption $W_{out}$ ($=I_p \times V_{out}$) of the high voltage output section respectively with respect to the resistance value $R_c$ of the inserted resistor 74 based on observed values. As is evident from FIG. 35, the greater the resistance value $R_c$, the more discharge irregularities can be absorbed, and the smaller the lower limit value for the discharge current $I_p$ required for preventing charged electric potential irregularities.

Under the condition of $R_c \geqq 500$ (MΩ), the discharge current $I_p$ reaches a saturated level. Therefore, it is preferable to set the resistance value $R_c$ in this range. Here, the greater is the resistance value $R_c$, the higher the voltage to be applied to the resistor 74. However, in consideration of cost and space, generally, the voltage has an upper limit voltage of around 7 kV. In this case, the resistance value of the resistor would be 2,500 MΩ (see FIG. 35).

On the other hand, it is unpreferable to set the resistance value below 500 MΩ for the following reason. In this case, the lower limit of discharge current required for preventing charged electric potential irregularities greatly varies depending on the level of the space impedance $R_g$ (the impedance between the discharging tip portions and the surface of the photoreceptor, which varies within the range of 150 MΩ to 950 MΩ in accordance with the surrounding condition such as humidity, etc.), and such variations in discharge current cause an unstable discharging operation.

Therefore, by inserting the resistor 74 with a resistance value in the range of 500 MΩ$\leqq R_c \leqq$2,500 MΩ (the range denoted by A in FIG. 35), the surface of the photoreceptor can be uniformly charged under an applied lower limit discharge current without being affected by the space impedance, and an inexpensive charging device can be achieved.

It is especially preferable that the resistor 74 with a resistance value in a range of 600 MΩ$\leqq R_c$800 MΩ is inserted. This is because, the power consumption $W_{out}$ is minimized in the described range of 600 MΩ$\leqq R_c \leqq$800 MΩ (the range denoted by C in the figure) from FIG. 35. As a result, as the required high voltage capacitance can be reduced, not only can a charging device of compact size and reduction in power consumption be achieved, but also the surface of the photoreceptor drum 51 can be charged uniformly under an applied minimum discharge current without having adverse effects from the space impedance $R_g$.

Figure 36:
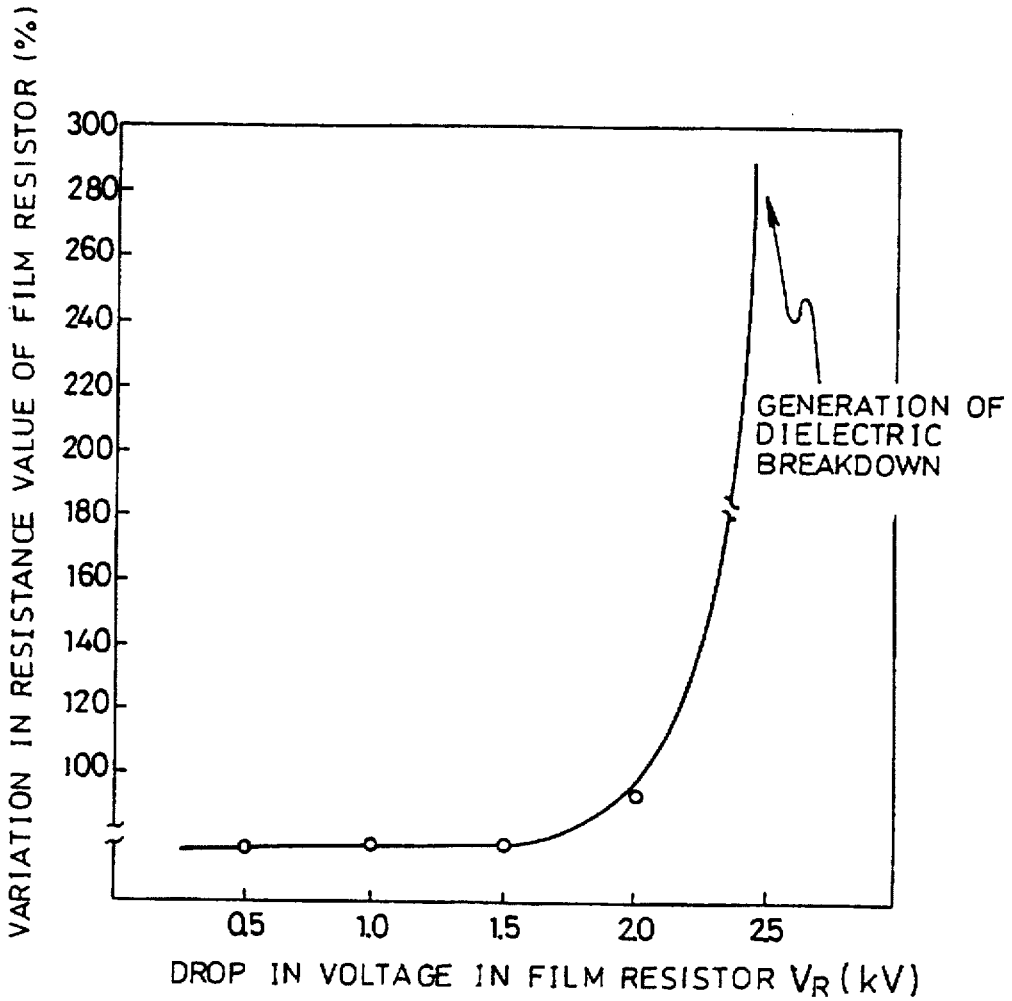
FIG. 36 is an explanatory view showing resistance values that vary in response to a voltage applied to both ends of the resistor when a film resistor is adopted as the inserted resistor.
Figure 37:
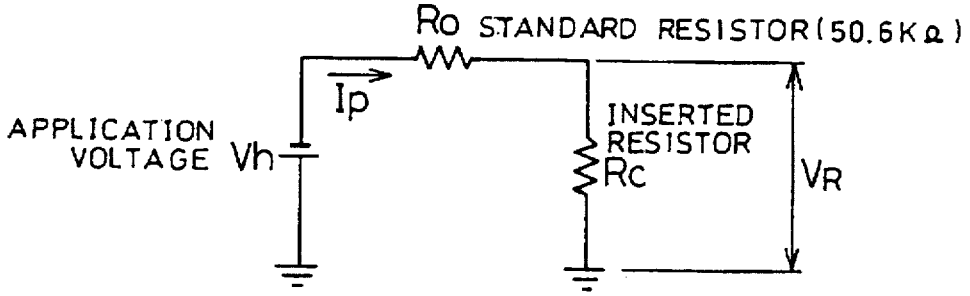
FIG. 37 is a circuit diagram adopted to obtain characteristics shown in FIG. 36.

Here, the kind of the inserted resistor 74 will be explained. It is beneficial to use the resin resistor such as a film resistor, etc., as the resistor 74 in terms of cost, etc. In this case, as shown in FIG. 36, the resistance value varied according to a voltage to be applied across the resistor 74. FIG. 36 shows the results of respective rates of change in resistance values $R_c$ of the inserted resistor 74 measured before and after (a time elapsed of 30 minutes) the voltage $V_h$ is applied to the inserted resistor 74 (resistance value $R_c$) under an applied voltage $V_h$ in a range of 1.9 kV to 2.5 kV (at an interval of 0.5 kV).

Here, the upper limit of the resistance value $R_c$ in the case where the film resistor is adopted as the resistor will be explained below.

As is evident from FIG. 36, when the voltage of not less than 2 kv is applied, the film resistor causes an insulation breakdown. Therefore, it is preferable not to apply a voltage of more than 2 kV to the film resistor. Therefore, the condition of $I_p \times R_c$=2,000 in the formula (17) is preferable. From the aforementioned formula (3), the discharge gap $L_g$ is 9.0 (mm) when the space impedance $R_g$ is set to 950 MΩ. Here, the discharge starting voltage of $V_{th} \approx 3.78$ (kV) is obtained from the formula (2). In view of cost, required space, etc., generally, the high voltage has the upper limit of around 7 kV. As described, the discharge current $I_p$ per discharge tip portion is given by the formula (16):

$$I_p=(V_h-V_{th})/(R_g+R_c)=(7{,}000-3{,}780-2{,}000)/(950\times10^6)\approx1.28\ (\mu A)$$

Here, as the withstanding voltage of the film resistor is not more than 2 kV, the resistance value $R_c$ would be $R_c$=2,000/($1.28\times10^{-6}$)≈1563 (MΩ), and the resistance value $R_c$ preferably has the upper limit value of around 1,600 (MΩ).

As described, by adopting the resin resistor such as an inexpensive film resistor, etc., the resistance value can be set in a range of 500 MΩ$\leqq R_c \leqq$1,600 MΩ (the area denoted by A in FIG. 35), the surface of the photoreceptor drum 51 can be uniformly charged under an applied discharge current of a lower limit value without increasing the size of the charging device nor having an adverse effect from the space impedance. Moreover, a charging device can be obtained still more economically.

Figure 38:
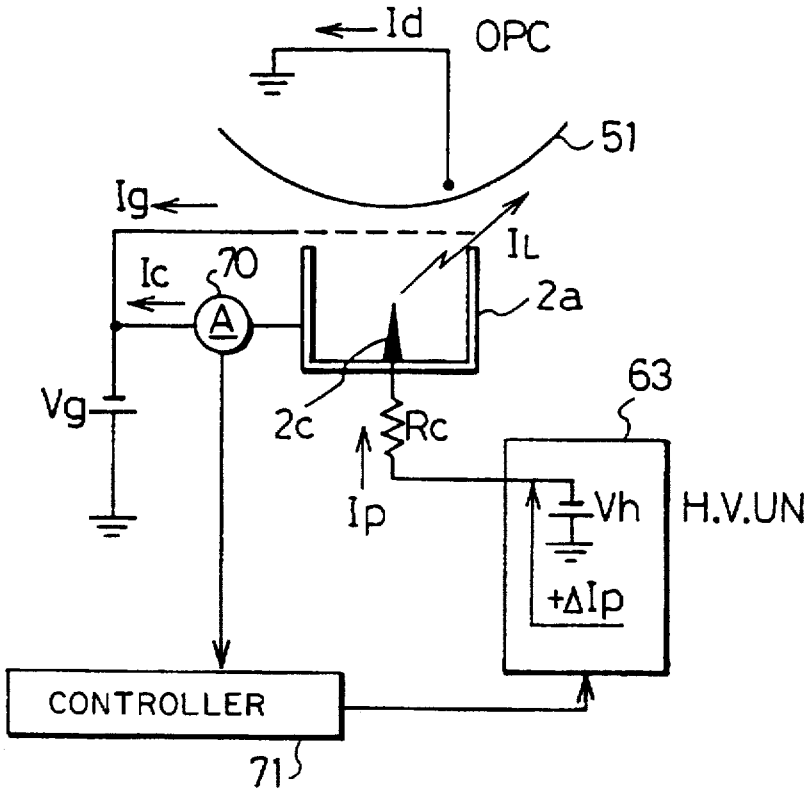
FIG. 38 is an explanatory view showing an example structure in accordance with still another embodiment of the present invention.

A still another embodiment of the present invention will be explained in reference to FIG. 38. The arrangement of FIG. 38 includes a current detector 70 for detecting the current $I_c$ (μA) flowing through the MC case 2a from the discharge electrode 2c. The detected current $I_c$ is sent to controller 71. Controller 71 calculates $\Delta I_c$ which satisfies the condition of $A \leqq \Delta I_p \leqq (A+A^2/I_p)$ wherein $A=(I_p-7I_c/3)$, and the calclulated value is outputted to the high voltage generating section 63. The high voltage generating section 63 feeds back the $\Delta I_p$ to the discharge current $I_p$ to compensate for the current $I_L$ (μA) flowing in the air from the discharge electrode 2c.

The discharge current $I_p$ is expressed by $I_p=I_g+I_c+I_d+I_L$. In the normal surrounding conditions, $I_L \approx 0$. However, when the surrounding conditions are varied to high temperature and high humidity, the current $I_L$ increases. Further, when the current $I_L$ starts flowing, the respective parameters $I_g$, $I_c$ and $I_d$ decrease.

Under such circumferences, the drum current $I_d$ slightly reduces, and the level of the charge potential is lowered (for example, from −600 V to −580 V). The respective reductions in $I_g$ and $I_c$ also cause charged electric potential irregularities (for example, charged electric potential irregularities ΔV increase from±30 V to±50 V). As described, the stability in discharging operation and uniformity in charging operation cannot be maintained, thereby presenting the problem that the charged electric potential irregularities occur which would adversely affect the formation of an image. According to the arrangement of the present embodiment, however, as the increased $I_L$ is compensated by feeding back the current corresponding to $I_L$ to the MC charger 52, the conditions can be approximated to normal temperature and normal humidity, thereby permitting a uniform charging and stable discharging operations irrespectively of the surrounding conditions as described below in detail.

Assumed here that the condition of $I_g:I_c:I_d$=3:3:1 is set in initialization. When the surrounding conditions are changed to the critical conditions of high temperature and high humidity, $I_L$ increases. Here, it is assumed that the condition of $I_g:I_c:I_d=3:3:1$ is maintained irrespectively of a change in surrounding conditions. Then, the discharge current $I_p$ is maintained constant by feeding back the amount of current $\Delta I_p=I_p-(I_g+I_c+I_d)=(I_p-7I_c/3)$ to the discharge current $I_c$, thereby compensating for the effect of $I_L$.

Figure 39:
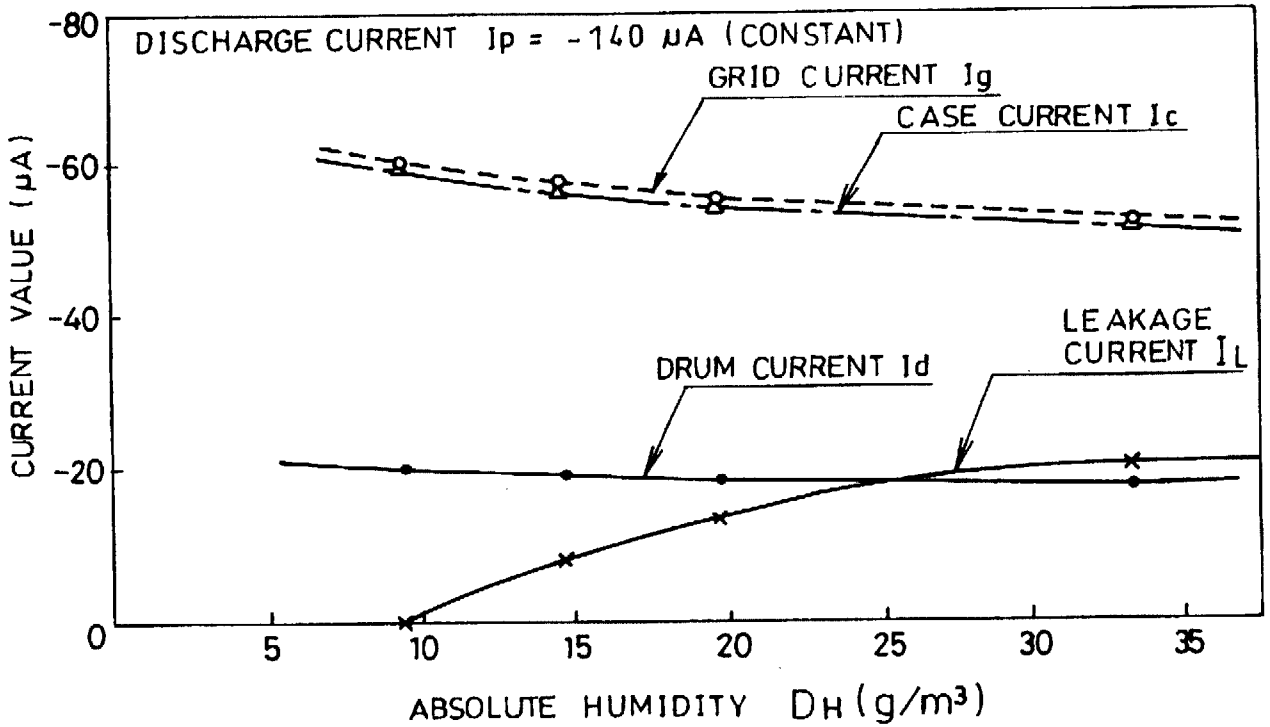
FIG. 39 is an explanatory view showing an absolute humidity dependency of each current value for $I_g$, $I_c$ and $I_d$ and $I_L$ when $\Delta I_p=(I_p-7I_c/3)$ is fed back to the discharge current $I_p$.

The experiment shows that in the case where $\Delta I_p=(I_p-7I_c/3)$ is fed back to the discharge current $I_p$, respective current values for $I_g$, $I_c$, $I_d$ and $I_L$ vary according to the absolute humidity as shown in FIG. 39. As evident from FIG. 39, the higher is the absolute humidity, the greater is $I_L$; however, $I_p$ is maintained constant by feeding back $\Delta I_p$, thereby maintaining the correlation between $(I_g/I_d)$ and $(I_c/I_d)$ substantially constant. Namely, by setting the current distribution ratio among $I_g$, $I_c$ and $I_d$ to an optimal ratio $(I_g:I_c:I_d=3:3:1)$, the condition of $3I_d=I_c=I_g$ can be maintained while having almost no change in ratio irrespectively of a change in absolute value in accordance with a change in surrounding conditions. FIG. 39 is based on the results of measurements of the following table 3.

TABLE 3

| | ABSOLUTE HUMIDITY ($g/m^3$) | $I_g$ | $I_c$ | $I_d$ | $I_l$ | $I_p$ |
|---|---|---|---|---|---|---|
| (1) | 9.51 | −60 | −60 | −20 | 0 | −140 |
| (2) | 14.98 | −57 | −56 | −19 | −8 | −140 |
| (3) | 19.73 | −55 | −54 | −18 | −13 | −140 |
| (4) | 33.64 | −52 | −51 | −17 | −20 | −140 |

In Table 3, (1) through (4) respectively correspond to absolute humidities in FIG. 39 in this order from the smallest humidity value. Namely, (1) corresponds to the condition of temperature 20° C., relative humidity 55%, (2) corresponds to the condition of temperature 25° C., relative humidity 65%, (3) corresponds to the condition of temperature 30° C., relative humidity 65%, and (4) corresponds to the condition of temperature 35° C., relative humidity 85%. Here, $I_g$ through $I_p$ are expressed in unit μA. The absolute humidity $(D_H)$ can be converted by the following formula (18):

$$D_H=0.794e_s(R_H/100)/(1+0.00366t) \quad (18)$$

wherein $R_H$ is a relative humidity, t is temperature and $e_s$ is a saturated vapor pressure at temperature t.

The case current $I_c$ is detected by the current detecting unit 70, and controller 71 calculates $\Delta I_p=(I_p-7I_c/3)$ $(=I_L)$ based on detected $I_c$, and is sent to the high voltage generating section 63 as an amount of current which compensates for the current $I_L$ flowing in the air. In the high voltage generating section 63, $\Delta I_p$ is fed back with respect to the discharge current $I_p$. As a result, the parameters $I_g$, $I_c$ and $I_d$ are respectively reduced by amounts of $\Delta I_g$, $\Delta I_c$ and $\Delta I_d$ respectively (In this state, the condition of $I_g:I_c:I_d=3:3:1$ is substantially satisfied, and the condition of $\Delta I_p=\Delta I_g+\Delta I_c+\Delta I_d$ is satisfied). However, the discharge current $I_p$ is maintained constant at −140 μA before and after the feedback.

Figure 40:
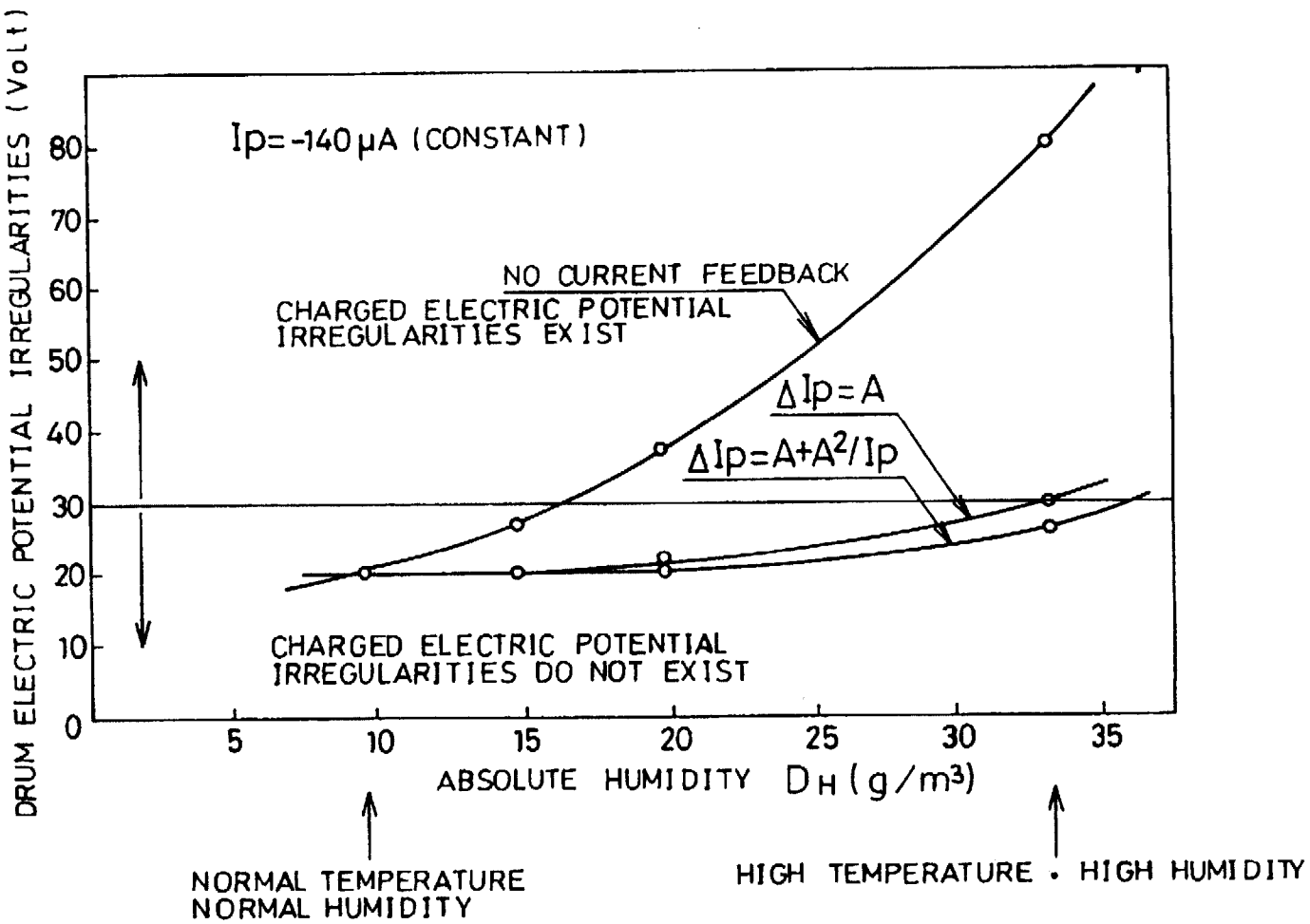
FIG. 40 is an explanatory view of charged electric potential irregularities $\Delta V$ on the surface of the photoreceptor with respect to an absolute humidity when $\Delta I_p=(I_p-7I_c/3)$ is fed back to the discharge current $I_p$.
Figure 41:
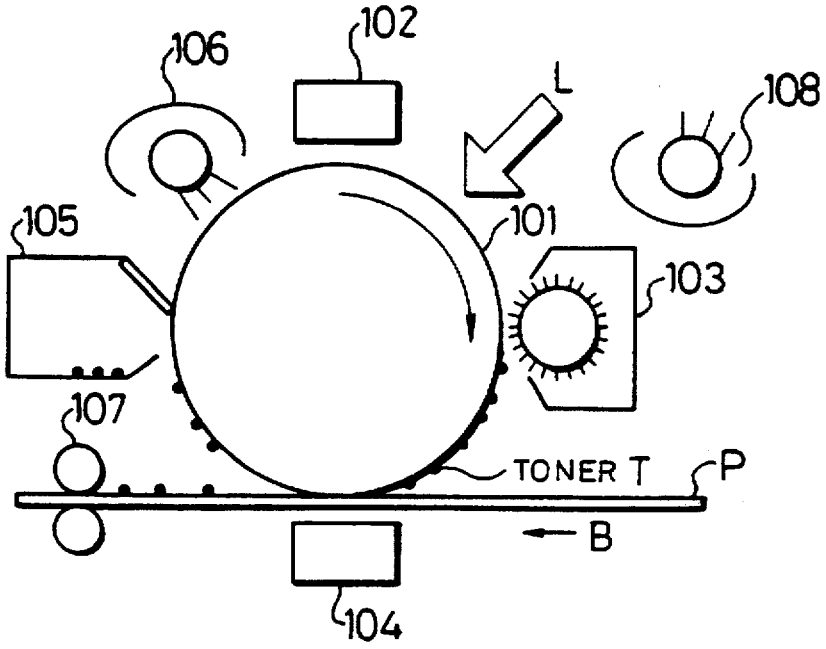
FIG. 41 PRIOR ART
FIG. 41 is an explanatory view showing an example structure of a copying machine with conventional charging device.
Figure 42:
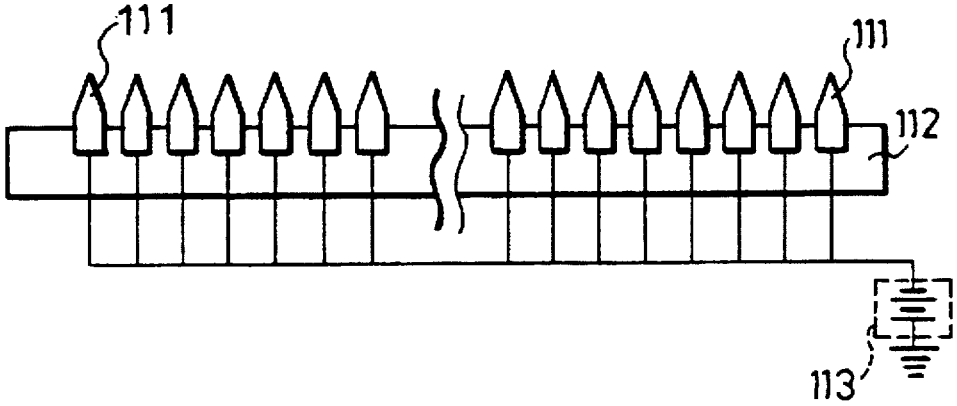
FIG. 42 PRIOR ART
FIG. 42 is an explanatory view showing a conventional saw-toothed electrode composed of a plurality of electrodes with discharging tip portion.
Figure 43:
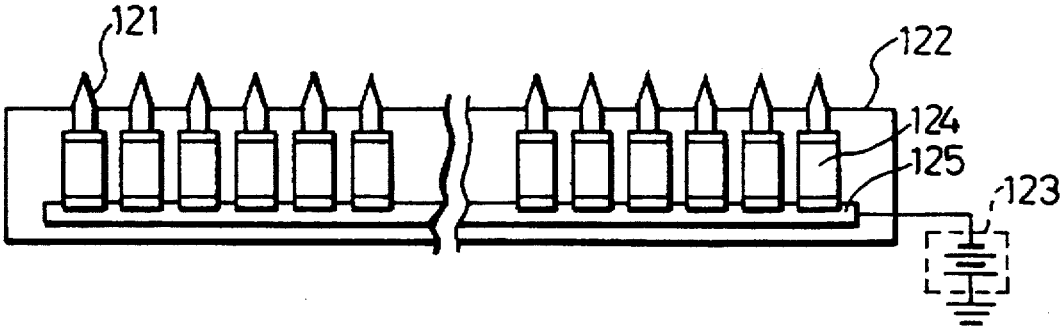
FIG. 43 PRIOR ART
FIG. 43 is an explanatory view showing an example structure for controlling a current to stably flow in each discharge electrode by connecting each discharge electrode to a high voltage power source through a corresponding resistor in a conventional corona discharge device with saw-toothed electrode of FIG. 42.

As described, when $\Delta I_L=(I_p-7I_c/3)=A$ is fed back to the discharge current $I_p$, the results of measurements of charged electric potential irregularities ΔA on the surface of the photoreceptor drum 51 with respect to the absolute humidity are shown in FIG. 40. As is evident from FIG. 40, when $\Delta I_p$ is not fed back to the charged electric potential irregularities, ΔV varies in response to the absolute humidity, and is increased to the level of 80 V under the critical surrounding conditions. In contrast, when $\Delta I_p=(I_p-7I_c/3)$ is fed back, the charged electric potential irregularities ΔV were suppressed to not more than 30 V even under the critical surrounding conditions. A copying operation was actually performed in the copying machine provided with the charging device having the described structure. As a result, an image of a stable quality was obtained.

When $\Delta I_p$ is fed back, a part of the feedback current $\Delta I_p=I_L$ causes leakage current. This leakage current $\Delta I_L$ is given by the following formula:

$\Delta I_L=(\Delta I_p/I_p)\times I_L=(I_L)^2/A^2/I_p$. Therefore, when $\Delta I_p=(A+A^2/I_p)$ is fed back in replace of A, the charged electric potential irregularities ΔV can be reduced compared with the case of $\Delta I_p=A$. Namely, the charged electric potential irregularities can be still approximated to those under normal temperature and normal humidity. Furthermore, in consideration of the high feedback current, a still improvement of compensation precision can be expected. In practice, however, if the feedback current is set still higher, $\Delta I_p$ increases accordingly, and would result in an increase in an amount of ozone generated.

In consideration of the above, it is preferable that the feed back current $\Delta I_p$ satisfies the condition of $A\leqq\Delta I_p\leqq(A+A^2/I_p)$.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. A charging device provided with a discharge electrode having a plurality of discharging tip portions at predetermined intervals and an electrically conductive case for supporting said discharge electrode, said case being electrically insulated from said discharge electrode, said charging device generating discharge from said plurality of discharging tip portions with respect to a photoreceptor via a grid provided between said plurality of discharging tip portions and a surface of the photoreceptor according to a voltage applied to said discharge electrode in order to charge the surface of the photoreceptor, wherein:

a discharge current (μA), a grid current (μA) flowing through said grid and a leakage current (μA) leaking from said plurality of discharging tip portions to said electrically conductive case which are respectively designated by $I_p$, $I_g$ and $I_c$ are all set within an area surrounded by:

a straight line $I_p=-700$, a straight line $\log(I_g/I_c)=-8.78\times10^{-3}I_p-0.54$, and a straight line $\log(I_g/I_c)=5\times10^{-3}I_p+0.68$, in a coordinate system formed by a $\log(I_g/I_c)$ axis that is a common logarithm of $(I_g/I_c)$ and an axis of $I_p$ indicating the discharge current.

2. The charging device as set forth in claim 1, wherein:

said grid current $I_g$ flowing through said grid and said leakage current $I_c$ leaking from said plurality of discharging tip portions to said electrically conductive case satisfy $1<(I_g/I_c)\leqq10$.

3. A charging device provided with a discharge electrode having a plurality of discharging tip portions at predetermined intervals and an electrically conductive case for supporting said discharge electrode, said case being electrically insulated from said discharge electrode, said charging device generating discharge from said plurality of discharging tip portions with respect to a photoreceptor via a grid provided between said plurality of discharging tip portions and a surface of the photoreceptor according to a voltage applied to said discharge electrode in order to charge said surface of the photoreceptor, wherein:

a discharge current (μA), a grid current (μA) flowing through said grid and a leakage current (μA) leaking from said plurality of discharging tip portions to said electrically conductive case which are respectively designated by $I_p$, $I_g$, and $I_c$ are set within an area surrounded by:

a straight line $I_p=-400$, a straight line $\log(I_g/I_c)=-8.78\times10^{-3}I_p-2.32$, and a straight line $\log(I_g/I_c)=5\times10^{-3}I_p+1.68$ in a coordinate system formed by a $\log(I_g/I_c)$ axis that is a common logarithm of $(I_g/I_c)$ and an $I_p$ axis indicating the discharge current.

4. The charging device as set forth in claim 3, wherein:

said grid current $I_g$ flowing through said grid and said leakage current $I_c$ leaking from said plurality of discharging tip portions to said electrically conductive case satisfy $1<(I_g/I_c)\leqq10$.

5. A charging device provided with a discharge electrode having a plurality of discharging tip portions at predetermined intervals and an electrically conductive case for supporting said discharge electrode, said case being electrically insulated from said discharge electrode, said charging device generating discharge from said plurality of discharging tip portions with respect to a photoreceptor via a grid provided between said plurality of discharging tip portions and a surface of the photoreceptor according to a voltage applied to said discharge electrode in order to charge said surface of the photoreceptor, wherein:

a discharge current (μA), a grid current (μA) flowing through said grid, a leakage current (μA) leaking from said plurality of discharging tip portions to said electrically conductive case and an ambient absolute temperature (g/m$^3$) which are respectively designated by $I_p$, $I_g$, $I_c$ and $D_H$ are all set within an area surrounded by:

a straight line $I_p=-400$, a straight line $\log(I_g/I_c)=-8.78\times10^{-3}I_p-(0.07\times D_H-0.16)$, and a straight line $\log(I_g/I_c)=5\times10^{-3}I_p+(0.04\times D_H30\ 0.28)$, in a coordinate system formed by a $\log(I_g/I_c)$ axis that is a common logarithm of $(I_g/I_c)$, and an $I_p$ axis indicating the discharge current.

6. The charging device as set forth in claim 5, wherein:

said grid current $I_g$ flowing through said grid and said current leakage $I_c$ leaking from said plurality of discharging tip portions to said electrically conductive case satisfy $1<(I_g/I_c)\leqq10$.

7. A charging device provided with a discharge electrode having a plurality of discharging tip portions at predetermined intervals and an electrically conductive case whose surface facing a photoreceptor is an opening, for supporting said discharge electrode, said case being electrically insulated from said discharge electrode, said charging device generating discharge from said plurality of discharging tip portions with respect to said photoreceptor via a grid provided between said plurality of discharging tip portions and a surface of the photoreceptor according to a voltage applied to said discharge electrode in order to charge said surface of the photoreceptor, wherein:

an opening width (mm) of said electrically conductive case, a process speed (mm/sec), and a film thickness (μm) of the photoreceptor which are respectively designated by $L_c$, $v_p$ and $t_{opc}$ are all set within an area surrounded by:

a straight line $L_c=30$, and a straight line $L_c=3.02\times10^{-6}(v_p/t_{opc})$ in a coordinate system formed by an axis $L_c$ and an axis $v_p$.

8. A charging device provided with a discharge electrode having a plurality of discharging tip portions at predetermined intervals and an electrically conductive case whose surface facing a photoreceptor is an opening, for supporting said discharge electrode, said case being electrically insulated from said discharge electrode, said charging device generating discharge from said plurality of discharging tip portions with respect to said photoreceptor via a grid provided between said plurality of discharging tip portions and a surface of the photoreceptor according to a voltage applied to said discharge electrode in order to charge said surface of the photoreceptor, wherein:

an opening width (mm) of said electrically conductive case, and a distance between said plurality of discharge electrodes and said grid which are respectively designated by $L_c$ and $L_{pg}$ are set so as to satisfy $0.4\leqq-L_{pg}/L_c\leqq0.5$.

9. A charging device provided with a discharge electrode having a plurality of discharging tip portions formed at predetermined intervals, said charging device generating discharge from said plurality of discharging tip portions with respect to a photoreceptor via a grid provided between said plurality of discharging tip portions and a surface of said photoreceptor according to a voltage applied to said discharge electrode in order to charge said surface of the photoreceptor to a predetermined potential, wherein:

when a minimum discharge current for charging the surface of the photoreceptor to the predetermined potential and a minimum discharge current for suppressing charged electric potential irregularities on the surface of the photoreceptor within a permissible range are respectively designated by $I_{p1}$ and $I_{p2}$, the voltage to be applied to said grid is set so as to satisfy $I_{p1}\approx I_{p2}$.

10. A charging device provided with a discharge electrode having a plurality of discharging tip portions at predetermined intervals, said charging device generating discharge from said plurality of discharging tip portions with respect to a photoreceptor according to a voltage applied to said discharge electrode in order to charge a surface of said photoreceptor, wherein:

a pitch (mm) of the discharging tip portions, a discharging current (μA), and a distance (mm) between the discharging tip portions and the surface of the photoreceptor which are respectively designated by P, $I_p$ and $L_g$ are all set within an area surrounded by:

a straight line $I_p=-700$, and a curved line $I_p=[-89((L_g/P)-4.5)^2-295]$ in a coordinate system formed by an $I_p$ axis and an $(L_g/P)$ axis.

11. The charging device as set forth in claim 10, wherein:

said $I_p$, $L_g$ and P are set within an area surrounded by:

a straight line $I_p=-400$, and a curved line $I_p=[--89((L_g/P)-4.5)^2-295]$.

12. The charging device as set forth in claim 11, wherein said P is set corresponding to $L_g$ after $(L_g/P)$ is determined.

13. A method for designing a charging device which generates discharge with respect to a photoreceptor from a plurality of discharging tip portions at predetermined intervals via a grid to charge a surface of the photoreceptor, comprising the steps of:

setting an opening width $L_c$ (mm) of an electrically conductive case of the charging device and a distance $L_{pg}$ between said plurality of discharging tip portions and said grid so as to satisfy $9.4\leqq L_{pg}/L_c<0.5$;

setting a grid gap and a grid pitch;

setting a pitch P of the discharging tip portions, a discharge current $I_p$ (μA) and a distance $L_g$ between said plurality of discharge tip portions and the surface of the photoreceptor within an area surrounded by a straight line $I_p=-700$, and a curved line $I_p=|-89((L_g/P)-4.5)^2-295|$ in a coordinate system formed by an $I_p$ axis and an $(L_c/P)$ axis;

setting the discharge current $I_p$ (μA), a grid current $I_g$ (μA) and a leakage current $I_c$ (μA) leaking from the discharging tip portions to the electrically conductive case within an area surrounded by a straight line $I_p=-700$, a straight line $\log(I_g/I_c)=-8.78\times10^{-3}I_p-0.54$ and a straight line $\log(I_g/I_c)=5\times10^{-3}I_p+0.68$in a coordinate system formed by a $\log(I_g/I_c)$ axis that is a common logarithm of $(I_g/I_c)$ and an $I_p$ axis indicating the discharge current;

setting a voltage to be applied to said grid such that a minimum discharge current value required for charging the surface of the photoreceptor to a predetermined potential is substantially equal to a minimum discharge current required for suppressing charged electric potential irregularities on the surface of the photoreceptor within a permissible range; and setting a margin of the discharge current based on changes in charged electric potential of the photoreceptor and in charged electric potential irregularities due to changes in environmental conditions.

14. A charging device provided with a discharge electrode having a plurality of discharging tip portions formed at predetermined intervals and an electrically conductive case whose surface facing a photoreceptor is an opening, for supporting said discharge electrode, said case being electrically insulated from said discharge electrode, said charging device generating discharge from said plurality of discharging tip portions with respect to a photoreceptor via a grid provided between said plurality of discharging tip portions and surface of the photoreceptor according to a voltage applied to said discharge electrode in order to charge said surface of the photoreceptor, wherein:

a discharge current (μA), a current (μA) flowing through said grid, a leakage current (μA) leaking from the discharging tip portions to the electrically conductive case, and a current (μA) flowing through the photoreceptor which are respectively designated by $I_p$, $I_g$, $I_c$, and $I_d$ are all set within an area surrounded by:

$(I_g/I_d)+(I_c/I_d)=6$, $(I_g/I_d)+(I_c/I_d)=8$, $(I_c/I_d)=1$, and $(I_g/I_d)=1$, in a coordinate system formed by an $(I_g/I_d)$ axis and an $(I_c/I_d)$ axis.

15. The charging device as set forth in claim 14, wherein:

when a voltage equal to a grid voltage is applied to the electrically conductive case, a distance $L_{pg}$ between said plurality of discharging tip portions and said grid and a distance $l_c$ between the discharging tip portions and the electrically conductive case are set so as to satisfy $I_g \geqq I_d$ and $I_c \geqq I_d$.

16. The charging device as set forth in claim 14, wherein:

when a voltage equal to a grid voltage is applied to the electrically conductive case, a distance $L_{pg}$ between the discharging tip portions and said grid and a distance $l_c$ between the discharging tip portions and the electrically conductive case are set so as to satisfy $(L_{pg}/l_c) \approx 1.1$.

17. A charging device provided with a discharge electrode having a plurality of discharging tip portions formed at predetermined intervals and an electrically conductive case whose surface facing a photoreceptor is an opening, for supporting said discharge electrode, said case being electrically insulated from said discharge electrode, said charging device generating discharge from said plurality of discharging tip portions with respect to a photoreceptor via a grid provided between said plurality of discharging tip portions and a surface of the photoreceptor according to a voltage applied to said discharge electrode in order to charge said surface of the photoreceptor, wherein:

a minimum discharge current (μA) for uniformly charging the surface of the photoreceptor is applied to the discharge electrode, and a grid current (μA) flowing through said grid, a leakage current (μA) leaking from said plurality of discharging tip portions to said electrically conductive case, and a current (μA) flowing through the photoreceptor which are respectively designated by $I_g$, $I_c$ and $I_d$ are all set within an area surrounded by:

$(I_g/I_d)+(I_c/I_d)=6$, $1 \leqq (I_c/I_d) \leqq 5$, and $1 \leqq (I_g/I_d) \leqq 5$ in a coordinate system formed by an $(I_g/I_d)$ axis and an $I_c/I_d$ axis.

18. The charging device as set forth in claim 17, wherein:

said $I_g$, $I_d$, $I_c$ and $I_d$ respectively satisfy $(I_g/I_d)=(I_c/I_d)=3$.

19. The charging device as set forth in claim 17, wherein:

when a voltage equal to a grid voltage is applied to the electrically conductive case, a distance $L_{pg}$ between the discharging tip portions and said grid and a distance $l_c$ between the discharging tip portions and the electrically conductive case are set so as to satisfy $I_g \geqq I_d$ and $I_c \geqq I_d$.

20. The charging device as set forth in claim 17, wherein:

when a voltage equal to a grid voltage is applied to the electrically conductive case, a distance $L_{pg}$ between the discharging tip portions and said grid and a distance $l_c$ between the discharging tip portions and the electrically conductive case are set so as to satisfy $(L_{pg}/l_c) \approx 1.1$.

21. A charging device provided with a discharge electrode having a plurality of discharging tip portions at predetermined intervals and an electrically conductive case whose surface facing a photoreceptor is an opening, for supporting said discharge electrode, said case being electrically insulated from said discharge electrode, said charging device generating discharge from said plurality of discharging tip portions with respect to a photoreceptor via a grid provided between said plurality of discharging tip portions and a surface of the photoreceptor according to a voltage applied to said discharge electrode in order to charge said surface of the photoreceptor, wherein:

when a current (μA) flowing through the electrically conductive case in the discharging current $I_p$ (μA) is designated by $I_c$, said $I_c$ and $I_p$ are set so as to satisfy $0.1 \leqq (I_c/I_p) \leqq 0.8$.

22. The charging device as set forth in claim 21, wherein:

said $I_c$ and $I_p$ are set so as to satisfy $0.3 \leqq (I_c/I_p) \leqq 0.6$.

23. A charging device provided with a discharge electrode having a plurality of discharging tip portions at predetermined intervals and an electrically conductive case whose surface facing a photoreceptor is an opening, for supporting said discharge electrode, said case being electrically insulated from said discharge electrode, said charging device generating discharge from said plurality of discharging tip portions with respect to a photoreceptor via a grid provided between said plurality of discharging tip portions and surface of the photoreceptor according to a voltage applied to said discharge electrode in order to charge said surface of the photoreceptor, comprising:

means for detecting a current $I_c$ (μA) flowing through said electrically conductive case from said discharge electrode, wherein:

when a discharge current (μA), a grid current (μA) flowing through said grid from said discharge electrode, and a current (μA) flowing in an air from said discharge electrode are respectively designated by $I_p$, $I_g$ and $I_L$, and $A=(I_p-7I_c/3)$, said $I_L$ is compensated by feeding back $\Delta I_p$ satisfying the condition of $A \leqq \Delta I_p \leqq (A+A^2/I_p)$ to said discharge current $I_p$.

* * * * *